US006735404B2

(12) United States Patent
Higeta et al.

(10) Patent No.: US 6,735,404 B2
(45) Date of Patent: May 11, 2004

(54) PROCESS CARTRIDGE AND REMANUFACTURING METHOD THEREFOR

(75) Inventors: Akira Higeta, Shizuoka-ken (JP); Satoshi Yasuda, Toride (JP); Takayoshi Hoshi, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,870

(22) Filed: Jul. 31, 2002

(65) Prior Publication Data

US 2003/0202817 A1 Oct. 30, 2003

(30) Foreign Application Priority Data

Apr. 26, 2002 (JP) ..... 2002/126157

(51) Int. Cl.[7] ..... G03G 15/00
(52) U.S. Cl. ..... 399/109
(58) Field of Search ..... 399/102, 103, 399/105, 106, 109, 111, 113

(56) References Cited

U.S. PATENT DOCUMENTS

| | | | | |
|---|---|---|---|---|
| 5,485,249 A | | 1/1996 | Higeta et al. | |
| 5,740,499 A | | 4/1998 | Higeta et al. | 399/105 |
| 5,809,374 A | | 9/1998 | Tsuda et al. | 399/111 |
| 6,101,348 A | | 8/2000 | Nonaka et al. | 399/103 |
| 6,397,025 B1 | | 5/2002 | Higeta et al. | 399/109 |
| 6,400,914 B1 | | 6/2002 | Noda et al. | 399/90 |
| 6,493,527 B1 | * | 12/2002 | Higeta et al. | 399/111 |
| 6,505,020 B1 | * | 1/2003 | Higeta et al. | 399/109 |
| 6,519,430 B2 | * | 2/2003 | Higeta et al. | 399/109 |
| 6,574,445 B2 | * | 6/2003 | Higeta et al. | 399/103 |
| 6,577,829 B2 | * | 6/2003 | Higeta et al. | 399/109 |

* cited by examiner

*Primary Examiner*—William J. Royer
(74) *Attorney, Agent, or Firm*—Fitzpatrick, Cella, Harper & Scinto

(57) ABSTRACT

A remanufacturing method is disclosed for a process cartridge detachably mountable to a main assembly of an electrophotographic image forming apparatus, wherein the process cartridge includes first and second frames rotatably coupled relative to each other. The remanufacturing method includes (a) a separating step of separating the first and second frames; (b) a step of dismounting a developing roller mounted in the second frame; (c) a step of peeling off an elastic sealing member for providing a seal between the second frame and the developing roller; (d) a step of sticking a double coated tape on a seat on which the elastic sealing member has been stuck; (e) a step of filling developer into a developer accommodating portion of the second frame; (f) a step of mounting a developing roller to the second frame; and (g) a step of coupling the separated first and second frames.

30 Claims, 31 Drawing Sheets

PROCESS CARTRIDGE AND REMANUFACTURING METHOD THEREFOR

BACKGROUND OF THE INVENTION

Field of the Invention

The present invention relates to a process cartridge and a remanufacturing method for the process cartridge. The process cartridge is a cartridge or unit which contains as a unit at least an electrophotographic photosensitive drum and developing means (developing member) and which is detachably mountable to a main assembly of an electrophotographic image forming apparatus.

The electrophotographic image forming apparatus may be an electrophotographic copying machine, an electrophotographic printer (a LED printer, a laser beam printer or the like), an electrophotographic printer type facsimile machine, an electrophotographic printer type word processor or the like.

In an image forming apparatus using an electrophotographic image forming process, a process cartridge type in which an electrophotographic photosensitive member and process means actable on the electrophotographic photosensitive member are contained as a unit in a process cartridge which is detachably mountable to the main assembly of the image forming apparatus, has been used. The process cartridge type is advantageous in that maintenance operations can be performed not by a service person but by the user in effect, and therefore, the operation property has been significantly improved. Therefore, the process cartridge type is widely used in electrophotographic image forming apparatus.

The process cartridge forms an image on a recording material using a developer. Therefore, the developer is consumed with the image forming operation. When the developer is consumed up to such an extent that a user is not satisfied with the image quality, the commercial value of the process cartridge is lost.

It is desired that such a used process cartridge is given a commercial value, again by remanufacturing the process cartridge through an easy method.

SUMMARY OF THE INVENTION

Accordingly, it is a principal object of the present invention to provide a simple remanufacturing method for a process cartridge.

It is another object of the present invention to provide a remanufacturing method of a process cartridge wherein the process cartridge with which the developer is consumed to such an extent that a user is not satisfied with the image quality is recycled to be given a commercial value.

According to an aspect of the present invention, there is provided a remanufacturing method for a process cartridge detachably mountable to a main assembly of an electrophotographic image forming apparatus, wherein the process cartridge comprises a first frame supporting an electrophotographic photosensitive drum and a second frame which supports a developing roller for developing an electrostatic latent image formed on the electrophotographic photosensitive drum and which includes a developer accommodating portion accommodating a developer to be used for development of the electrostatic latent image by the developing roller, wherein the first frame and the second frame are rotatably coupled, the remanufacturing method comprising (a) a separating step of separating the first frame and the second frame from each other; (b) a developing roller dismounting step of dismounting the developing roller mounted in the second frame; (c) an elastic sealing member peeling step of peeling off an elastic sealing member for providing a seal between the second frame and the developing roller, wherein the elastic sealing member has been stuck in a longitudinal direction of the second frame; (d) an elastic sealing member sticking step of sticking a double coated tape on a seat on which the elastic sealing member has been stuck in a widthwise direction of the seat such that it protrudes toward the developing roller and resticking an elastic sealing member using the double coated tape; (e) a developer filling step of filling the developer into the developer accommodating portion; (f) a developing roller mounting step of mounting a developing roller to a second frame; and (g) a frame coupling step of coupling separated first and second frames with each other.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Next, the preferable embodiments of the present invention will be described. In the following descriptions, the widthwise direction means the direction in which a process cartridge B is mounted into, or dismounted from, the apparatus main assembly 14. It coincides with the direction in which a recording medium is conveyed. The lengthwise direction of the process cartridge B means the direction perpendicular (approximately perpendicular) to the direction in which the process cartridge B is mounted into, or dismounted from, the apparatus main assembly 14. Further, the left or right side of the process cartridge B means the left or right side as seen from above, from the downstream side in terms of the direction in which recording medium is conveyed.

Figure 1:
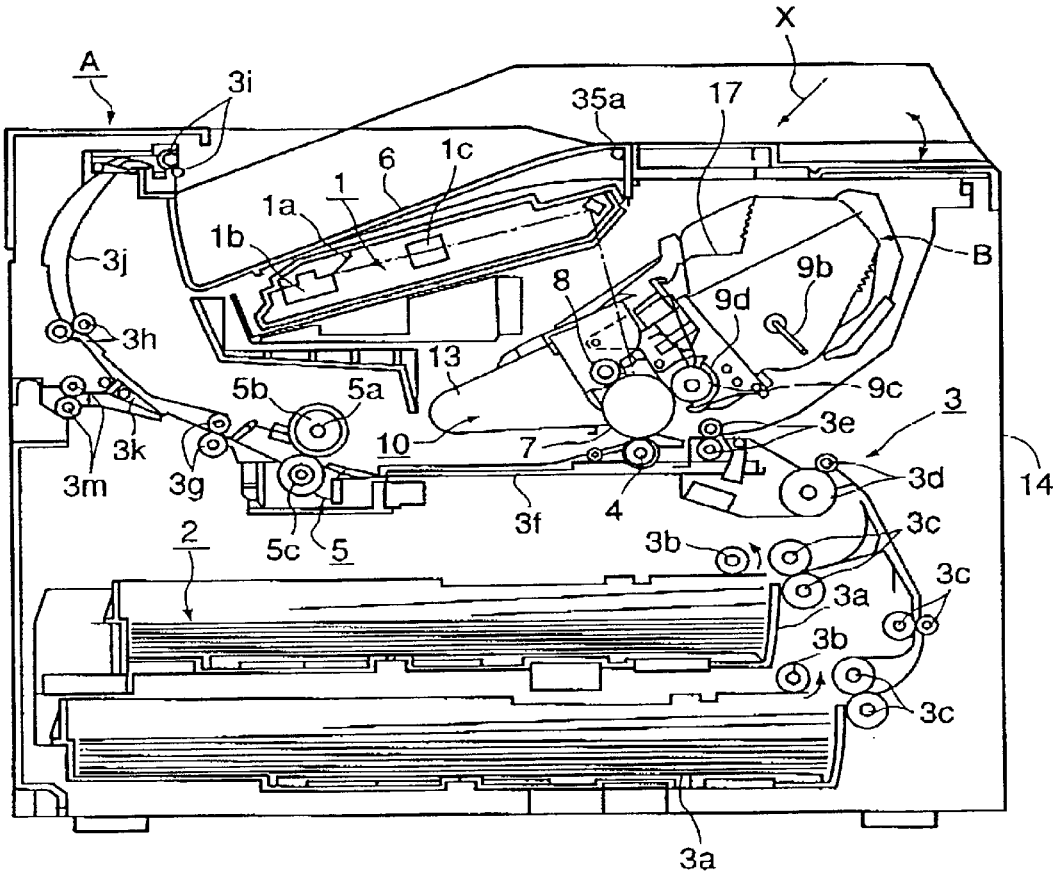
FIG. 1 is a longitudinal sectional view of an electrophotographic image forming apparatus.
Figure 2:
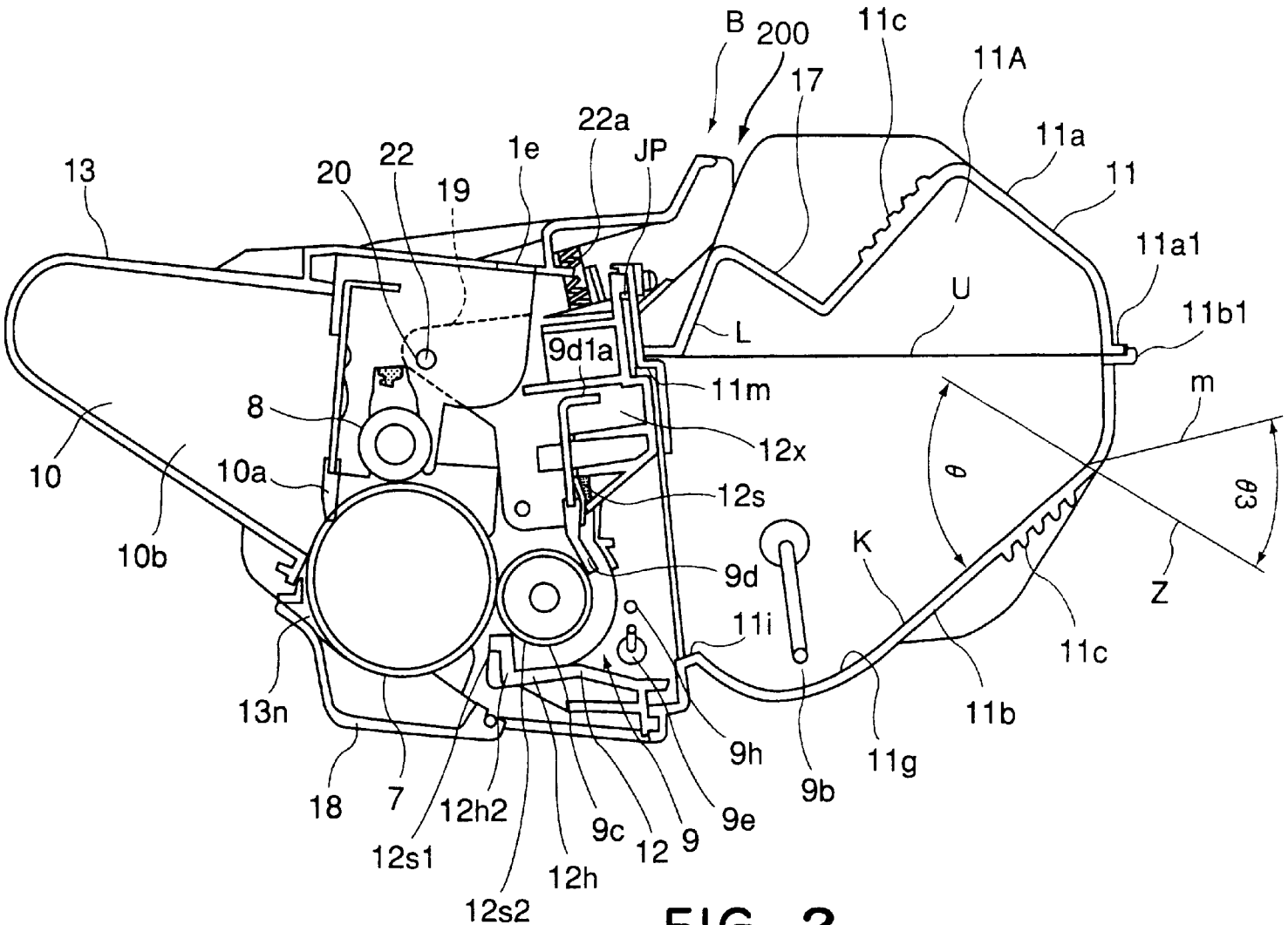
FIG. 2 is a longitudinal sectional view of a process cartridge.
Figure 3:
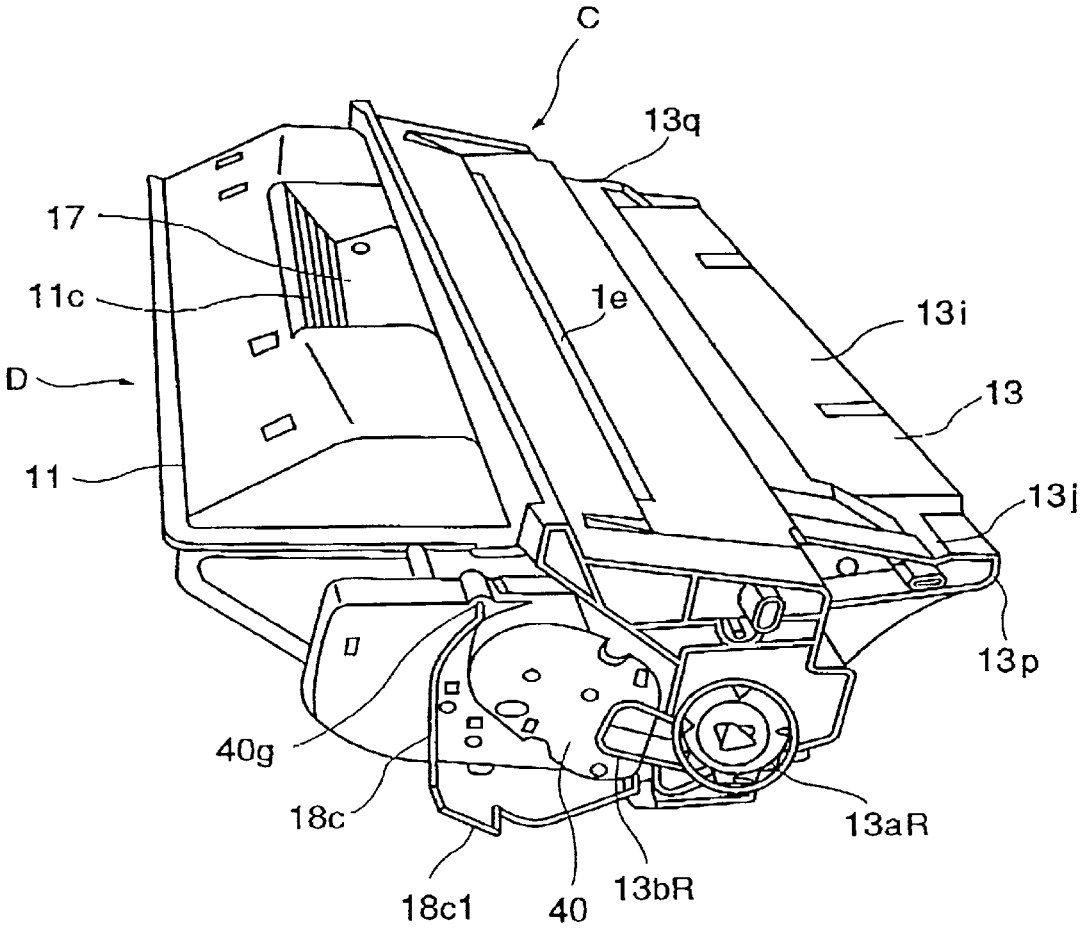
FIG. 3 is a e view of the process cartridge of FIG. 2 as seen from the upper right.
Figure 4:
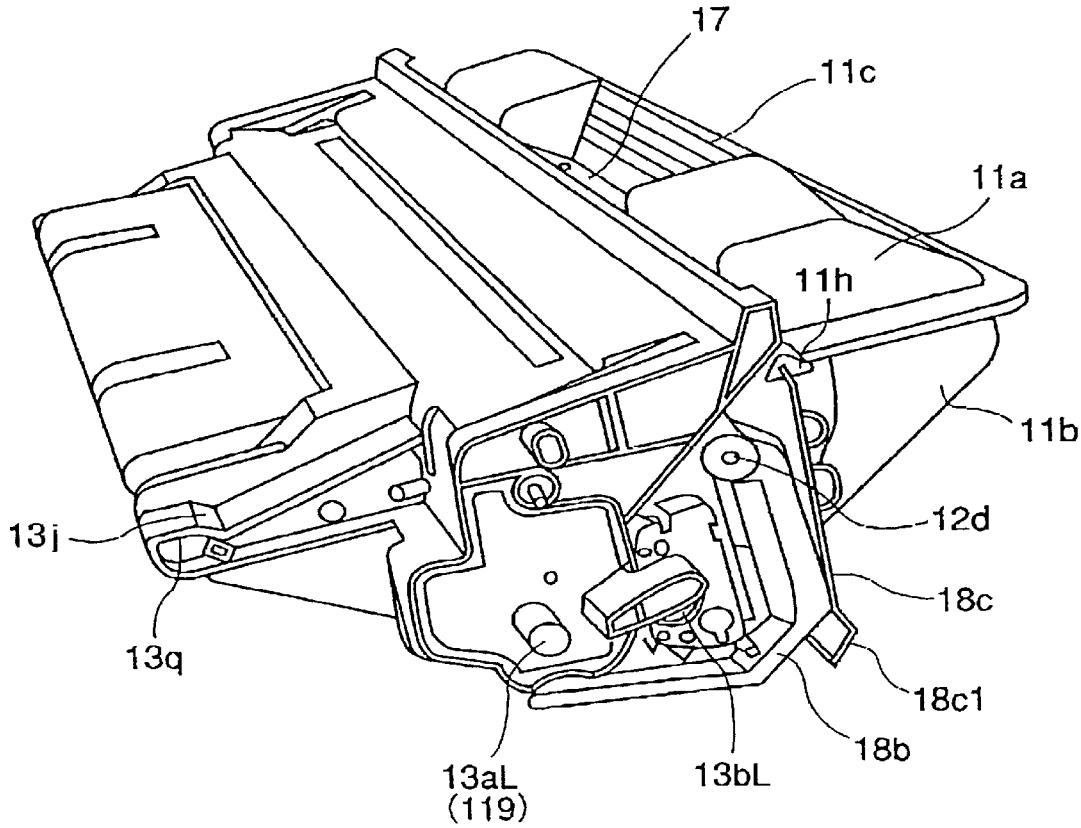
FIG. 4 is a perspective view of the process cartridge of FIG. 2 as seen from the upper left.
Figure 5:
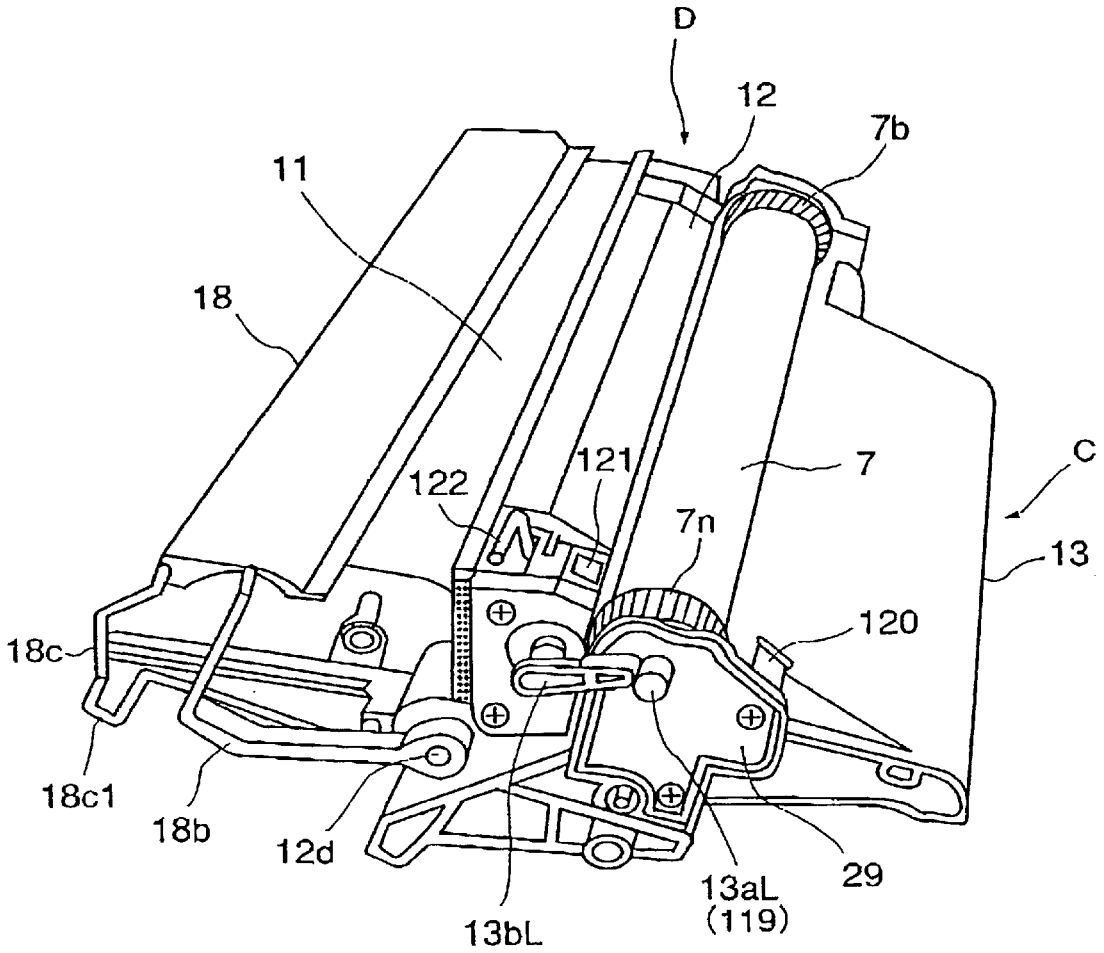
FIG. 5 is a perspective view of the process cartridge of FIG. 2 as seen from the bottom left.

FIG. 1 is a sectional view of an electrophotographic image forming apparatus (laser beam printer) in accordance with an embodiment of the present invention, for depicting the structure thereof. FIGS. 2–5 are drawings of the process cartridge B in the embodiment of the present invention. More specifically, FIG. 2 is a sectional view of the process cartridge B, at a plane perpendicular to the lengthwise direction of the process cartridge B, and FIG. 3 is an external perspective view of the process cartridge B. FIG. 4 is a perspective view of the process cartridge B as seen from diagonally above, and FIG. 5 is a perspective view of the process cartridge B, as seen from diagonally above, with the process cartridge B being positioned upside down. In the following description of the process cartridge B, the top surface of the process cartridge B means the external surface of the process cartridge B, which faces upward when the process cartridge B is in the proper position in the apparatus main assembly 14, and the bottom surface is the external surface of the process cartridge B which faces downward when the process cartridge B is in the proper position in the apparatus main assembly 14.

First, referring to FIG. 1, a laser beam printer A as an example of an electrophotographic image forming apparatus to which this embodiment of the present invention is applicable will be described. As shown in FIG. 1, the laser beam printer A is an apparatus which forms an image on recording medium (for example, recording paper; OHP sheet, fabric, and the like) with the use of an electrophotographic image forming process. As for an image forming process, first, a toner image, that is, a visual image formed of developer (which hereinafter will be referred to as toner) is formed on an electrophotographic photosensitive member 7 in the form of a drum (which hereinafter will be referred to as a photosensitive drum 7). More specifically, first, the photosensitive drum 7 is charged by a charging means, and then, is exposed to a beam of laser light projected from an optical means while being modulated with the image formation data. As a result, a latent image reflecting the image formation data is formed on the photosensitive drum. This latent image is developed by a developing means into a toner image. Meanwhile, in synchronism with the formation of the toner image, a recording medium 2 set in a cassette 3*a* is fed into the apparatus main assembly 14 by a pickup roller 3*b*, a pair of conveying rollers 3*c* and 3*d*, and a registration roller pair 3*e*. During this feeding of the apparatus main assembly 14, the recording medium 2 is placed upside down. Next, the toner image on the photosensitive drum 7 is transferred onto the recording medium 2 by applying voltage to a transfer roller 4 as a transferring means. Thereafter, the recording medium 2 having received the toner image is conveyed to a fixing means 5 by a conveying guide 3*f*. The fixing means 5 has driving roller 5*c* and fixing roller 5*b*. The fixing roller 5*b* contains a heater 5*a*. In the fixing means 5, heat and pressure are applied to the recording medium 2 as the recording medium 2 is passed through the fixing means 5. As a result, the toner image is fixed to the recording medium 2. Then, the recording medium 2 is farther conveyed by the discharge roller pairs 3*g*, 3*h* and 3*i*, and is discharged into a delivery tray 6 through a reversing path 3*j*. The delivery tray 6 is a part of the top surface of the apparatus main assembly 14 of the image forming apparatus A. Incidentally, a pivotal flapper 3*k* may be pivoted so that the recording medium 2 is discharged by the discharge roller pair 3*m*, without being passed through the reversing path 3*j*. In this embodiment, the aforementioned pickup roller 3*b*, pair of conveying rollers 3*c* and 3*d*, registration roller pair 3*e*, conveying guide 3*f*, discharge roller pairs 3*g*, 3*h*, and 3*i*, and discharge roller pair 3*m* make up a conveying means 3.

Referring to FIGS. 2–5, on the other hand, in the process cartridge B, the photosensitive drum 7, the peripheral layer of which is a photosensitive layer 7*e* (FIG. 8), is rotated, and the peripheral surface of the photosensitive drum 7 is uniformly charged by applying voltage to a charge roller 8 as a charging means. Next, a beam of laser light reflecting the image formation data is projected from an optical system 1 onto the photosensitive drum 7 through an exposure opening 1*e*. As a result, an electrostatic latent image is formed on the photosensitive drum 7. This latent image is developed by a developing means 9 which uses toner. More specifically, the charge roller 8 is placed in contact with the photosensitive drum 7, and electrically charges the photosensitive drum 7. The charge roller 8 is rotated by the rotation of the photosensitive drum 7. The developing means 9 supplies toner onto the region of the photosensitive drum 7, which is in the development station, so that the latent image on the photosensitive drum 7 is developed. The optical system 1 has a laser diode 1*a*, a polygonal mirror 1*b*, a lens 1*c*, and a deflective mirror.

In the developing means 9, as a toner sending member 9*b* is rotated, a toner in a toner container 11A is sent out of the toner container 11A, and is delivered to a development roller 9*c*, which contains a stationary magnet and is being rotated. As a result, a layer of toner is formed on the peripheral surface of the development roller 9*c* while being triboelectrically charged by a development blade 9*d*. The toner particles in this toner layer are supplied onto the region of the photosensitive drum 7 in the development station. More specifically, the toner particles are transferred onto the peripheral surface of the photosensitive drum 7 in a pattern reflecting the latent image. As a result, a toner image is formed on the peripheral surface of the photosensitive drum 7. The development blade 9*d* is a member which regulates the amount by which toner is placed on the peripheral surface of the development roller 9*c* and also triboelectrically charges the toner. In the adjacencies of the development roller 9*c*, a toner stirring member 9*e* for circulating the toner within the development chamber is rotatably disposed. The aforementioned toner image on the photosensitive drum 7 is transferred onto the recording medium 2 by applying an electrical voltage, which is opposite in polarity to the toner image, to the transfer roller 4. Thereafter, the toner particles remaining on the peripheral surface of the photosensitive drum 7 are removed by a cleaning means 10. More specifically, the cleaning means 10 has an elastic cleaning blade 10*a* placed in contact with the peripheral surface of the photosensitive drum 7, and the toner particles remaining on the peripheral surface of the photosensitive drum 7 are scraped down by the cleaning blade 10*a*, being collected into a removed toner bin 10*b*. Incidentally, the process cartridge B comprises a toner holding frame 11, which has the toner container 11A (toner storage portion) for holding toner, and a developing means holding frame 12 which holds the developing means 9 such as the development roller 9*c* and the like. The toner holding frame 11 and developing means holding frame 12 are joined with each other, making up a second frame 200. The process cartridge B also comprises a cleaning means holding frame 13 (first frame), to which photosensitive drum 7, cleaning means 10 such as the cleaning blade 10*a*, and the charge roller 8 are attached. The cleaning means holding frame 13 is joined with the second frame 200. The process cartridge B is removably mountable in the apparatus main assembly 14 by an operator. The process cartridge B is provided with the exposure opening 1*e* for allowing a beam of light reflecting the image formation data to be projected onto the photosensitive drum 7, and a transfer opening 13*n* for placing the photosensitive drum 7 in contact with the recording medium 2. More specifically, the exposure opening 1*e* belongs to the cleaning means holding frame 13, whereas the transfer opening 13*n* is a gap formed between the developing means holding frame 12 and cleaning means holding frame 13.

{Structure of Housing of Process Cartridge B}

Next, the structure of the housing of the process cartridge B in this embodiment will be described.

Figure 9:
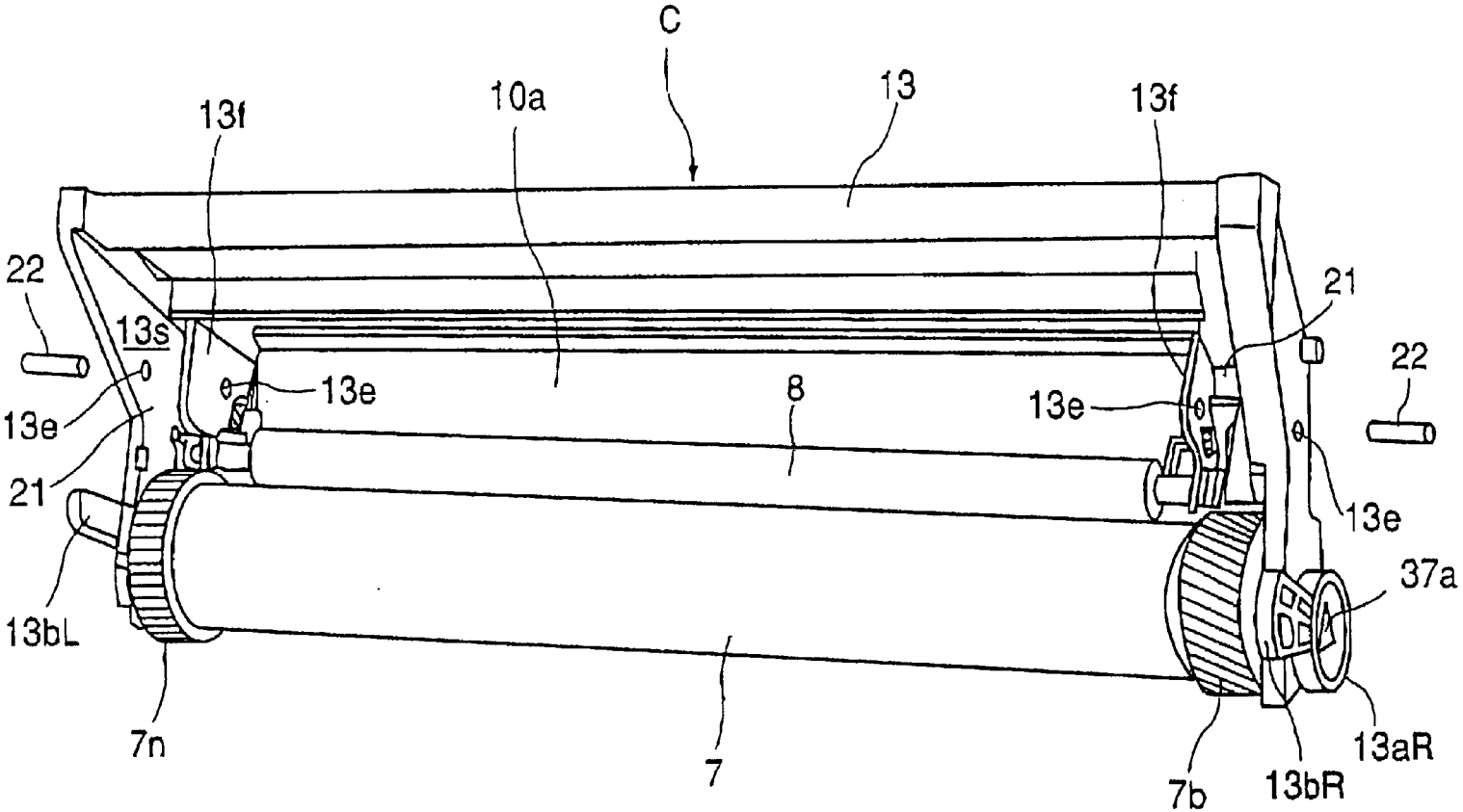
FIG. 9 is a perspective view of a cleaning unit.
Figure 10:
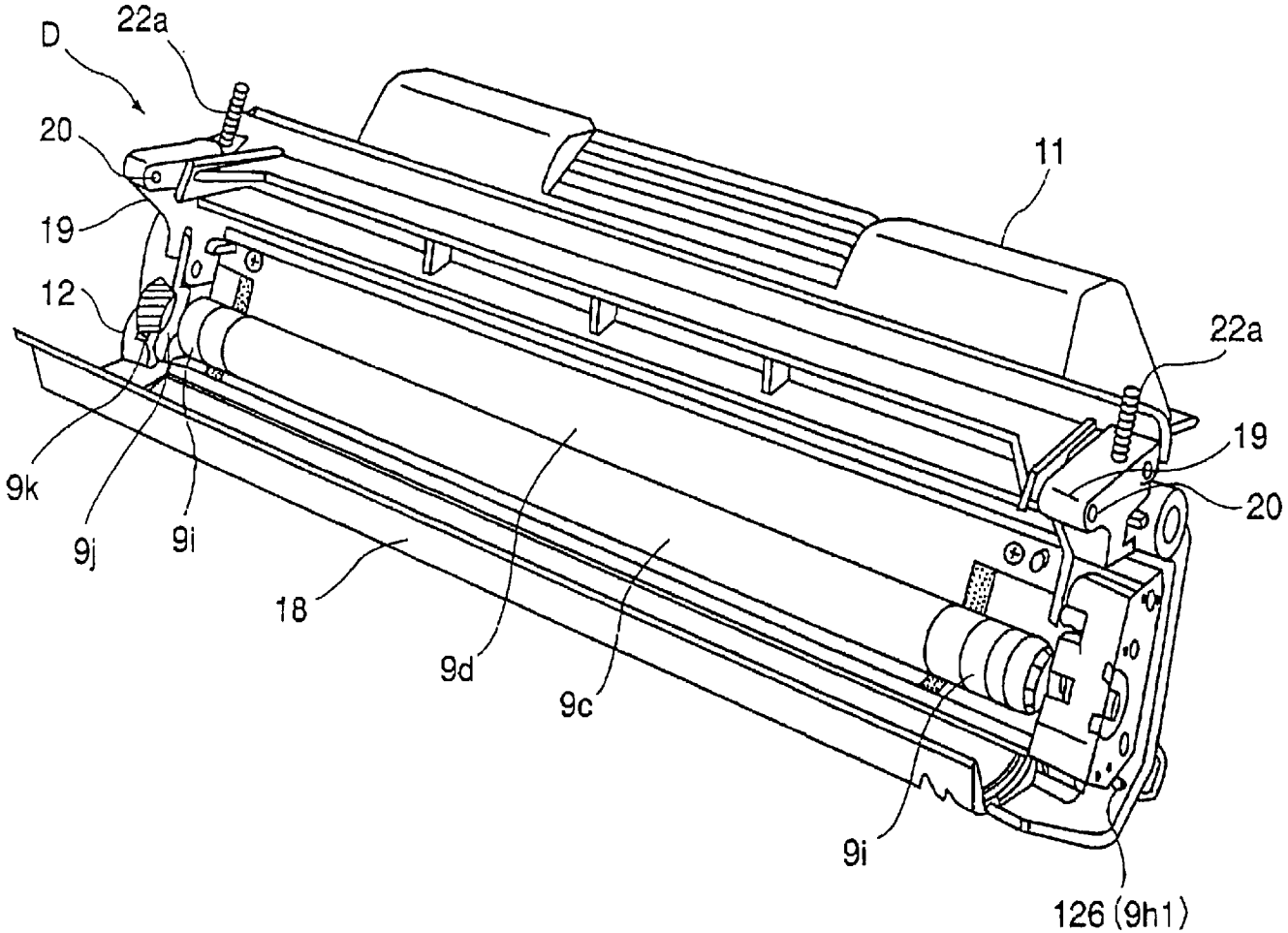
FIG. 10 is a perspective view of a developing unit.
Figure 15:
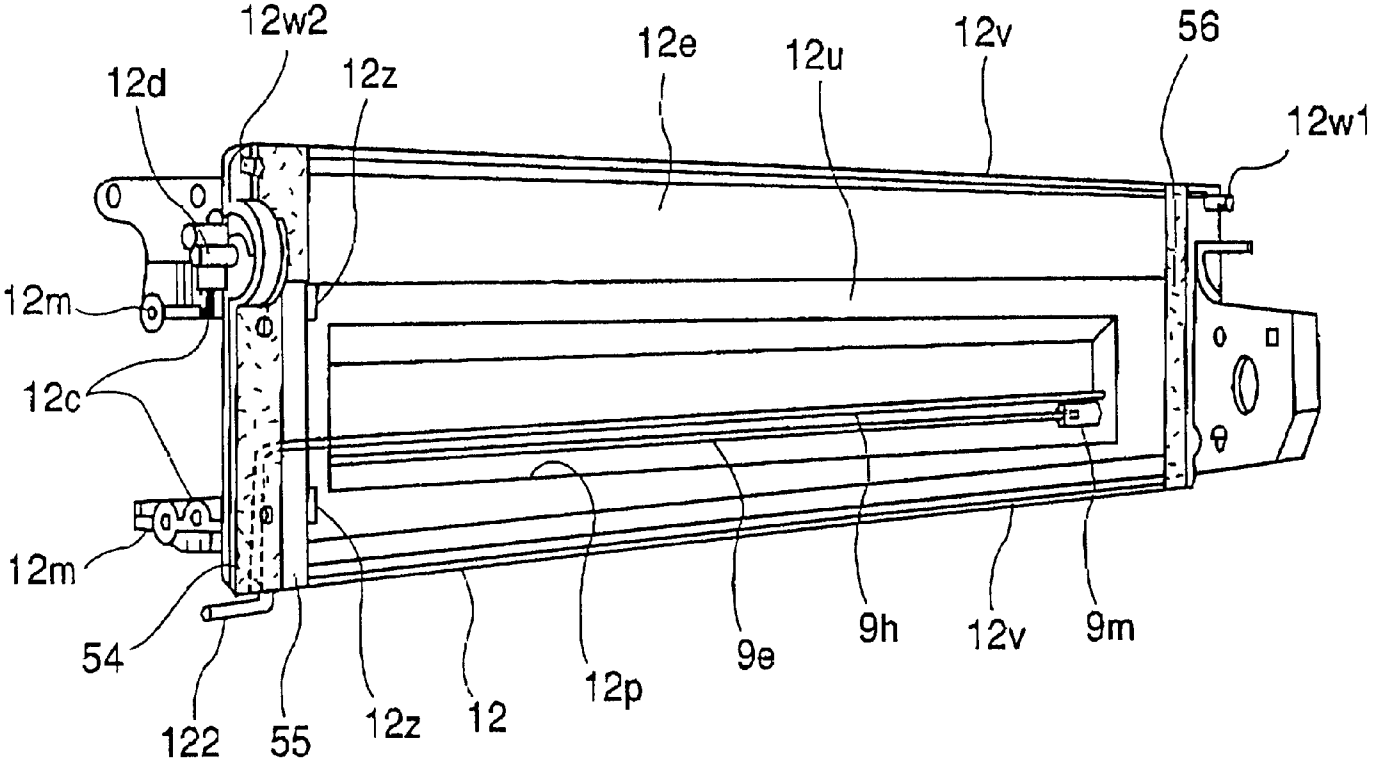
FIG. 15 is a perspective view of a developing device frame.
Figure 16:
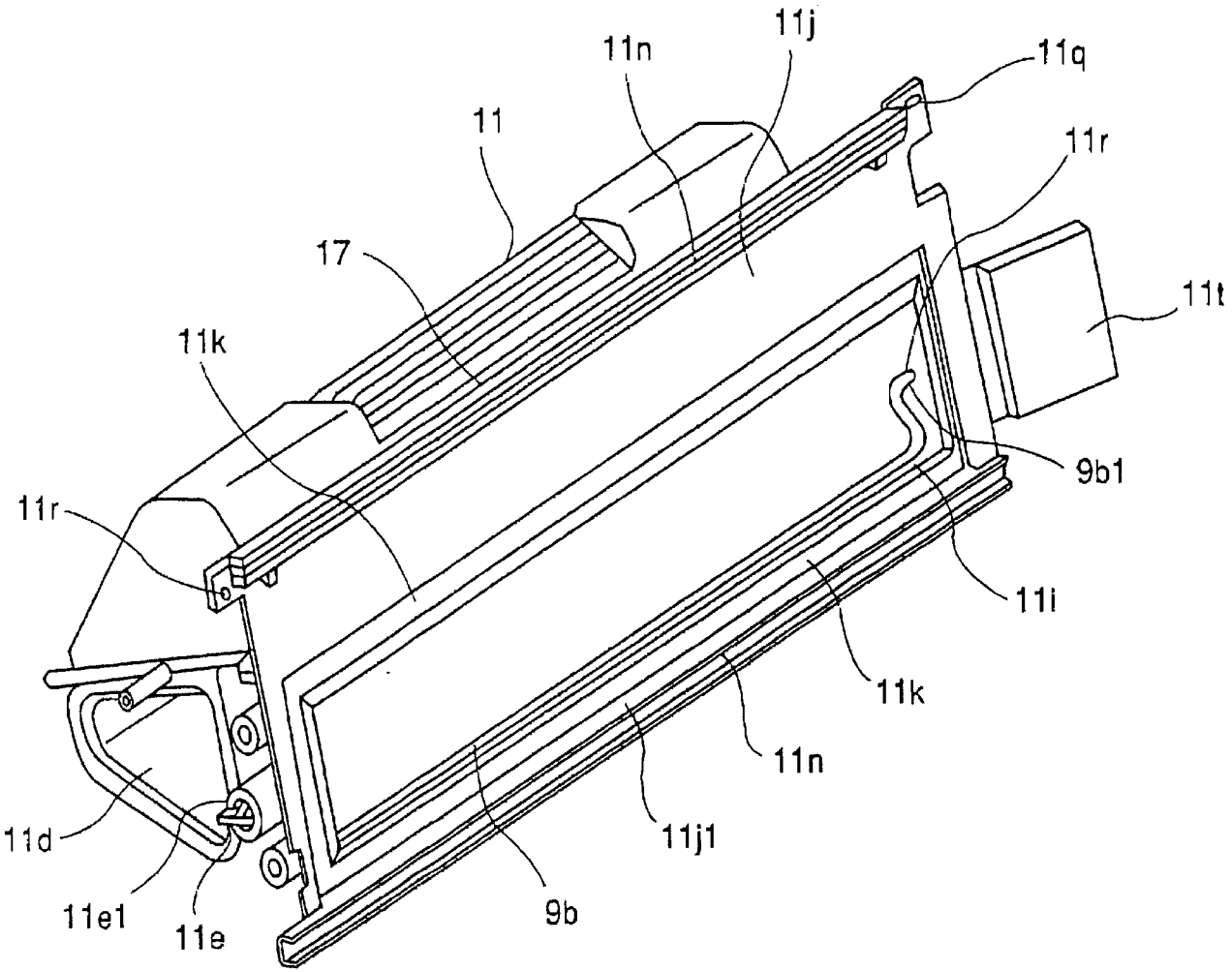
FIG. 16 is a perspective view of a toner frame.

The process cartridge B in this embodiment comprises the toner holding frame 11 and developing means holding frame 12, which are joined together, making up the second frame 200. To the second frame 200, the cleaning means holding frame 13 (first frame) is rotatably attached. In other words, the toner holding frame 11, developing means holding frame 12, and cleaning means holding frame 13 are joined as described above, making up, the housing of the process cartridge B. In the housing, the photosensitive drum 7, charge roller 8, developing means 9, cleaning means 10, and the like, are disposed, making up the process cartridge B, which is enabled to be removably mountable into a cartridge mounting means of the apparatus main assembly 14. Next, the structures of these frames will be described in more detail. Referring to FIGS. 2 and 16, the toner holding frame 11 holds the toner sending member 9*b*, which is rotatably attached to the toner holding frame 11. To the developing means holding frame 12, the development roller 9*c* and development blade 9*d* are attached. Further, in the adjacencies of the development roller 9*c*, the stirring member 9*e* for circulating toner within the development chamber is rotatably attached to the developing means holding frame 12. Also to the developing means holding frame 12, a rod antenna 9*h* is attached, extending along the development roller 9*c* approximately in parallel to the lengthwise direction, as shown in FIGS. 2 and 15. The toner holding frame 11 and developing means holding frame 12 are welded (ultrasonic welding is used in this embodiment) to each other, forming a virtually monolithic second frame, which constitutes the development unit D (FIG. 10). To the development unit D, a drum shutter assembly 18 for covering the photosensitive drum 7 to prevent the photosensitive drum 7 from being exposed to the ambient light for an extended length of time and also from coming into contact with foreign substances, when the process cartridge B is removed from the apparatus main assembly 14 or while it is out of the apparatus main assembly 14, is attached. Referring to FIG. 4, the shutter assembly 18 has a shutter, which exposes or covers the transfer opening 13*n* (FIG. 2), and a pair of links 18*b* and 18*c* for supporting the shutter. As seen in FIGS. 3 and 4, link 18*c* is found on the left and right sides of the process cartridge B. On the upstream side of the process cartridge B in terms of the recording medium 2 conveyance direction, one end of the link 18*c* on the right side of the process cartridge B is fitted in the hole 40*g* of a developing means holder 40 as shown in FIG. 3, and one end of the link 18*c* on the left side of the process cartridge B is fitted around a boss 11*h* of a bottom subframe 11*b* of the toner holding frame 11 as shown in FIG. 4. The other end of the link 18*c* on the right side of the process cartridge is attached to the upstream side of the shutter in terms of the cartridge mounting direction, as seen in FIG. 3, whereas the other end of the link 18*b* is attached to a joggle 12*d* of the developing means holding frame 12, as seen in FIG. 4. The link 18*c* on the left and right sides of the process cartridge B is provided with a projection 18*cl*, which is placed in contact with a solid anchoring portion (unshown) located next to the cartridge mounting space S of the apparatus main assembly 14. The shutter assembly 18 is moved by the movement of the process cartridge B; the shutter is opened by the movement of the process cartridge B. The drum shutter assembly 18 is kept pressured by an unshown torsion coil spring in the direction to cause the shutter to cover the transfer opening 13*n*. Further, referring to FIGS. 2 and 9, to the cleaning means holding frame 13, the photosensitive drum 7, charge roller 8, and cleaning means 10, are attached, making up the first frame, which constitutes the cleaning unit C (FIG. 9).

The development unit D and cleaning unit C are joined with each other with the use of a pair of round pins 22, that is, connecting members, being enabled to pivot relative to each other, and making up the process cartridge B. More specifically, referring to FIG. 10, the developing means holding frame 12 is provided with a pair of arms 19, which are located at the lengthwise ends (in terms of the direction of the axial line of the development roller 9*c*), one for one. The end portion of each arm 19 is provided with a round hole 20, which is parallel to the development roller 9*c*. On the other hand, the cleaning means holding frame 13 is provided with a pair of recesses 21, which are located at the lengthwise ends one for one (FIG. 9). The arm 19 is inserted into the corresponding recess 21. With the arm 19 being held in the recess 21, a connecting member 22 is pressed into a hole 13*e* of the cleaning means holding frame 13, on the outward side of the process cartridge B, is put through the hole 20 of the arm 19, and is inserted into the hole 13*e* of the cleaning means holding frame 13, on the inward side of the process cartridge B. As a result, the developing and cleaning units D and C are connected to each other, being enabled to pivot relative to each other about the connecting members 22. With the two units attached to each other as described above, a pair of compression coil springs 22*a* fitted, one for one, around a pair of joggles (unshown) projecting from the adjacencies of the bases of the arm 19 remain in contact with the top walls of the recesses 21 and of the cleaning means holding frame 13, keeping the developing means holding frame 12 pressed downward by their resiliency, ensuring thereby that the development roller 9*c* is kept pressed upon the photosensitive drum 7. More precisely, referring to FIG. 10, the lengthwise end portions of the development roller 9*c* are fitted with a spacer ring 9*i*, which is greater in diameter than the development roller 9*c*, and these spacer rings 9*i* are kept pressed upon the photosensitive drum 7 by the pair of compression coil springs 22*a*, maintaining a predetermined gap (approximately 300 $\mu$m) between the peripheral surfaces of the photosensitive drum 7 and development roller 9*c*. In other words, the development and cleaning units D and C are pivotal relative to each other about the connecting members 22, and the positional relationship between the peripheral surfaces of the photosensitive drum 7 and development roller 9*c* is kept constant by the resiliency of the pair of compression coil springs 22*a*.

{Structure of Means for Guiding Process Cartridge B}

Figure 6:
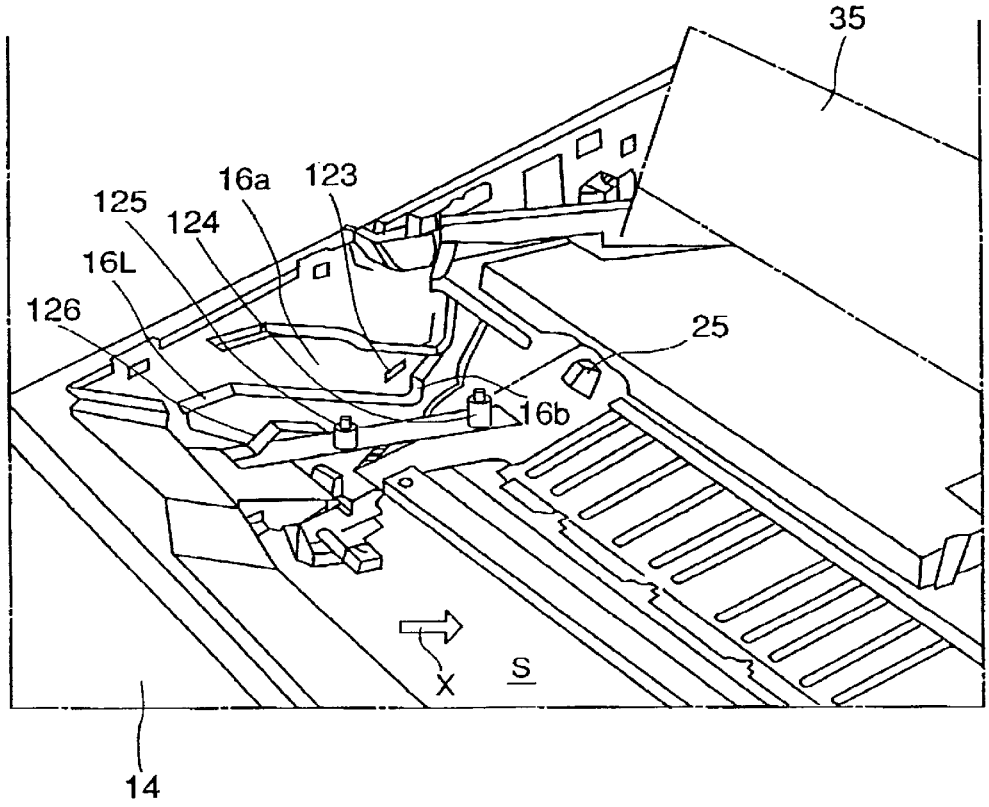
FIG. 6 is a perspective view of a mounting portion of a main assembly of the apparatus for the process cartridge.
Figure 7:
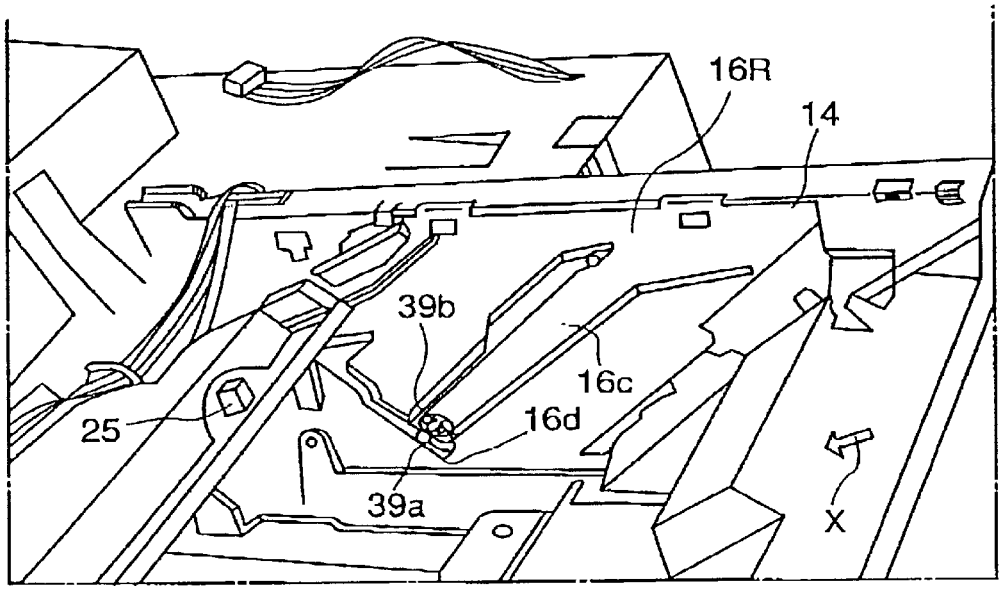
FIG. 7 is a perspective view of a mounting portion of a main assembly of the apparatus for the process cartridge.

Next, the guiding means for guiding the process cartridge B when mounting the process cartridge B into the apparatus main assembly 14, or dismounting it therefrom, will be described. The guiding means is shown in FIGS. 6 and 7. FIG. 6 is a perspective view of the left portion of the process cartridge mounting space S of the apparatus main assembly 14, as seen from the upstream side in terms of the direction (indicated by arrow mark X) in which the process cartridge B is inserted into the apparatus main assembly 14 (as seen from the development unit D side), whereas FIG. 7 is a perspective view of the right portion of the process cartridge mounting space S as seen also from the upstream direction.

Next, referring to FIGS. 3 and 4, each of the lengthwise end surfaces of the above described cleaning means holding frame 13 is provided with a guiding means which serves as a guide during the mounting or dismounting of the process cartridge B, into or out of, the apparatus main assembly 14. The right and left guiding means are provided with a pair of cylindrical guides 13*a*R and 13*a*L, respectively, as guiding members, for positioning the process cartridge B, and a pair of rotation controlling guides 13*b*R and 13*b*L, as guiding members, for controlling the attitude of the process cartridge B during the mounting or dismounting of the process cartridge B, into or out of, the apparatus main assembly 14. The rotation controlling guide 13*b*R is an integral part of the cylindrical guide 13*a*R, and extends from the peripheral surface of the cylindrical guide 13*a*R in the radius direction of the cylindrical guide 13*a*R. The cylindrical guides 13*a*R and 13*a*L are fixed to the cleaning means holding frame 13 with the use of screws. The guides 13*a*L and 13*a*R, which are integral parts of the cleaning means holding frame 13, project from the lengthwise left end surface of the cleaning means holding frame 13 in the direction perpendicular to the lengthwise left end surface. The rotation controlling guide 13*b*L is disposed slightly away from the guide 13*a*L, and the direction in which the rotation controlling guide 13*b*L extends in terms of the widthwise direction of the process cartridge B approximately coincides with the radius direction of the cylindrical guide 13*a*L.

Next, rotation regulating contact areas 13*j* of a top surface 13*i* of a cleaning unit C will be described. Here, the top surface means the external surface of the process cartridge B, which faces upward when the process cartridge B is in the proper position in the apparatus main assembly 14. Referring to FIGS. 3 and 4, the top surface of the process cartridge B in this embodiment is the top surface 13*i* of the cleaning unit C, and these are two rotation regulating contact areas 13j, one constituting a part of the right end portion 13*p* of the top surface 13*i* in terms of the direction perpendicular to the cartridge mounting direction, and the other constituting a part of the left end portion 13*q* of the top surface 13*i*. Each of the two contact areas 13*j* is an area which positions the process cartridge B as the process cartridge B is mounted into the apparatus main assembly 14. More specifically, as the process cartridge B is mounted into the apparatus main assembly 14, the contact area 13*j* comes into contact with a solid cartridge catching member 25 (FIGS. 6 and 7) of the apparatus main assembly 14, controlling the rotational movement of the process cartridge B about the cylindrical guides 13*a*R and 13*a*L.

Next, the cartridge guiding means on the apparatus main assembly 14 side will be described. A lid 35 of the apparatus main assembly 14 is rotated counterclockwise about the hinge 35*a* (FIG. 1), exposing the top portion of the internal space of the apparatus main assembly 14, or the cartridge mounting space S, which appears as shown in FIGS. 6 and 7. The left and right internal walls (FIGS. 6 and 7, respectively) of the cartridge mounting space S, as seen from the cartridge mounting direction, which can be seen through the opening exposed by the opening of the lid 35, are provided with guiding members 16R and 16L, respectively. As is evident from the drawings, the guiding members 16R and 16L are provided with tilted guiding portions 16*a* and 16*c*, and positioning grooves 16*b* and 16*d* connected to the lower ends of the tilted guiding portions 16*a* and 16*c*, respectively. The aforementioned cylindrical guides 13*a*R and 13*a*L fit into the positioning grooves 16*b* and 16*d*, respectively. The positioning grooves 16*b* and 16*d* are semicylindrical, and when the process cartridge B is in the proper position in the apparatus main assembly 14, the axial lines of the positioning grooves 16*b* and 16*d* coincide with the axial lines of the cylindrical guides 13*a*R and 13*a*L, coinciding therefore with the axial line of the photosensitive drum 7. The rotation controlling guides 13*a*R and 13*b*R, the width of which are less than the diameters of the cylindrical guides 13*a*R and 13*a*L, respectively, loosely fit in the tilted guiding portion 16*c* and positioning groove 16*d*. However, with the cylindrical guides 13*a*R and 13*a*L, and rotation controlling guides 13*b*R and 13*b*L, being fitted in the tilted guiding portion 16*a* and positioning groove 16*c*, the process cartridge B is prevented from rotating about the axial lines of the cylindrical guides 13*a*R and 13*a*L, and therefore, the attitude of the process cartridge B is maintained in a predetermined range. Further, in the final stage of the mounting of the process cartridge B into the apparatus main assembly 14, the cylindrical guides 13*a*R and 13*a*L fit into the positioning grooves 16*b* and 16*d*, respectively, and the contact areas 13*j* come into contact with the corresponding solid cartridge catching members 25.

In order to mount the process cartridge B into the apparatus main assembly 14, first, an operator, or a user, is to insert the cylindrical guides 13*a*R and 13*a*L into the tilted guiding portions 16*a* and 16*c*, respectively, by grasping the process cartridge B by one hand, with the fingers placed in a recess 17 of the toner holding frame 11, and on the ribs 11*c* on the bottom surface of the toner holding frame 11. Next, the rotation controlling guides 13*b*R and 13*b*L are to be inserted into the tilted guiding portion 16*a* and positioning groove 16*b*, respectively, with the process cartridge B downwardly tilted in terms of the cartridge mounting direction. As a result, the cylindrical guides 13*a*R and 13*a*L, and the rotation controlling guides 13*b*R and 13*b*L, advance inward following the tilted guiding portions 16*a* and 16*c*, respectively. Then, as the cylindrical guides 13*a*R and 13*a*L reach the positioning grooves 16*b* and 16*d*, they settle in the positioning grooves 16*b* and 16*d*, respectively, due to the weight of the process cartridge B, being thereby accurately positioned relative to the positioning grooves 16*b* and 16*d*, respectively. As a result, the photosensitive drum 7 is almost perfectly positioned relative to the apparatus main assembly 14; eventually, the photosensitive drum 7 is perfectly positioned relative to the apparatus main assembly 14 as the coupling on the photosensitive drum 7 side engages with the coupling on the apparatus main assembly 14 side. At this point in the cartridge inserting process, the operator is to release the process cartridge B from the hand which is holding the process cartridge B. As the process cartridge B is released, the contact areas 13*j* come into contact with the corresponding solid cartridge catching members 25, accurately positioning the process cartridge B relative to the apparatus main assembly 14. Thereafter, the lid 35 is closed.

All that is necessary to remove the process cartridge B from the apparatus main assembly 14 is to carry out in reverse the above described cartridge mounting process.

{Toner Holding Frame}

Figure 17:
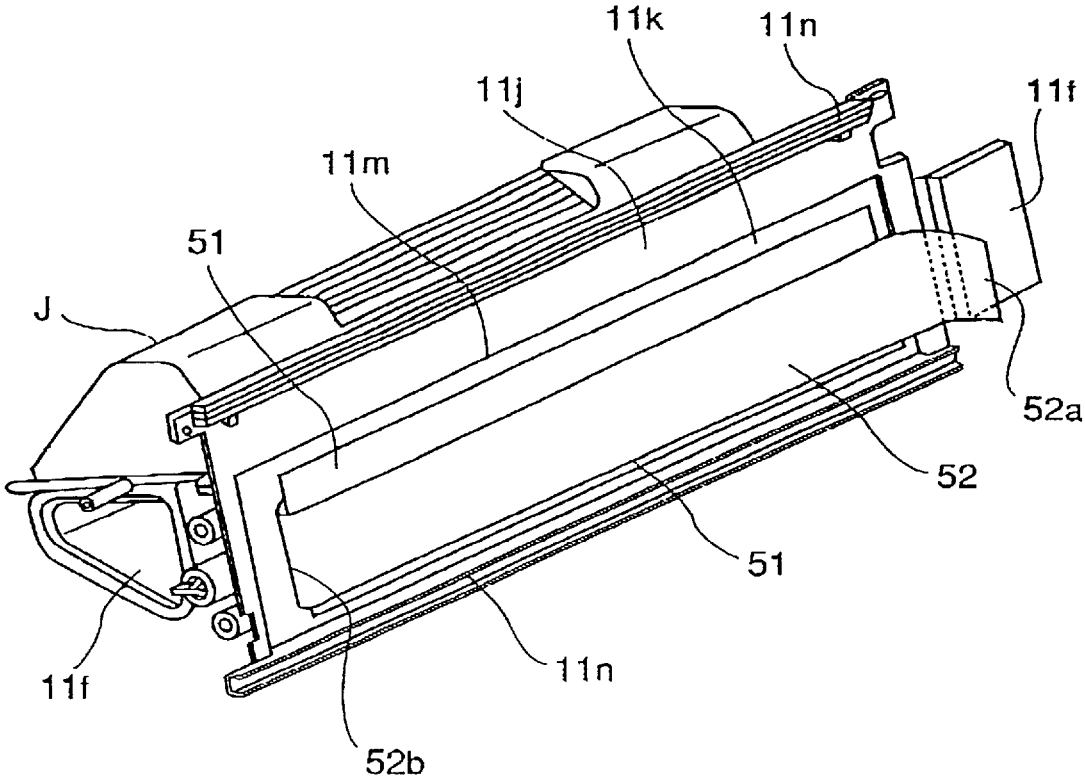
FIG. 17 is a perspective view of a toner frame.

Referring to FIGS. 2, 4, 13, 16 and 17, the toner holding frame 11 will be described in detail (hereinafter, developer will be referred to as toner). FIG. 16 is a perspective view of the toner holding frame 11 prior to the welding of a toner seal, and FIG. 17 is a perspective view of the toner holding frame 11 after the filling of the toner holding frame 11 with toner. Referring to FIG. 2, the toner holding frame 11 is made up to two sections: a top sub-frame 11*a* and a bottom sub-frame 11*b*, which are provided with flanges 11*a*1 and 11*b*1. The top and bottom sub-frames 11*a* and 11*b* are joined at a welding surface U, which is the interface between the flanges 11*a*1 and 11*b*1; they are welded into the virtually monolithic toner holding frame 11 by ultrasonic welding. When welding the sub-frames 11*a* and 11*b* to each other, the two sub-frames 11*a* and 11*b* are supported by the flange 11*b*1. The toner holding frame 11 is provided with a stepped portion 11*m*, a riser portion of which is virtually level with the flange 11*b*1. Prior to the joining of the two sub-frames 11*a* and 11*b*, the toner sending member 9*b* is to be attached to the interior of the bottom sub-frame 11*b*. Next, referring to FIG. 13, a coupler assembly 11*e* is attached to one of the lengthwise ends of the toner sending member 9*b* through a hole 11*e*1 in one of the lengthwise end plates of the toner holding frame 11. The lengthwise end plate having the hole 11*e*1 is provided with a hole 11*d* through which toner is filled into the toner holding frame 11, and which is in the form of a virtually equilateral triangle. Next, referring to FIG. 16, the toner holding frame 11 is provided with a rectangular hole 11*i*, the lengthwise direction of which corresponds to the lengthwise direction of the toner holding frame 11, and through which toner is sent from the toner holding frame 11 to the developing means holding frame 12. The aforementioned seal (which will be described later) is welded to the edge of this rectangular hole 11*i* in a manner to seal the rectangular hole 11*i*. Thereafter, the toner is filled into the toner holding frame 11 through the toner filling hole 11*d*. Then, the toner filling hole 11*d* is plugged with a toner cap 11*f* as shown in FIG. 17, completing a toner unit J. The toner unit J is welded to the developing means holding frame 12, which will be described later, by ultrasonic welding, completing the development unit D.

Also referring to FIG. 2, the portion of the bottom sub-frame 11*b* below the toner sending member 9*b* is bulged outward, creating a recessed portion 11*g*, in order to prevent the bottom sub-frame 11*b* from being introduced into the rotational range of the toner sending member 9*b*.

Referring to FIG. 16, the toner sending member 9*b* is shaped like a crank. One of its journal portions 9*b*1 of the toner sending member 9*b* is fitted in a hole 11*r* of the toner holding frame 11, and the other is fixed to the coupling assembly 11*e* (joint between toner sending member 9*b* and coupling assembly 11*e* is not visible in FIG. 16).

Figure 18:
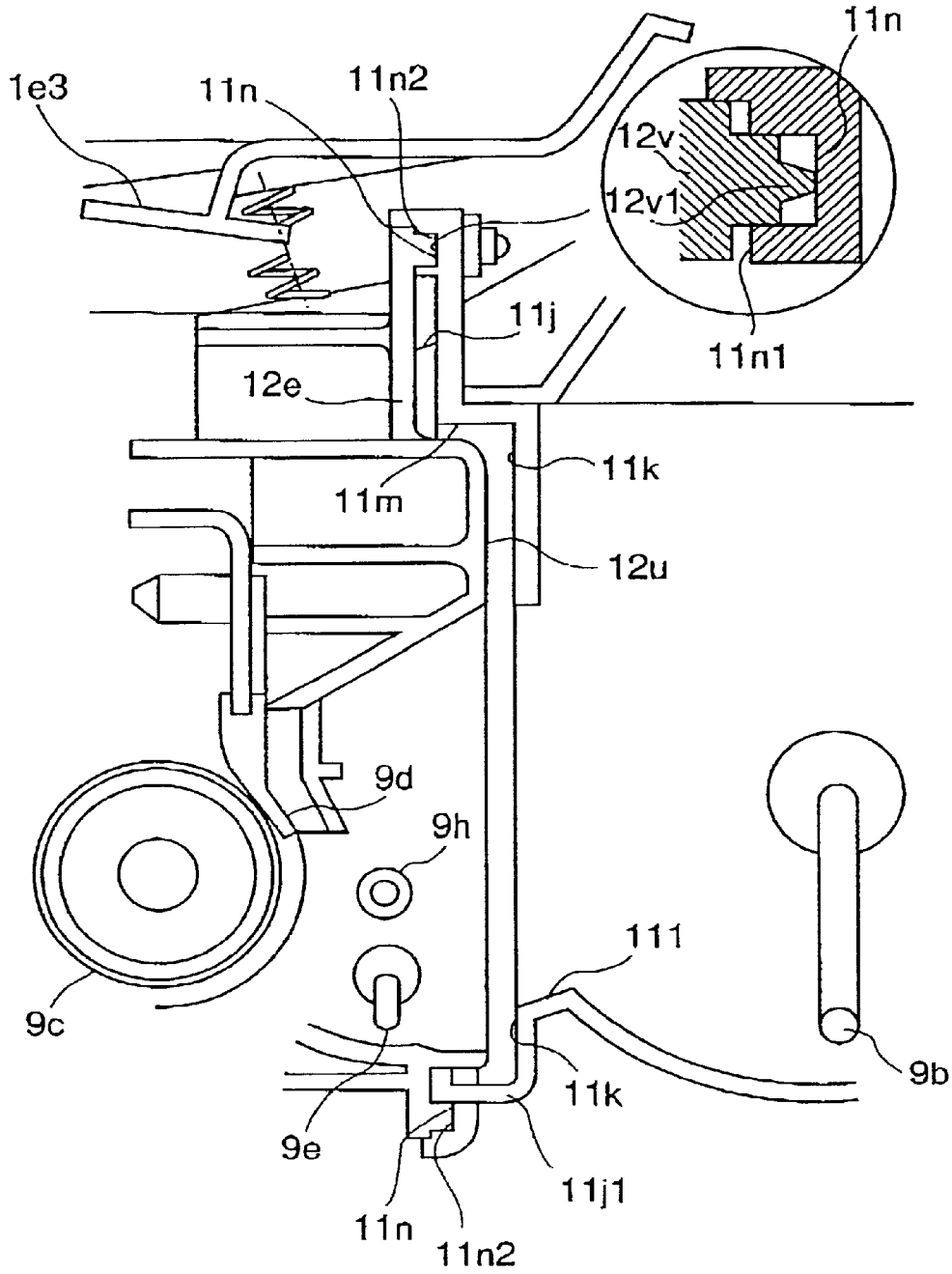
FIG. 18 is a longitudinal sectional view of a toner seal portion of FIG. 17.

Further, the toner holding frame 11 is provided with a recessed surface 11*k*, which surrounds the above described rectangular hole 11*i*. The toner holding frame 11 is also provided with top and bottom flanges 11*j* and 11*j*1, and a groove 11*n*, which are parallel to each other, and are located in the adjacencies of the hole 11*i*. Referring to FIG. 18, the bottom surface 11*n*2 of the groove 11*n* of the toner holding frame 11 is positioned on the outward side (on the developing means holding frame side), relative to the recessed surface 11*k*.

Referring to FIG. 15, the developing means holding frame 12 faces the toner holding frame 11 by a flat surface 12*u*, and has a flange 12*e*, which is positioned on the inward side relative to the flat surface 12*n*. The developing means holding frame 12 also has a rib 12*v*, which fits into the groove 11*n*. The rib 12*v* extends along the flange 12*e*. It is provided with a rib 12*v*1, which is used for ultrasonic welding (FIG. 18). After the above described various components are attached to the interiors of the corresponding frames, the toner holding frame 11 and developing means holding frame 12 are put together, with the rib 12*v* fitted in the groove 11*n*, and are joined to each other by ultrasonic welding. As a result, the two frames 11 and 12 are welded to each other by their long edges. Referring to FIG. 17, the hole 11*i* is blocked with a cover film 51 pasted to the recessed surface 11*k*; more specifically, the four edges of the cover film 51 are pasted to the four edges, one for one, of the hole 11*i* of the toner holding frame 11. Further, the cover film 51 is provided with a tear tape 52, which is welded to the cover film 51 to expose the hole 11*i*, in other words, to tear the cover film 51. The tear tape 52 is extended from one of the lengthwise ends of the hole 11*i* (which corresponds to portion 52*b*) to the other end, is doubled back therefrom to the first end of the hole 11*i*, is extended beyond the first end of the hole 11*i*, and is extended outward between an elastic sealing member 54 formed of material such as felt, and the toner holding frame 11. The portion 52*a* of the tear tape 52 extending outward from the toner holding frame 11 is provided with a handle 11*f* (FIGS. 16 and 17). On the immediately inward side of the sealing member 54, there is a tape 55 formed of synthetic resin film. The tape 55 is pasted to the developing means holding frame 12. Further, there is another elastic sealing member 56, which is pasted to the flat surface of the flange 12*e* located opposite to the side to which the sealing member 54 is pasted, in terms of the lengthwise direction of the process cartridge B (FIG. 15).

The above described elastic sealing members 54 and 56 are pasted to the lengthwise end portions of the flange 12*e*, extending across the entire width of the flange 12*e*. Further, the positions of the sealing members 54 and 56 coincide with those of the positions of the flanges 11*j* at the lengthwise ends of the recessed surface 11*k*, one for one, and are long enough to reach from one end of the flange 11*j* to the other, in terms of the widthwise direction, and extend farther to overlap with the rib 12*v*. Further, in order to make it easier to align the toner holding frame 11 and developing means holding frame 12 when joining the two frames, the flange 11*j* is provided with holes 11*r* and 11*q*, into which the joggles 12*w*1 and 12*w*2 of the developing means holding frame 12 fit.

Before joining the toner holding frame 11 and developing means holding frame 12 with each other, they are assembled as modules, independently from each other. When joining them thereafter, the joggles 12*w*1 and 12*w*2 are fitted into the holes 11*r* and 11*q*, respectively, and the rib 12*v* is fitted into the groove 11*n*. Then, the toner holding frame 11 and developing means holding frame 12 are pressed against each other. As they are pressed against each other, the sealing members 54 and 56 come into contact with the flange 11*j*, being thereby compressed, and a pair of ribs 12*z*, which are located on the lengthwise ends of the flat surface 12*u* of the developing means holding frame 12 and extend in the widthwise direction of the developing means holding frame 12, come close to the flange 11*j*. Here, in order to allow the tear tape 52 to pass, the pair of ribs 12*z* are positioned, one for one, at the widthwise ends of the flat surface 12*u*.

With the toner holding frame 11 and developing means holding frame 12 kept pressed against each other as described above, ultrasonic vibrations are applied to the interface between the surfaces of the rib 12*v* and grooves 11*n* to weld the rib 12*v*1 to the bottom surface of the groove 11*n* by melting the rib 12*v*1 with frictional heat. As a result, the edge 11*n*1 of the groove 11*n*, and the pair of ribs 12*z*, come into contact with each other, leaving a space between the recessed surface 11*k* of the toner holding frame 11, and the flat surface 12*u* of the developing means holding frame 12. The cover film 51 and tear tape 52 fit in this space. In order to send the toner in the toner holding frame 11 out into the developing means holding frame 12, an operator is to pull the aforementioned handle 11*f* by hand after breaking off the aforementioned handle 11*f* attached to the end portion 52*a* of the tear tape 52 extending outward from the process cartridge B, from the toner holding frame 11. As the handle 11*f* is pulled, the cover film 51 is torn, exposing the opening 11*i*. As a result, it becomes possible for the toner to be sent from the toner holding frame 11 to the developing means holding frame 12. The sealing members 54 and 56 located at the lengthwise ends of the flange 11*j*, one for one, have been compressed only in their thickness direction, keeping the development unit D satisfactorily sealed.

In FIG. 2, which is a sectional view of the toner holding frame 11 in this embodiment, at a plane perpendicular to the lengthwise direction of the process cartridge B, the plane of the joint JP between the toner holding frame 11 and developing means holding frame 12 is approximately vertical.

Next, the toner holding frame 11 in this embodiment will be described further in detail. In order to allow the single-component toner in the toner container 11A to efficiently fall toward the opening 11*i*, the toner holding frame 11 is provided with two tilted surfaces K and L, which extend from one lengthwise end of the toner holding frame 11 to the other. The tilted surface L is located above the opening 11*i*, whereas the tilted surface K is on the rear side of the toner holding frame 11 as seen from the opening side (in terms of the widthwise direction). Further, the tilted surface L is a part of the wall of the top sub-frame 11*a*, whereas the tilted surface K is a part of the wall of the bottom sub-frame 11*b*. With the process cartridge B properly set in the apparatus main assembly 14, the tilted surface L is vertical, or the angle of the tilted surface L relative to the vertical direction is such that the tilted surface L faces diagonally downward. Further, the angle θ3 of the tilted surface K relative to the line perpendicular to the plane JP of the interface between the toner holding frame 11 and developing means holding frame 12 is approximately within the range of 20–40 deg. In other words, in this embodiment, the sub-frame 11*a* is shaped so that when attaching the sub-frame 11*b* to the sub-frame 11*a*, the sub-frame 11*b* is positioned at the above described angle. Therefore, according to this embodiment, the toner container 11A containing toner is enabled to efficiently move the toner toward the opening 11*i*.

[Developing Means Holding Frame]

Figure 11:
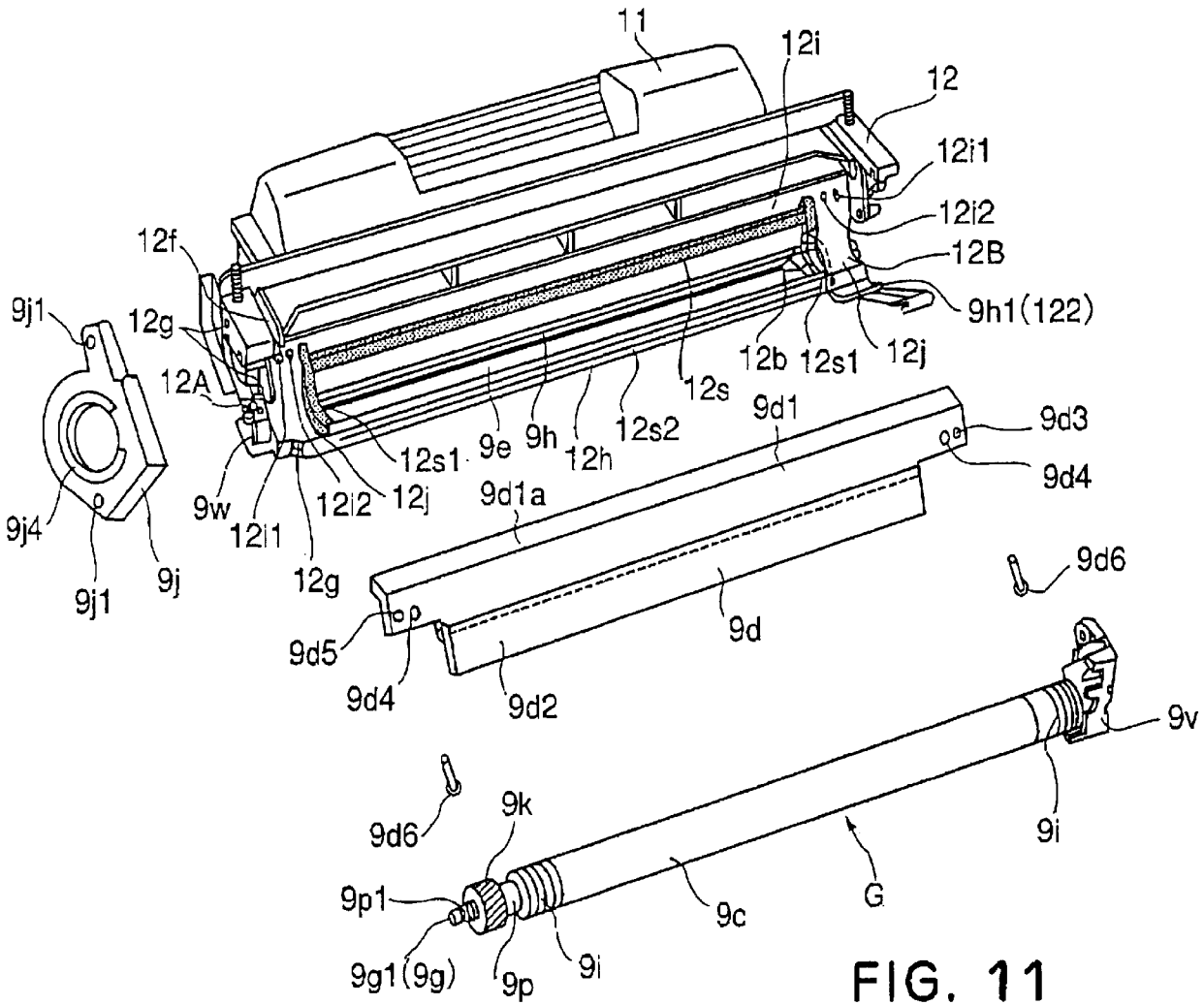
FIG. 11 is a partly broken perspective view of a developing unit.
Figure 12:
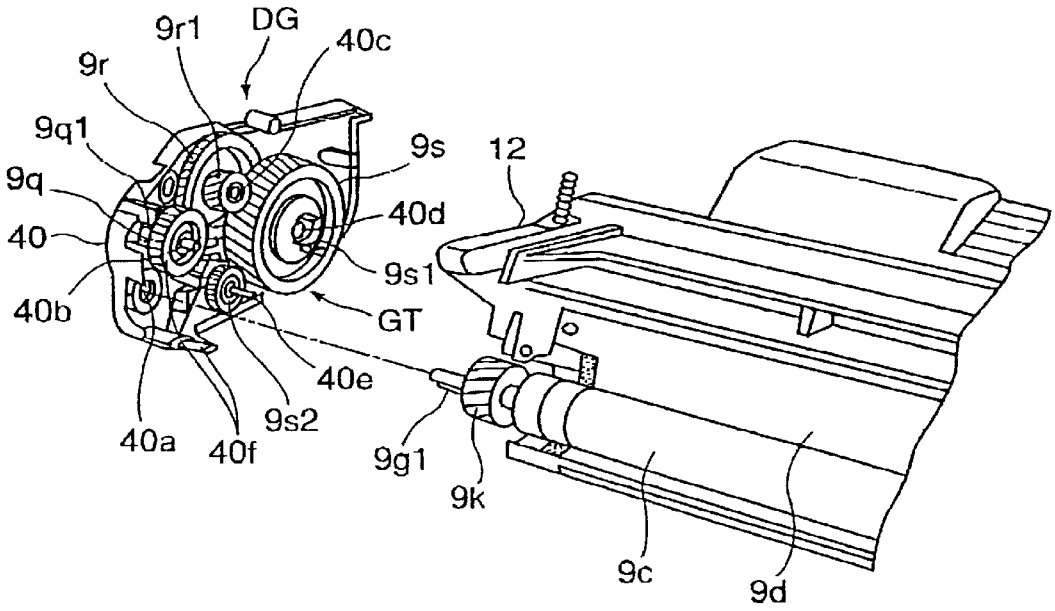
FIG. 12 is a perspective view of a rear portion of a development holder.
Figure 13:
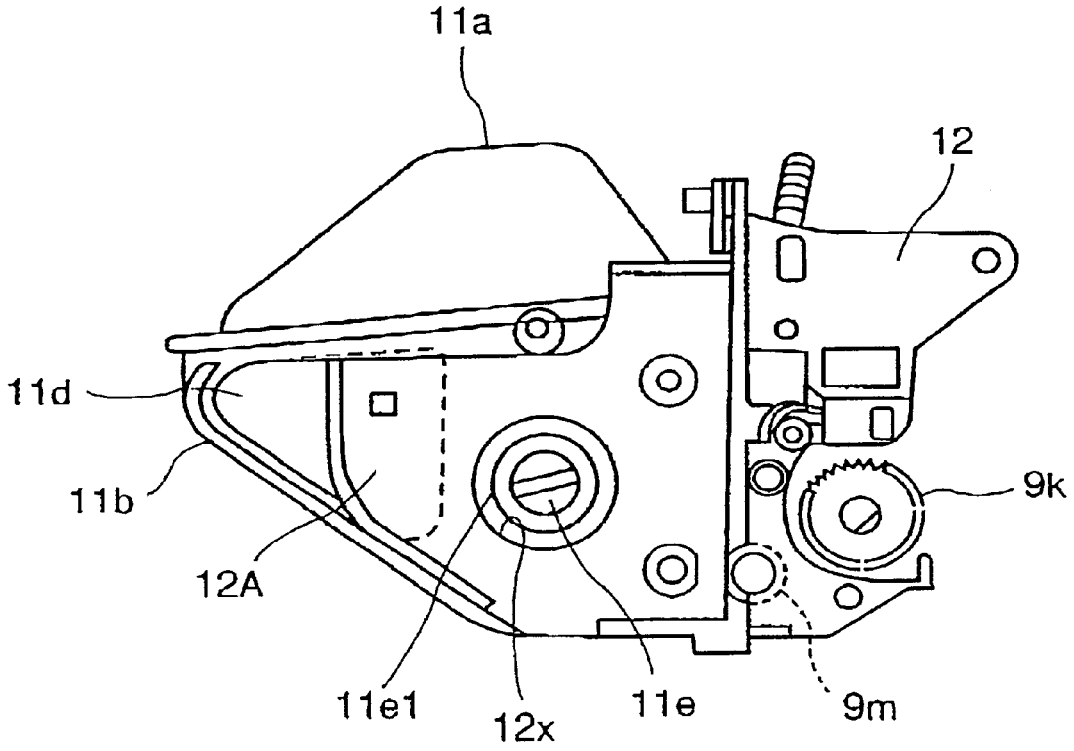
FIG. 13 is a side view of a side plate and a toner frame of a developing device frame.
Figure 14:
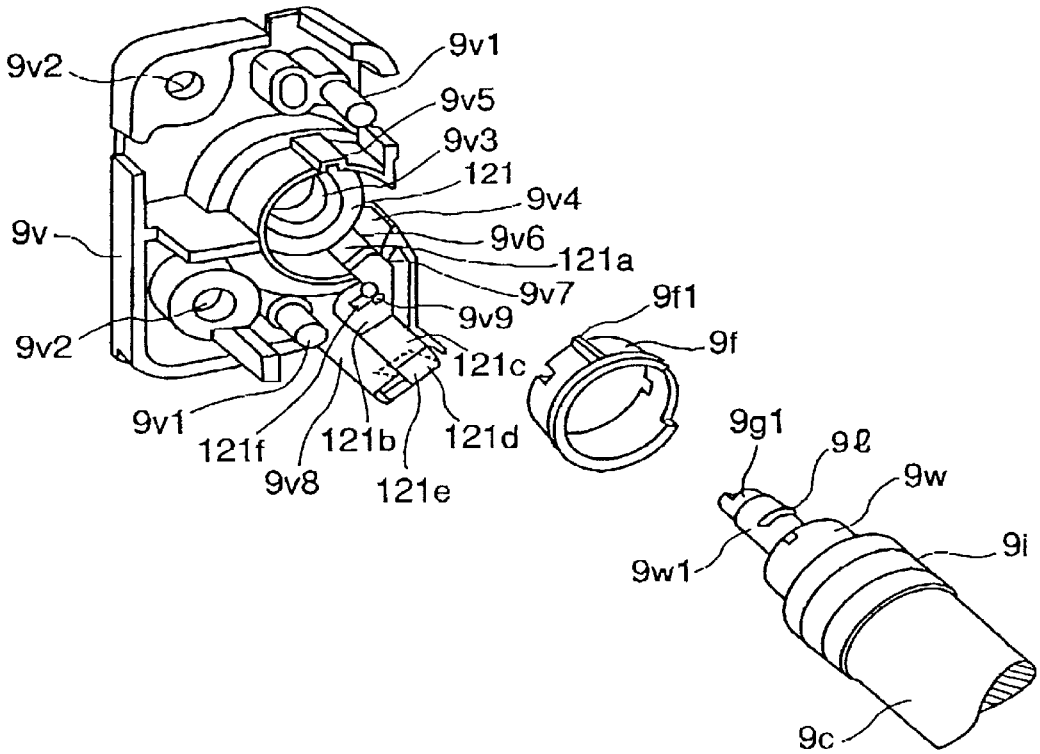
FIG. 14 is a perspective view of a developing roller shaft reception box.

Next, referring to FIGS. 2, 11, 12, 13 and 14, the developing means holding frame 12 will be further described in detail. FIG. 11 is a perspective drawing for showing how various components are assembled into the developing means holding frame 12, and FIG. 12 is a perspective drawing for showing how a unit DG for transmitting a driving force to the development station is attached to the developing means holding frame 12. FIG. 14 is a perspective drawing for showing the interior of a bearing box.

Into the developing means holding frame 12, the development roller 9*c*, development blade 9*d*, toner stirring member 9*e*, and rod antenna 9*h* for detecting the amount of the remaining toner, are assembled as described before. Referring to FIG. 11, the blade 9*d* is made up of a piece of 1–2 mm thick metallic plate 9*d*1, and a silicone rubber portion 9*d*2 molded onto the metallic plate 9*d*1. The amount by which toner is coated on the peripheral surface of the development roller 9*c* is regulated by positioning the rubber portion 9*d*2 so that it is placed in contact with the generatrix of the development roller 9*c*. The lengthwise end portions of the flat surface 12*i* of the developing means holding frame 12, as a blade anchoring portion, are each provided with a joggle 12*i*1 and a screw hole 12*i*2. On the other hand, the right end portion of the metallic plate 9*d*1 is provided with a hole 9*d*3, and the left end portion of the metallic plate 9*d*1 is provided with a elongated hole 9*d*5 elongated in the lengthwise direction of the process cartridge B. Into these holes 9*d*3 and 9*d*5, the above described pair of joggles 12*i*1 fit one for one. The pair of joggles 12*i*1, hole 9*d*3, and elongated hole 9*d*5, constitute a means for positioning the development blade 9*d*. More specifically, referring to the right-hand side of FIG. 11, the play between the walls of the joggle 12*i*1 and hole 9*d*3 is several microns to several tens of microns; in other words, the joggle 12*i*1 virtually perfectly fits in the hole 9*d*3, positioning the development blade 9*d* in terms of both the widthwise and lengthwise directions. On the other hand, the left-hand joggle 12*i*1 is virtually identical to the right-hand joggle 12*i*1, whereas the hole 9*d*5 of the metallic plate 9*d*1, into which the left-hand joggle 12*i*1 fits, is elongated in the lengthwise direction of the process cartridge B. Thus, in terms of the lengthwise direction, the development blade 9*d* is positioned as the joggle 12*i*1 is fitted into the hole 9*d*3, whereas in terms of the widthwise direction, the development blade 9*d* is positioned as the left- and right-hand joggles 12*i*1 are fitted into the holes 9*d*3 and 9*d*5 one for one. Therefore, the blade 9*d* can be accurately attached. With the blade 9*d* positioned by the above described positioning means, a pair of small screws 9*d*6 are put through a pair of screw holes 9*d*4 of the metallic plate 9*d*1, and are screwed into the pair of female-threaded holes 12*i*2 of the developing means holding frame 12, so that the metallic plate 9*d*1 is secured to the flat surface 12*i*. The developing means holding frame 12 is provided with an elastic sealing member 12*s*1 as a development blade long edge seal, a pair of magnetic sealing members 12*s*1 as development roller end seals, and an elastic sealing member 12*s*2. The elastic sealing member 12*s* is for sealing between the developing means holding frame 12 and development blade 9*d* to prevent toner from leaking outward, and is formed of Moltprene or the like. Its length is virtually the same as that of the metallic plate 9*d*1, and is pasted to the developing means holding frame 12 so that it extends in the lengthwise direction of the process cartridge B, along the area which corresponds to the top edge of the metallic plate 9*d*1. The magnetic sealing member 12*s*2 is for sealing the corresponding lengthwise end of the development roller 9*c*. Each magnetic sealing member 12*s*2 extends downward from the corresponding lengthwise end of the sealing member 12*s*, following the arcuate surface 12*f* of the developing means holding frame 12, the curvature of which matches that of the development roller 9*c*, to the bottom end of the arcuate surface 12*f*. The elastic sealing member 12*s*2 is for sealing between the developing means holding frame 12 and development roller 9*c*, and is relatively thin. It is pasted to the mandible-like portion 12*h* of the developing means holding frame 12, being place in contact with the development roller 9*c*, with the surface of the elastic sealing member 12*s*2 in contact with the development roller 9*c* being tangential to the peripheral surface of the development roller 9*c*. In terms of the cross section perpendicular to the lengthwise direction, the metallic plate 9*d*1 of the development blade 9*d* is bent approximately 90 deg., forming a portion 9*d*1*a*.

Next, referring to FIGS. 11 and 14, the development roller unit G will be described. The development roller unit G comprises (1) development roller 9*c* and (2) a pair of spacer rings 9*i* for keeping constant the distance between the peripheral surfaces of the development roller 9*c* and photosensitive drum 7. The rings 9*i* are formed of electrically insulative synthetic resin. Each ring 9*i* doubles as a sleeve cap which covers the lengthwise end of the development roller 9*c* to prevent the electrical leak between the aluminum cylindrical portion of the photosensitive drum 7 and the aluminum cylindrical portion of the development roller 9*c*. The development roller unit G also comprises: (3) development roller bearing 9*j* (enlarged in FIG. 11) for rotationally supporting the development roller 9*c* to position the development roller 9*c* relative to the developing means holding frame 12; (4) development roller gear 9*k* (helical gear) for rotating the development roller 9*c* by receiving a driving force from a helical drum gear 7*b* (FIG. 8) attached to the photosensitive drum 7; (5) development contact 9*l* in the form of a coil spring (FIG. 14), one end of which is fitted around the end portion of the development roller 9*c*; and (6) magnet 9*g* positioned inside the development roller 9*c* to adhere toner onto the peripheral surface of the development roller 9*c*. In FIG. 11, the bearing box 9*v* has already been attached to the development roller unit G. However, the development roller unit G is to be joined with the bearing box 9*v* when the bearing box 9*v* is attached to the lateral plate 12B of the developing means holding frame 12.

Also referring to FIG. 11, the development roller unit G comprises a metallic flange 9*p* securely attached to one of the lengthwise end of the roller development 9*c*. The flange 9*p* is provided with a roller gear attachment shaft portion 9*p*1, which projects outward in the lengthwise direction. A shaft portion 9*p*1 is cylindrical except for the double-flatted portion. The aforementioned development roller gear 9*k* formed of synthetic resin is fitted around the shaft portion 9*p* 1, being prevented from rotating around the shaft portion 9*p*1 by the double-flatted portion. The development roller gear 9*k* is a helical gear, with its teeth twisted in such a direction that as it is rotated, it pushes the development roller 9*c* in the axial direction. Through the flange 9*p*, a D-cut shaft 9*g*1 of the magnet 9*g* protrudes outward, whereas the shaft 9*g*1 on the other end of the magnet 9*g* is fitted in the developing means holder 40 of the driving force transmission unit DG, which will be described later, being nonrotationally supported. The bearing 9*j* is provided with a round hole, the wall of which has a rotation control projection projecting toward the axial line of the hole. Into this hole, a C-shaped bearing 9*j*4 is fitted. The aforementioned flange 9*p* is rotationally fitted in this bearing 9*j*4. The bearing 9*j* is fitted into the slit 12*f* of the developing means holding frame 12, and the projection 40*f* of the developing means holder 40 is inserted into the hole 12*g* of the developing means holding frame 12 and the hole 9*j*1 of the bearing 9*j*. As a result, the developing means holder 40 is secured to the developing means holding frame 12, supporting the magnet 9*g*. The wall of the hole into which the bearing 9*j*4 is inserted has a stepped portion, and the aforementioned rotation control projection protrudes from the wall of the large diameter portion of the hole, into which the flange portion of the bearing 9*j*4 is fitted. The bearing 9*j*, and a bearing which will be described later, are formed of polyacetals, polyamide, or the like.

The lengthwise end portions of the magnet 9*g* protrude from the corresponding ends of the development roller 9*c*. One end 9*g*1 of the magnet 9*g* is fitted in the supporting hole 9*v*3 of a bearing box 9*v* (FIG. 14). The development roller 9*c* is provided with a hollow journal 9*w*, which is fitted within the end portion of the development roller 9*c*, being in contact with the internal wall of the development roller 9*c*. The hollow journal 9*w* is formed of insulating substance. A cylindrical portion 9*w*1, which is an integral part of this journal 9*w*, insulates between the development bias contact 9*l*, in the form of a coil spring, electrically connected to the development roller 9*c*, and the magnet 9*g*. The bearing 9*f* is formed of insulating synthetic resin, and is fitted into a bearing fitting hole 9*v*4, the axial line of which coincides with that of the magnet supporting hole 9*v*3. The wall of this hole 9*v*4 has a key groove 9*v*5, into which a key portion 9*f*1 of the bearing 9*f* fits, preventing therefore the bearing 9*f* from rotating. The hole 9*v*4 is not a through hole, and on the bottom wall of this hole 9*v*4, the inward end portion of the development bias electrode 121 in the form of a donut-shaped disk is provided. As the above described lengthwise end portion of the development roller 9*c* is fitted into the bearing box 9*v*, the metallic development bias electrode 9*l* in the form of a coil spring comes into contact with the electrode 121, being thereby compressed. The electrode 121 has an extension 121*a*, which extends from the outward edge of the donut-shaped disk portion at an angle, in the axial direction of the hole 9*v*4, being fitted in the recess 9*v*6 formed in the wall of the hole 9*v*4, and which follows the peripheral surface of the bearing 9*f*. Further, the electrode 121 has, in addition to the extension 121*a*, or the first extension, a second extension 121*b*, a third extension 121*c*, a fourth extension 121*d*, and an external contact portion 121*e*. The second extension 121*b* extends at an angle from the first extension 121*a*, in the outward direction, in terms of the radius direction of the hole 9*v*4, and being fitted in the gap 9*v*7 formed in the edge portion of the hole 9*v*4, and the third extension 121*c* extends at an angle from the second extension 121*b*. The fourth extension 121*d* extends at an angle in the outward direction, in terms of the radius direction of the hole 9*v*4, and the external contact portion 121*e* extends at an angle from the fourth extension 121*d*. In order to support the electrode 121 structured as described above, the bearing box 9*v* is provided with a supporting portion 9*v*8, which protrudes inward. This supporting portion 9*v*8 contacts the third and fourth extensions 121*c* and 121*d*, and external contact portion 121*e*. The second extension 121*b* has an anchoring hole 121*f*, into which a joggle 9*v*9 projecting inward from the back side of the bearing box 9*v* is pressed. The contact portion 121*e* contacts the development bias electrode 125 (FIG. 6) of the apparatus main assembly 14, making it possible to apply development bias to the development roller 9*c*, as the process cartridge B is mounted into the apparatus main assembly 14.

The bearing box 9*v* has two projections 9*v*1, which fit into a pair of holes 12*m*, one for one, (FIG. 15) in one of the lengthwise ends of the developing means holding frame 12, positioning the bearing box 9*v* relative to the developing means holding frame 12. With the bearing box 9*v* positioned as described above, a pair of screws (unshown) are put through the screw holes of the bearing box 9*v*, and screwed into the female-threaded holes 12*c* of the developing means holding frame 12, solidly securing the bearing box 9*v* to the developing means holding frame 12. As is evident from the above description, in this embodiment, when attaching the development roller 9*c* to the developing means holding frame 12, first, the development roller unit G is assembled, and then, the assembled development roller unit G is attached to the developing means holding frame 12.

Next, the rod antenna 9*h* for detecting the amount of the remaining toner will be described. Referring to FIGS. 11 and 15, one of the lengthwise end portions of the rod antenna 9*h* is bent like a crank. The end of this crank-like portion of the rod antenna 9*h* constitutes a contact electrode 9*h*1 (which hereinafter will be designated with referential code 123 when it is referred to as a contact point), which comes into contact with a toner detection electrode 126, shown in FIG. 6, attached to the apparatus main assembly 14, establishing electrical connection between the rod antenna 9*h* and toner detection electrode 126. In order to attach the rod antenna 9*h* to the developing means holding frame 12, first, the end portion of the rod antenna 9*h* is inserted into the developing means holding frame 12, through a through hole 12*b* in the aforementioned lateral plate 12B. Then, the entirety of the rod antenna 9*h* is pushed into the developing means holding frame 12, and its leading end portion is inserted into a hole (unshown) in the lateral plate-of the developing means holding frame 12 on the opposite side, to make the developing means holding frame 12 support the rod antenna 9*h* by the lengthwise ends of the rod antenna 9*h*. In other words, the rod antenna 9*h* is positioned and supported by the through hole 12*b* in the lateral plate 12A and the hole (unshown) in the lateral plate on the opposite side. In order to prevent toner invasion, the through hole 12*b* is fitted with a sealing member (unshown) (ring formed of synthetic resin, felt, sponge, or the like). As the bearing box 9*v* is attached to the developing means holding frame 12, the arm portion having the contact point 9*h*1 is prevented from moving in its lengthwise direction by the bearing box 9*v*, being therefore prevented from slipping out of the developing means holding frame 12. The lateral plate 12A having the hole through which the end portion of the rod antenna 9*h* is inserted has an extended portion, which partially covers the toner cap 11 f attached to the bottom sub-frame 11*b* of the toner holding frame 11, as the toner holding frame 11 is joined with the developing means holding frame 12. The lateral plate 12A is provided with a hole (unshown), into which the coupling portion 9*s*1 (FIG. 12) of the toner sending gear 9*s* for transmitting a driving force to the toner sending member 9*b* is fitted. This gear 9*s* is provided with a coupling portion 9*s*1, which transmits the driving force to the toner sending member 9*b* by engaging with the coupling assembly 11*e* (FIGS. 13 and 16) rotationally supported by the toner holding frame 11. The coupling assembly 11*e* is connected to one of the lengthwise ends of the toner sending member 9*b*.

Referring to FIG. 15, the toner stirring member 9*e* is rotationally supported by the developing means holding frame 12, in parallel to the rod antenna 9*h*. The stirring member 9*e* is in the form of a crank. One of its journal portions is fitted in the bearing hole (unshown) of the lateral plate 12B, whereas the other is fitted in the hole of the toner stirring gear 9*m* having a shaft portion rotationally supported by the lateral plate 12A (FIG. 13), with the arm portion of the stirring member 9*e* fitted in the slot of the shaft portion to transmit the rotation of the stirring gear 9*m* to the toner stirring member 9*e*.

Next, the transmission of a driving force to the development unit D will be described.

Referring to FIG. 12, the D-cut shaft portion 9*g*1 of the magnet 9*g* is fitted in the supporting hole 40*a* of the developing means holder 40, being nonrotationally supported. As the developing means holder 40 is attached to the developing means holding frame 12, the development roller gear 9*k* meshes with the gear 9*q* of a gear train GT, and the toner stirring gear 9*m* meshes with a small gear 9*s*2, enabling the toner sending gear 9*s* and toner stirring gear 9*m* to receive a driving force from the development roller gear 9*k*. The gears 9*q* and 9*s*, and the gears between them, are all idler gears. The gear 9*q* which meshes with the gear 9*k*, and a small gear 9*q*1 integral with the gear 9*q*, are fitted around the joggle 40*b* integral with the developing means holder 40, being thereby rotationally supported by the joggle 40*b*. A large gear 9*r* which meshes with the gear 9*q*1, and a small gear 9*r*1 integral with the gear 9*r*, are rotationally supported by a joggle 40*c* integral with the developing means holder 40. The gear 9*r*1 is meshed with the gear 9*s*, which is rotationally supported by the joggle 40*d*. The gear 9*s* has the coupling portion 9*s*1, and is meshed with the gear 9*s*2, which is rotationally supported by a joggle 40*e*. With the provision of the above described structural arrangement, the gears making up the gear train GT can be supported by a single component (developing means holder 40 in this embodiment). Therefore, when assembling a process cartridge B, the gear train GT can be attached to the developing means holder 40 through a secondary assembly process. Further, the primary assembly process can be divided into a plurality of secondary assembly processes to simplify the primary assembly process. The development unit D is completed after the rod antenna 9*h* and toner stirring member 9*e* are attached to the developing means holding frame 12. This process is carried out at the same time as the development roller unit G and gear box 9*v* are attached to the driving force transmission unit DG and developing means holding frame 12, respectively.

Referring to FIG. 15, a referential code 12*p* stands for an opening, the longer edges of which are parallel to the lengthwise direction of the developing means holding frame 12. With the toner holding frame 11 and developing means holding frame 12 joined with each other, the opening 12*p* aligns with the opening 11*i* of the toner holding frame 11, making it possible for the toner in the toner holding frame 11 to be supplied to the development roller 9*c*. The aforementioned stirring member 9*e* and rod antenna 9*h* extend from one lengthwise end of the opening 12*p* to the other, in parallel to the lengthwise edges of the opening 12*p*. The material for the developing means holding frame 12 is the same as the material for the toner holding frame 11.

[Electrode Structure]

Next, referring to FIGS. 5, 6, and 8, the electrodes for establishing an electrical connection between the process cartridge B and image forming apparatus main assembly 14 as the former is mounted into the latter will be described along with the positioning of the electrodes.

Referring to FIG. 5, the process cartridge B is provided with a plurality (four) of electrodes: (1) cylindrical guide 13*a*L (which will be designated with a referential code 119 when described as conductive grounding electrode) as a grounding electrode electrically connected to the photosensitive drum 7 to ground the photosensitive drum 7 through the apparatus main assembly 14; (2) conductive charge bias electrode 120 electrically connected to a charge roller shaft to apply charge bias to the charge roller 8 from the apparatus main assembly 14; (3) conductive development bias electrode 121 electrically connected to the development roller 9*c* to apply development bias to the development roller 9*c* from the apparatus main assembly 14; and (4) conductive toner remainder amount detection electrode 122 electrically connected to the rod antenna 9*h* to detect the amount of the remaining toner. These electrodes 119–122 are positioned so that their contact portions are exposed from the side and bottom walls of the cartridge frame; more specifically, they are exposed from the left side wall, and the left end portion of the bottom wall, respectively, of the cartridge frame, as seen from the upstream side in terms of the cartridge mounting direction, with the provision of intervals large enough to prevent electrical leak among them. The grounding electrode 119 and charge bias electrode 120 are attached to the cleaning unit C, whereas the development bias electrode 121 and toner remainder amount detection electrode 122 are attached to the developing means holding frame 12. Further, the electrode 122 doubles as the cartridge presence detection electrode for detecting the presence (or absence) of the process cartridge B in the apparatus main assembly 14. Referring to FIG. 8, the grounding electrode 119 is electrically connected to the photosensitive drum 7. The charge bias electrode 120 and development bias electrode 121 are formed of an electrically conductive metallic plate (for example, stainless steel plate or phosphor bronze plate), and are intricately extended from inside the process cartridge B. The charge bias electrode 120 is exposed from the bottom surface of the cleaning unit C, whereas the development bias electrode 121 and toner remainder amount detection electrode 122 are exposed from the bottom surface of the development unit D.

Figure 8:
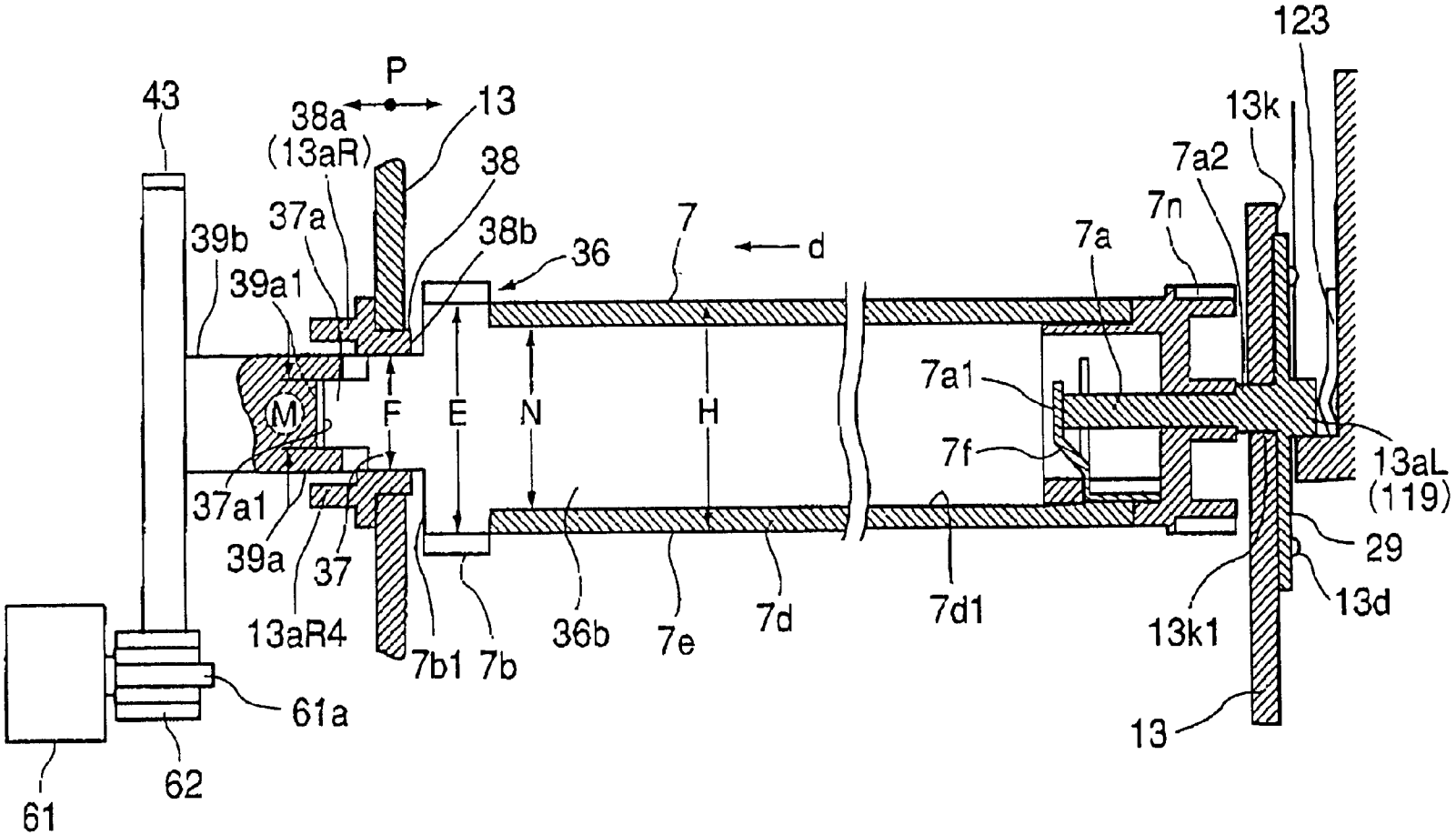
FIG. 8 is a longitudinal sectional view of a photosensitive drum and a driving device therefor.

To describe more in detail, referring to FIG. 8, in this embodiment, the photosensitive drum 7 is provided with the drum gear 7*b*, which is attached to one end of the photosensitive drum 7 in terms of its axial direction. The drum 7*b* meshes with the development roller gear 9*k*, rotating the development roller 9*c*. As it is rotated, it generates thrust (in the direction d indicated in FIG. 8), pressing the photosensitive drum 7 toward the drum gear 7*b*. As a result, a grounding plate 7*f* solidly fixed to the flange having a spur gear 7*n* is pressed by-the drum shaft 7*a* in the direction of the arrow d, generating, therefore, a reactive force, and the lateral surface 7*b*1 of the gear 7*b* is placed in contact with the inward end surface 38*b* of the bearing 38 solidly fixed to the cleaning means holding frame 13. As a result, the position of the photosensitive drum 7, in terms of its axial direction, in the process cartridge B is regulated. The grounding electrode 119 is on the inward surface of the one of the lengthwise lateral walls 3*k* of the cleaning means holding frame 13, being exposed. The drum shaft 7*a* protrudes inward of the drum cylinder 7*d* through the center hole of the drum journal. The drum cylinder 7*d* and drum shaft 7*a* are electrically connected to each other by the grounding plate 7*f*, which is in contact with the internal surface 7*d*1 of the drum cylinder 7*d* and the end surface 7*a*1 of the drum shaft 7*a*.

The charge bias electrode 120 is attached to the cleaning means holding frame 13, near the portion which is supporting the charge roller 8 (FIG. 5).

The development bias electrode 121 and toner remainder amount detection electrode 122 are attached to the bottom wall of the development unit D. The external contact portion of the development bias electrode 121 is disposed opposite to the charge bias electrode 120, with the interposition of the spur gear 7*n*.

The detection electrode 122 shown in FIG. 5 is disposed on the upstream side of the development bias electrode 121 in terms of the cartridge mounting direction (direction of arrow mark X), being exposed from the developing means holding frame 12.

Next, the connection between the electrodes provided on the process cartridge side, and the contact electrodes provided on the apparatus main assembly side, will be described. Referring to FIG. 6, the image forming apparatus A is provided with four contact electrodes which come into contact with the aforementioned contact electrodes of the process cartridge B as the process cartridge B is mounted into the image forming apparatus A (grounding electrode 123 which is electrically connected to grounding electrode 119; charge bias electrode 124 which is electrically connected to charge bias electrode 120; development bias electrode 125 which is electrically connected to development bias electrode 121; and toner remainder amount detection electrode 126 which is connected to toner remainder amount detection electrode 122). As shown in FIG. 6, the grounding electrode 123 is attached to the bottom of the positioning groove 16*b*. The development bias electrode 125, toner remainder amount detection electrode 126, and charge bias electrode 124 are attached to the bottom wall of the cartridge mounting space S, being positioned below the guiding portion 16*a*.

[Structures of Coupling and Driving Mechanism]

Next, the coupling means, which is a driving force transmission mechanism for transmitting a driving force from the apparatus main assembly 14 to the process cartridge B, will be described. FIG. 8 is a vertical sectional view of the coupling assembly. As is evident from FIG. 8, the photosensitive drum 7 is provided with a coupling means, which is attached to one of the lengthwise ends of the photosensitive drum 7. This coupling means is a coupling shaft 37 (cylindrical) which is a part of a drum flange 36 solidly attached to one end of the photosensitive drum 7. The shaft 37 is made up of the base portion, and the end portion 37*a* (male portion of coupling means) which is projecting from the base portion. The shaft 37 fits in the bearing 38, and functions as the rotational axle of the photosensitive drum 7. The flange 36 is provided with the helical drum gear 7*b* for transmitting a driving force to the development roller 9*c*. The projection 37*a* is in the form of a twisted polygonal pillar, more specifically, a pillar, the cross section of which is approximately in the form of an equilateral triangle, and which is twisted in the rotational direction of the photosensitive drum 7. On the other hand, a recess 39*a* (female portion of coupling means), into which the projection 37*b* fits, is a hole, the cross section of which is polygonal, and which is twisted in the rotational direction of the photosensitive drum 7. More specifically, the cross section of the recess 39*a* is approximately in the form of an equilateral triangle. The portion with the recess 39*a* is a part of the coupling shaft 39*b* integral with the gear 43 provided on the apparatus main assembly side.

Designated by a referential code 36*b* is an integral portion of the flange 36, which is fitted into the drum cylinder 7*d* to attach the flange 36 to the photosensitive drum 7.

Further, the bearing 38, which is solidly fixed to the cleaning means holding frame 13, is provided with a cylindrical projection 38*a* (cylindrical guide 13*a*R), which surrounds the projection 37*a* of the shaft 37 as the shaft 37 is fitted into the bearing 38 (FIG. 9). The bearing 38 doubles as a guiding member for guiding the process cartridge B when mounting or dismounting the process cartridge B, into or from, the apparatus main assembly 14.

The gear 43 is a helical gear, and is meshed with a small helical gear solidly attached to the shaft 61*a* of a motor 61. Thus, as the motor 61 is driven for image formation, the shaft with the recess 39*a* is moved toward the shaft 37 with the projection 37*a*, causing the projection 37*a* to enter the recess 39*a*.

The process cartridge B is mounted in the apparatus main assembly 14, being allowed to move in the lengthwise direction of the process cartridge B as well as the cartridge mounting direction indicated by an arrow mark X (FIG. 6). As the process cartridge B is inserted into the apparatus main assembly 14, the cylindrical guide 13*a*L (FIGS. 4 and 6) drops into the groove 16*b* (FIG. 6), being thereby positioned. As for the other lengthwise end of the photosensitive drum 7 (side from which photosensitive drum 7 is driven, which hereinafter may be referred to as driven side), the cylindrical guide 13*a*R is supported by the positioning groove 16*d*.

Figure 19:
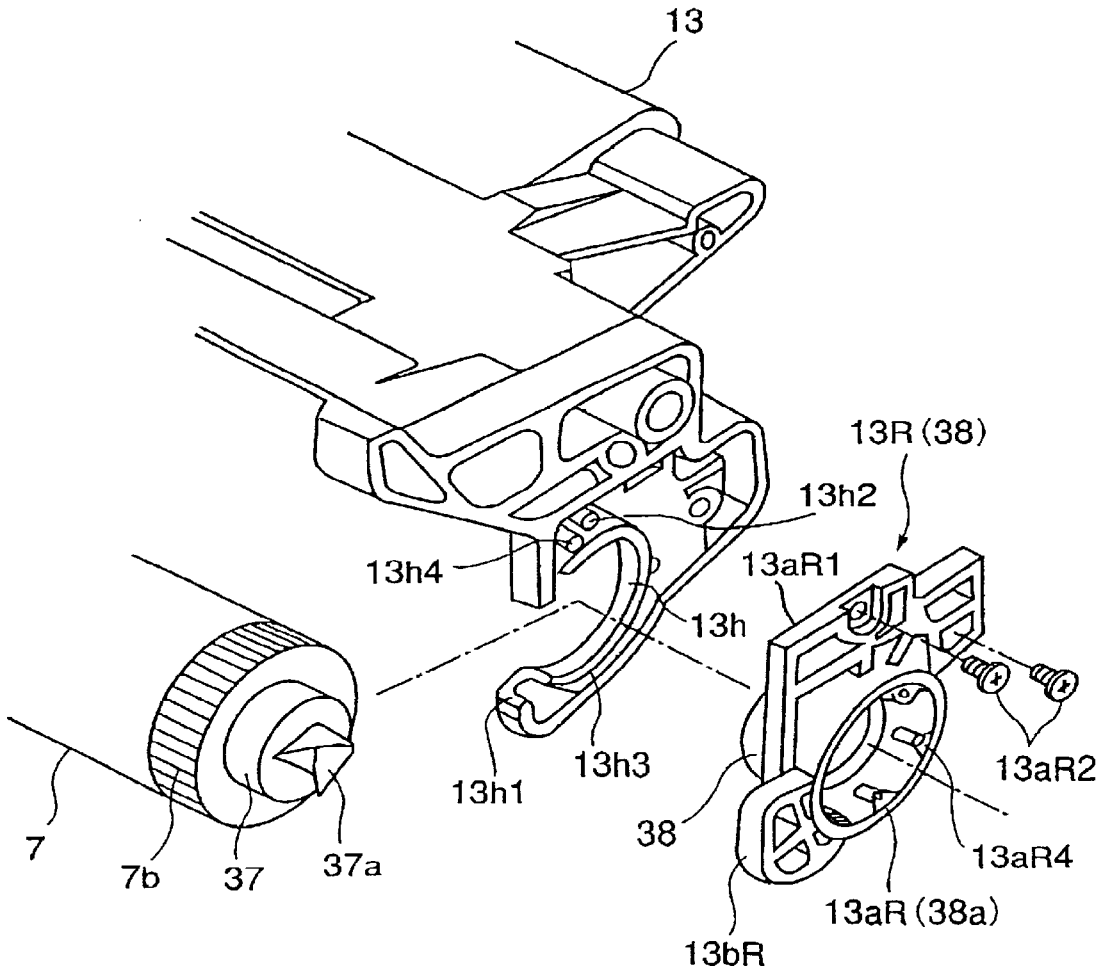
FIG. 19 is a perspective view of a mounting portion of the photosensitive drum to the cleaning frame.
Figure 20:
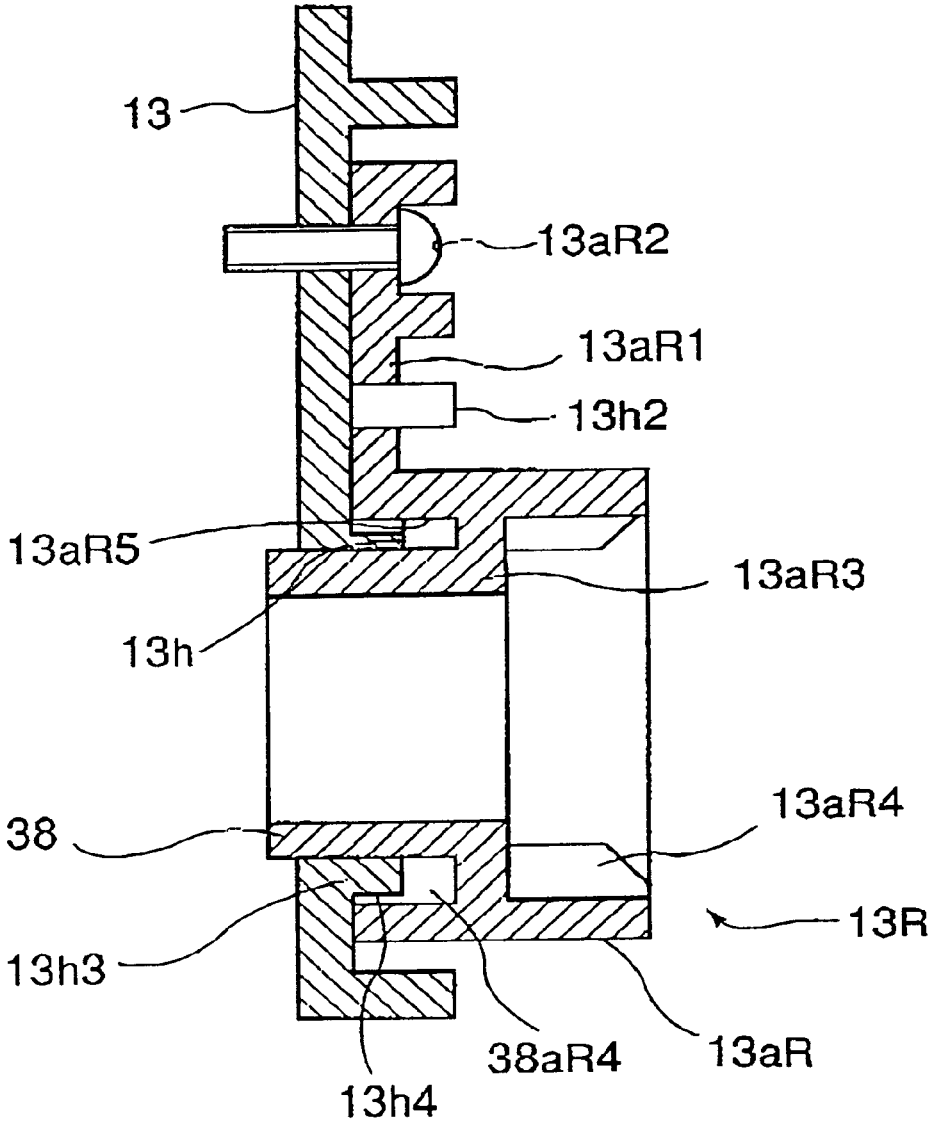
FIG. 20 is a longitudinal sectional view of a drum shaft receiving portion.
Figure 21:
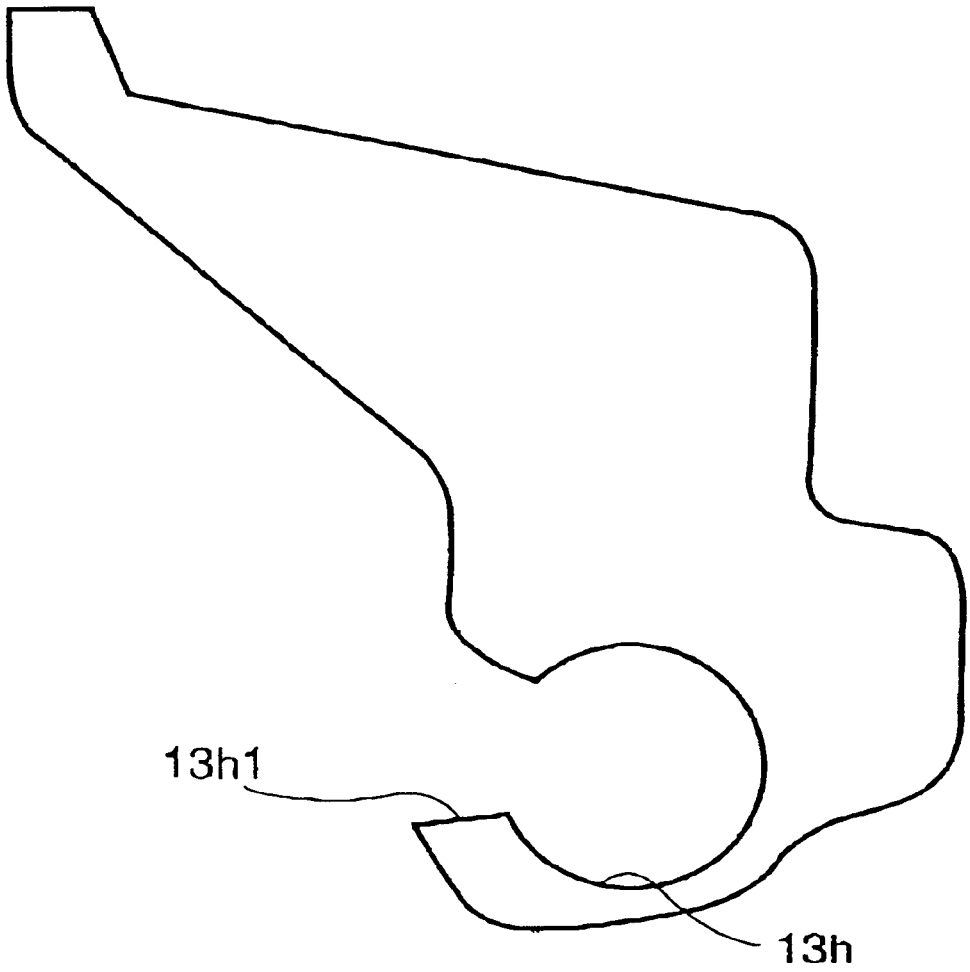
FIG. 21 is a side view showing a configuration of an outside of the drum shaft receiving portion.

FIG. 19 is a perspective drawing for showing the relationship between the guiding member 13R and cleaning means holding frame 13, in terms of how the former is attached to the latter, and FIG. 20 is a vertical sectional view of the guiding member 13R and cleaning means holding frame 13 after the attachment of the former to the latter. FIG. 21 is a drawing for showing a part of the surface of the cleaning means holding frame 13 on the right-hand side. The bearing 38 is an integral part of the rear side of the guiding member 13R, and its axial line coincides with that of the cylindrical guide 13*a*R (FIGS. 19 and 20). The bearing 38 has a donut-shaped portion 13*a*R3. There is a gap between the bearing 38 and cylindrical guide 13*a*R, forming a cylindrical groove 38*a*R4. One of the lateral walls of the cleaning means holding frame 13 is provided with a hole 13*h* into which the bearing 38 is fitted (FIGS. 19 and 21). The width of the missing portion 13*h*1 of the wall of the hole 13*h*, in terms of the direction perpendicular to the radius direction of the hole 13*h*, is smaller than the diameter of the hole 13*h*, and is greater than the diameter of the shaft 37. The aforementioned lateral wall of the cleaning means holding frame 13 is provided with a positioning pin 13*h*2, which fits into the flange 13*a*R1 of the guiding member 13R. With the provision of the above described structural arrangement, the unitized photosensitive drum 7 can be mounted into the cleaning means holding frame 13 from the direction perpendicular to the axial direction (lengthwise direction) of the photosensitive drum 7. Further, the guiding member 13R is accurately positioned relative to the cleaning means holding frame 13 when attaching the guiding member 13R to the cleaning means holding frame 13. In order to attach the photosensitive drum 7 to the cleaning means holding frame 13, the photosensitive drum 7 is to be moved in the direction perpendicular to the lengthwise direction of the photosensitive drum 7 (FIG. 19). During this movement of the photosensitive drum 7, the shaft 37 is to be inserted into the hole 13*h* through the missing portion 13*h*1, or the gap, of the surrounding wall of the hole 13*h*. With the photosensitive drum 7 held in this state, the drum shaft 7*a* integral with the cylindrical guide 13*a*L is to be put through the lateral end wall 13*k* of the cleaning means holding frame 13, so that the drum gear 7*a* is meshed with the spur shaft 7*n*. Next, a pair of small screws 13*d* are put through the flange 29, and are screwed into the cleaning means holding frame 13, solidly attaching the cylindrical guide 13*a*L to the cleaning means holding frame 13, and supporting the photosensitive drum 7 by one of the lengthwise ends. Next, the bearing 38 integral with the guiding member 13R is fitted into the bearing hole 13*h* so that the shaft 37 is fitted into the bearing 38. Then, the positioning pin 13*h*2 is fitted into the hole of the flange 13*a*R1. Thereafter, a pair of screws 13*a*R2 are put through the flange 13*a*R1 and are screwed into the cleaning means holding frame 13, solidly fixing the guiding member 13R to the cleaning means holding frame 13. The guiding portion 13*a*R4 is a portion for guiding the shaft with the recess 39*a*.

[Remanufacture of Process Cartridge]

Next, the process cartridge remanufacturing method in this embodiment of the present invention will be described.

In order to remanufacture the process cartridge in this embodiment, first, the process cartridge is separated into the development unit and cleaning unit after the depletion of the toner from the process cartridge. In terms of function, a remanufactured process cartridge is the same as a brand-new one. In terms of structure, however, a part of its development unit is different from that of a brand-new one. To describe concretely, the development unit of a remanufactured process cartridge is different from that of a brand-new one in that the former does not have the cover film 51 (FIG. 17) which seals the opening 111 (FIG. 16) of the toner holding frame 11 (neither is the torn cover film 51 restored, nor is the opening sealed with brand-new cover film 51), and that the interfaces between the development roller unit G (FIG. 11) and the developing means holding frame 12, and between the development blade 9*d* and developing means holding frame 12, are better sealed to compensate for the lack of the cover film 51. If the cover film 51 is restored, a remanufactured process cartridge is virtually the same as a brand-new process cartridge. In the process cartridge remanufacturing method in this embodiment, which will be described hereinafter, the cover film 51 is not restored. When remanufacturing a process cartridge, the development unit D can be sealed approximately as well as the development unit D in a brand-new process cartridge is sealed, without attaching a new cover film 51 or restoring the old film 51.

First, a method for sealing the development unit D well enough to prevent toner from leaking from the development unit D, without the cover film 51, will be described.

According to this embodiment which will be described hereinafter, it is possible to prevent toner from leaking during the ordinary handling of the process cartridge, for example, while a user is mounting or dismounting the process cartridge B, into or from, the image forming apparatus A, or is carrying the process cartridge B by hand. Further, it is possible to prevent toner from leaking even under severe conditions, for example, while the process cartridge B is transported by truck, ship, aircraft, or the like; after its remanufacture in a factory. To describe in more detail, while a process cartridge B is shipped out of a factory and is transported to be handed to a user, vibrations and impacts which are much greater than those to which the process cartridge B will be normally subjected when it is normally used by a user act on the process cartridge B. According to the remanufacturing method in this embodiment, toner can be prevented from leaking during the transportation of the process cartridge B, even if the cover film 51 is not used. In other words, the toner leakage from the process cartridge B can be prevented well enough for the process cartridge B to be sold as a viable product.

To describe concretely, with the presence of the cover film 51, the opening 11*i* is sealed, and therefore, the back side of the development blade 9*d* (FIGS. 2 and 18) (opposite side of development roller 9*c*), and the adjacencies of the toner stirring member 9*e* and rod antenna 9*h*, are not filled with toner. Thus, the interfaces between the development roller unit G and developing means holding frame 12 and between the development blade 9*d* and developing means holding frame 12 have only to be sealed enough to prevent toner from leaking during the aforementioned period, that is, while the process cartridge B is handled by a user. However, if the cover film 51 is not attached when remanufacturing the process cartridge B, the back side of the development blade 9*d* (opposite side of development roller 9*c*), and the adjacencies of the toner stirring member 9*e* and rod antenna 9*h*, are going to be filled with toner. Thus, the interfaces between the development roller unit G and developing means holding frame 12 and between the development blade 9*d* and developing means holding frame 12 must be sealed enough to prevent toner from leaking during the transportation of the process cartridge B.

Therefore, the process cartridge B remanufacturing method in this embodiment seals the interfaces between the development roller unit G and developing means holding frame 12 and between the development blade 9*d* and developing means holding frame 12 sufficiently to prevent toner from leaking the interfaces, instead of attaching a new cover film 51.

[Process for Separating Development Unit from Cleaning Unit]

Next, the process for separating the development unit D from the cleaning unit C will be described. As described before, the developing means holding frame 12 and drum holding frame 13 were joined to each other by putting the connecting members 22 through the holes 20 of the left and right arm portions 19 of the developing means holding frame 12, and the left and right holes 13*e* of the cleaning means holding frame 13. Therefore, when disassembling the process cartridge B, the connecting members 22 are pulled out of the above described holes 20, separating the developing means holding frame 12 from the cleaning means holding frame 13. As is evident from the above description, according to this embodiment the disassembly of the process cartridge B is very simple. Incidentally, in order to pull out the connecting members 22, a dedicated pulling tool designed in accordance with cartridge shape, or an ordinary tool, such as a nipper or a plier, may be used. After the separation, the development unit D and cleaning unit C appear as shown in FIGS. 9 and 10.

[Process for Removing Development Roller]

The development roller unit G is supported by attaching the bearing box 9*v* and driving force transmission unit DG to the lateral plates 12B and 12A of the developing means holding frame 12, as described in the above described [Development Means Holding Frame] section (FIGS. 11, 12 and 14). Therefore, in order to remove the development roller 9*c*, the screws (unshown) holding the bearing box 9*v* and unit DG to the lateral plates 12B and 12A of the developing means holding frame 12 are removed with the use of a screwdriver. Then, the bearing box 9*v* and unit DG are removed from the development means holding frame 12. Thereafter, the development roller unit G is lifted out of the development means holding frame 12; the development roller 9*c* is removed from the development means holding frame 12.

[Process for Removing Development Blade]

The development blade 9*d* also was attached to the development means holding frame 12 as described in the above described [Development Means Holding Frame] section. More specifically, in order to solidly attach the metallic plate 9*d*1 to the blade anchoring surface 12*i*, as a blade attachment portion, of the development means holding frame 12, the screws 9*d*6 were put through the screw holes 9*d*4 of the metallic plate 9*d*1, and were screwed into the female-threaded holes 12*i*2 in the blade anchoring surface 121. Thus, in order to remove the development blade 9*d*, the screws 9*d*6 are removed from the development means holding frame 12 with the use of a tool such as a screwdriver. Then, the development blade 9*d* is lifted out the development means holding frame 12; the development blade 9*d* is removed from the development means holding frame 12.

[Process for Removing Elastic Sealing Member]

Referring to FIGS. 2 and 11, the thin elastic sealing member 12*s*2 was pasted to the mandible-like portion 12*h* (elastic sealing member pasting surface 1 of stepped portion 12*h*2 in FIG. 2), being positioned so that it contacts the generatrix of the development roller 9*c* to seal the gap which extends in the lengthwise direction of the process cartridge B between the development means holding frame 12 and the peripheral surface of the development roller 9*c*; one of the edges in terms of the widthwise direction, that is, one of the long edges of the elastic sealing member 12*s*2 was pasted to the mandible-like portion 12*h* with the use of pasting means such as double-sided adhesive tape. The other long edge was elastically placed in contact with the peripheral surface of the development roller 9*c*; in other words, the gap between the development means holding frame 12 and the peripheral surface of the development roller 9*c* was sealed by elastically bending the sealing member 12*s*2 in the direction perpendicular to the lengthwise direction to prevent toner from leaking out through the gap between the development roller 9*c* and development means holding frame 12.

In this process cartridge B remanufacturing method, the original elastic sealing member 12*s*2 is replaced with a sealing member (12*s*2) which is wider and thicker than the original elastic sealing member 12*s*2; the replacement sealing member (12*s*2) is pasted to the elastic sealing member anchoring surface with the use of double-sided adhesive tape, in such a manner that the center portion of the double-sided adhesive tape protrudes from the elastic sealing member anchoring surface toward the development roller 9*c*, as will be described later. In order to do so, first, the original sealing member 12*s*2 on the mandible-like portion 12*h* is peeled off. As for the peeling method, all that is necessary is to pull the sealing member 12*s*2 in contact with the development roller 9*c* by hand, or a pair of tweezers or the like. If the adhesive of the double-sided adhesive tape remains on the mandible-like portion 12*h* after the peeling of the sealing member 12*s*2, it should be wiped away with the use of alcohol or the like.

[Process for Attaching Thin Plate]

As described before, in this process cartridge remanufacturing method, the cover film 51 is not restored. Thus, a certain measure for preventing toner from leaking from between the development roller unit G and developer means holding frame 12 is taken. As one of the examples of such a measure, a thin plate is pasted to the elongated seal which seals the gap between the developer holding means frame 12 and development blade 9*d*.

Figure 22:
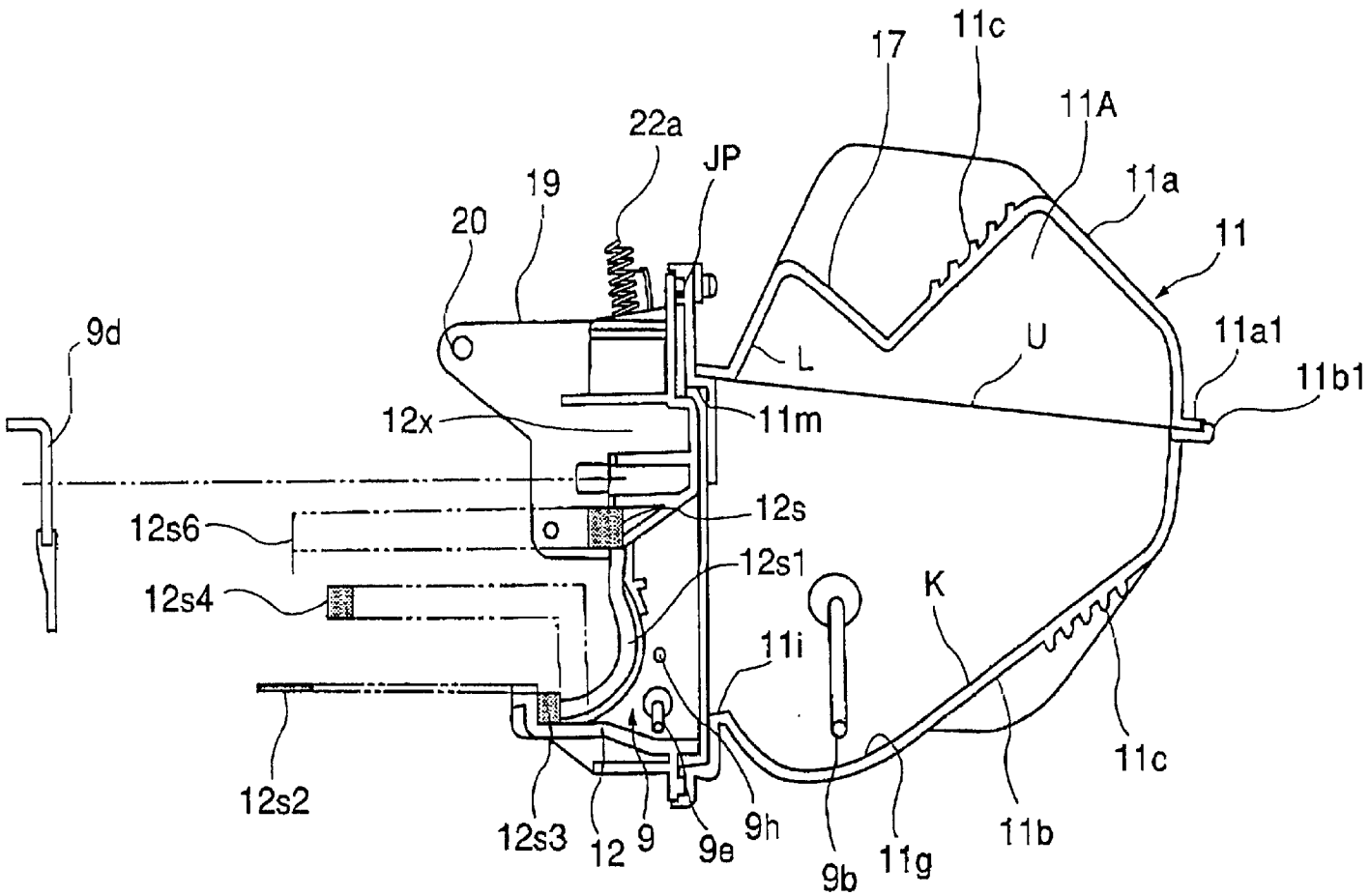
FIG. 22 is a sectional side elevation illustrating a mounting step of a part in a remanufacturing process.
Figure 23:
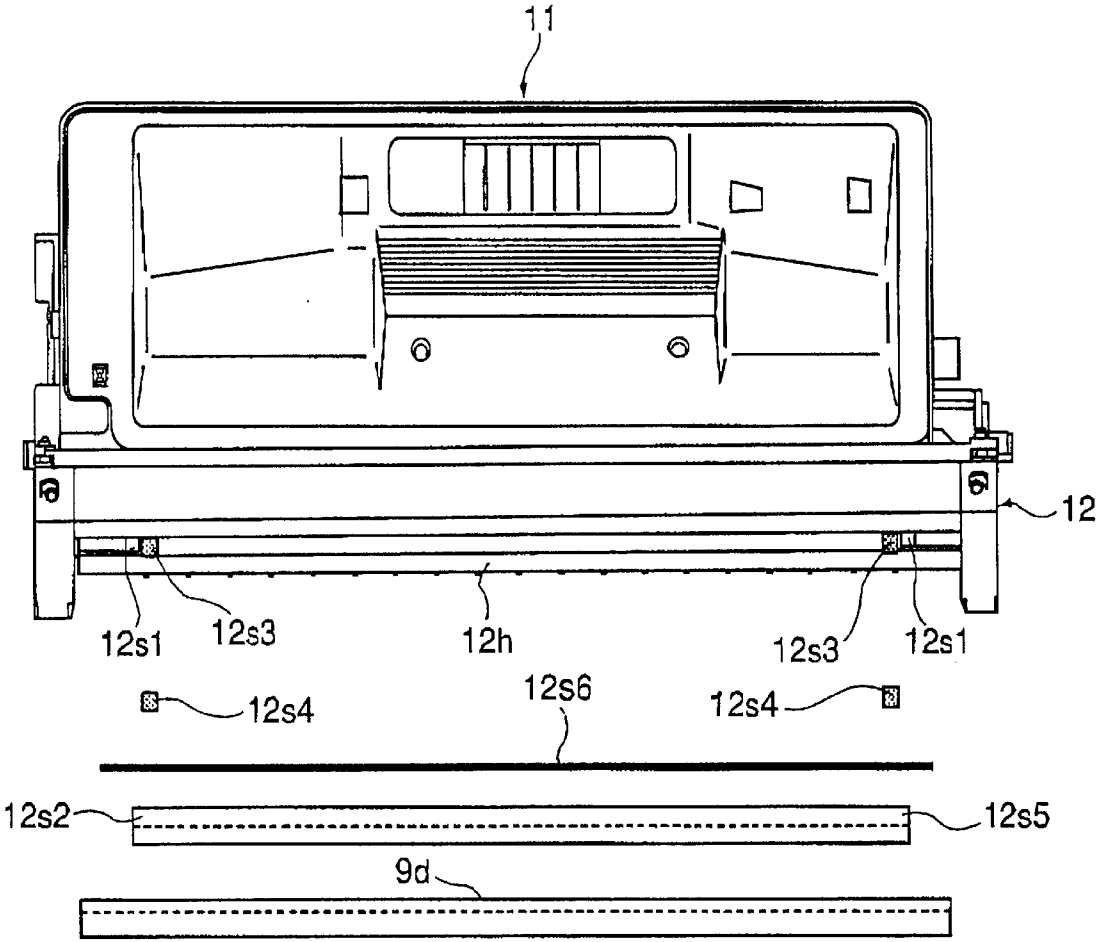
FIG. 23 is a top plan view illustrating a part mounting step in the remanufacturing process.

FIG. 22 is a sectional drawing for describing the process for attaching a toner leak prevention member with the use of the process cartridge remanufacturing method in this embodiment, in order to prevent toner leakage, and FIG. 23 is a top plan view of the developing means holding frame 12. In FIGS. 22 and 23, a referential code 12*s*6 stands for a piece of thin plate for improving the sealing performance of the elastic sealing member 12*s*, or the elongated seal for sealing between the developer means holding frame 12 and development blade 9*d*. The thin plate 12*s*6 is formed of polyethylene-terephthalate (PET) or the like. It is pasted to the top surface of the elastic sealing member 12*s* using pasting means such as double-sided adhesive tape, adhesive, or the like. In terms of the lengthwise direction of the process cartridge B, the dimension of the thin plate 12*s*6 is equal to that of the elastic sealing member 12*s*, whereas in terms of the widthwise direction of the process cartridge B, the dimension of the thin plate 12*s*6 is greater than that of the elastic sealing member 12*s*. Thus, the thin plate 12*s*6 is pasted so that it protrudes from the elastic sealing member 12*s* on the development roller side, by the distance equivalent to the amount by which the thin plate 12*s*6 is wider than the elastic sealing member 12*s*. The addition of the thin plate 12*s*6 increases the amount by which the elastic sealing member 12*s* formed of Moltprene is compressed. Further, if toner particles pass by the sealing member 12*s*, they are dammed by the thin plate 12*s*6, better sealing the aforementioned gap.

[Process for Attaching Second Auxiliary Development End Seal]

Figure 24:
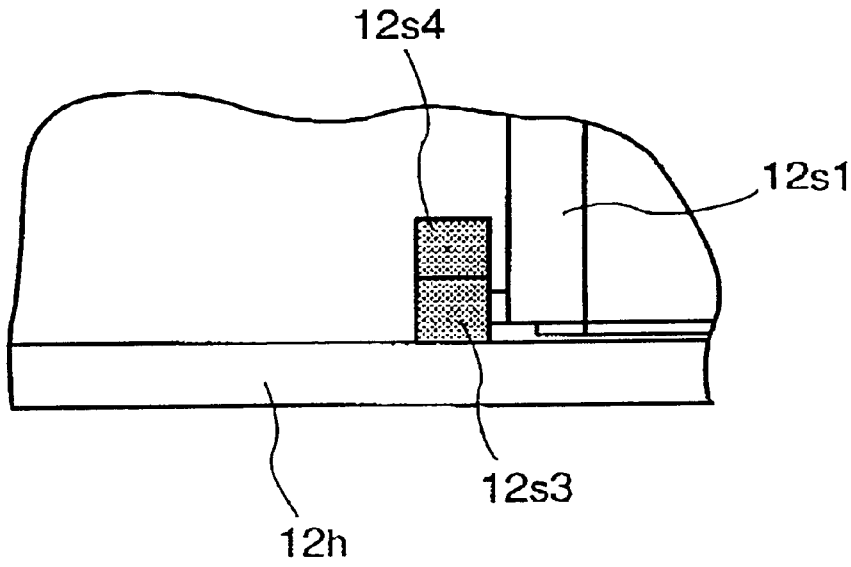
FIG. 24 is an enlarged view of an upper surface portion illustrating a mounting step of mounting a second developing roller one end portion assistance seal which is newly mounted in the remanufacturing process.

Referring to FIGS. 22–24, designated by a referential code 12*s*3 is a first auxiliary seal for sealing the gap next to the one of the lengthwise ends of the development roller 9*c*. A pair of auxiliary seal 12*s*3 are pasted in advance to the developing means holding frame 12 to prevent toner from leaking from between the magnetic sealing member 12*s*1 and elastic sealing member 12*s*2. The first auxiliary seal 12*s*3 is in the form of a parallelepiped or a cube, and is formed of Moltprene. It is pasted to the developing means holding frame 12, with the use of double-sided adhesive tape, on the location which is on the inward side of the magnetic sealing member 12*s*1, and which is covered with the elastic sealing member 12*s*2, and also on the location which is on the outward side of the magnetic sealing member 12*s*1, that is, the side opposite to the development roller 9*c* with respect to the magnetic sealing member 12*s*1 (two first auxiliary seals 12*s*3 are pasted to the left and right ends, one for one). In this remanufacturing method, in order to enhance the sealing performance of the first auxiliary seal 12*s*3, a pair of second auxiliary seals 12*s*4 for sealing the gaps in the adjacencies of the lengthwise end portions of the development roller 9*c* are pasted. These second auxiliary seals 12*s*4 were not pasted to the developing means holding frame 12 in a brand-new cartridge. Referring to FIG. 23, the first auxiliary seal 12*a*4 is similar in shape to the auxiliary seal 12*s*3. Referring to FIG. 24, the auxiliary seal 12*s*4 is pasted to the developing means holding frame 12 with the use of pasting means such as double-sided adhesive tape or adhesive, being placed in contact with the first auxiliary seal 12*s*3, on the development roller side, in such a manner that it follows the inward side of the magnetic sealing member 12*s*1. FIG. 24 is an enlarged top plan view of a part of the developing means holding frame 12, to which the second auxiliary seal 12*s*4 has been attached.

[Process for Pasting Elastic Sealing Member]

Figure 32:
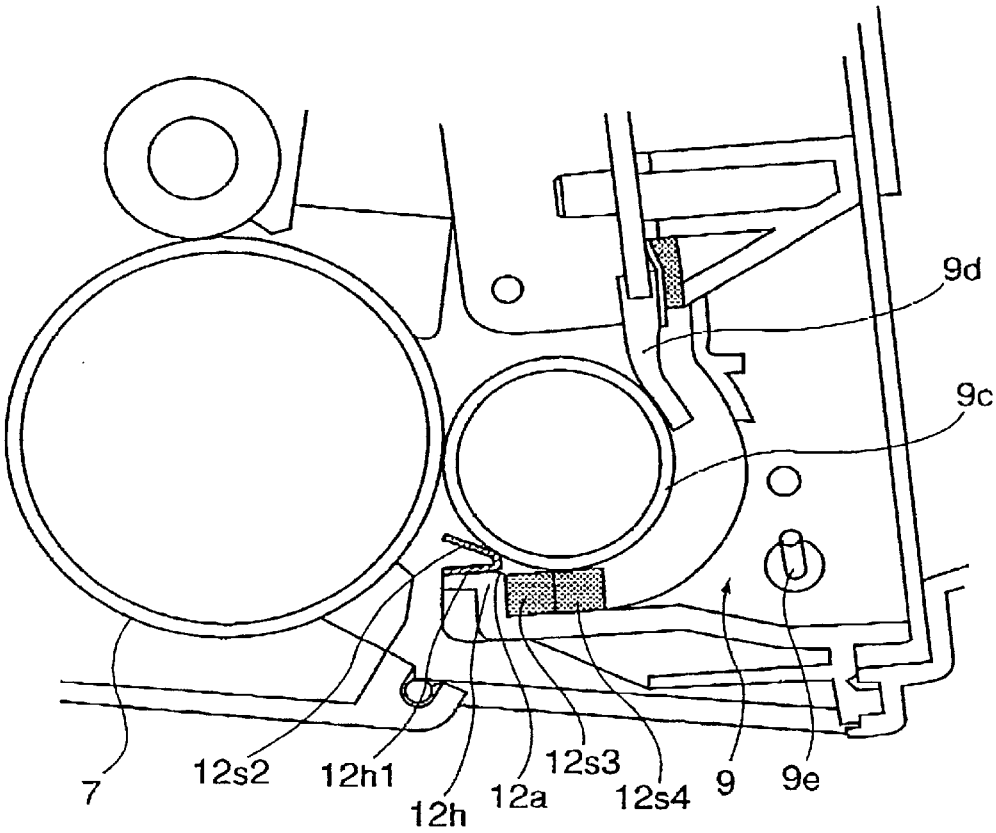
FIG. 32 is a longitudinal section enlarged view in which a thin elastic sealing member is wound.

Next, the elastic sealing member 12*s*2, which was peeled in the above described [Process for Removing Thin Elastic Sealing Member] section is reattached to the mandible-like portion 12*h*. The elastic sealing member 12*s*2 was peeled for improving the efficiency with which [Process for Attaching Second Auxiliary Seal for Adjacencies of Development Roller] is carried out, and for preventing the free long edge portion of the elastic sealing member 12*s*2 from being peeled away from the peripheral surface of the development roller 9*c*. Here, the phenomenon that the free long edge portion of the elastic sealing member 12*s*2 is peeled away from the peripheral surface of the development roller 9*c* will be described. The elastic sealing member 12*s*2 was pasted to the mandible-like portion 12*h* (bottom sub-frame of developing means holding frame) by one of its long edges, with the use of pasting means such as double-sided adhesive tape as described above, and the other long edge was placed elastically in contact with the peripheral surface of the development roller 9*c* (by bending elastic sealing member 12*s*2 in a direction perpendicular to the lengthwise direction of development roller 9*c*) to seal the gap between the peripheral surface of the development roller 9*c* and developing means holding frame 12. To describe in more detail, referring to FIG. 2, the development roller 9*c* rotates counterclockwise, whereas the elastic sealing member 12*s*2 is attached to the elastic sealing member pasting surface by the upstream side in terms of the moving direction of the peripheral surface of the development roller 9*c*. In other words, the sealing member 12*s*2 is pasted so that the direction in which the sealing member 12*s*2 extends in terms of its widthwise direction agrees with the rotational direction of the development roller 9*c*. However, the sealing member 12*s*2 is pushed up by the toner particles under the sealing member 12*s*2 (this pressure is sometimes referred to as toner pressure). If this toner pressure becomes excessive due to the vibrations and/or impacts which occur during the transportation of the process cartridge B, it is possible that the free long edge of the sealing member 12*s*2 will be partially, or entirely, peeled away from the peripheral surface of the development roller 9*c* and bent toward the photosensitive drum 7 as shown in FIG. 32. This is the aforementioned phenomenon called "peeling". FIG. 32 is an enlarged sectional view of the development roller 9*c* and its adjacencies. As the elastic sealing member 12*s*2 is "peeled", it fails to function as a seal, allowing toner to blow out through the gap between the development roller 9*c* and mandible-like portion 12*h*. According to the process cartridge remanufacturing method in this embodiment, however, the original elastic sealing member 12*s*2 is replaced with an elastic sealing member 12*s*2, the dimension of which in terms of the widthwise direction and the thickness of which are greater than those of the original elastic sealing member 12*s*2, in other words, an elastic sealing member 12*s*2 stronger than the original elastic sealing member 12*s*2 is provided, preventing thereby the occurrence of "peeling". Incidentally, the original sealing member 12*s*2 is approximately 8 mm in the dimension in terms of the widthwise direction, and approximately 39 $\mu$m in thickness, whereas the sealing member 12*s*2 pasted in this process cartridge remanufacturing process is approximately 13 mm in the dimension in terms of the widthwise direction, and approximately 50 $\mu$m in thickness.

Figure 25:
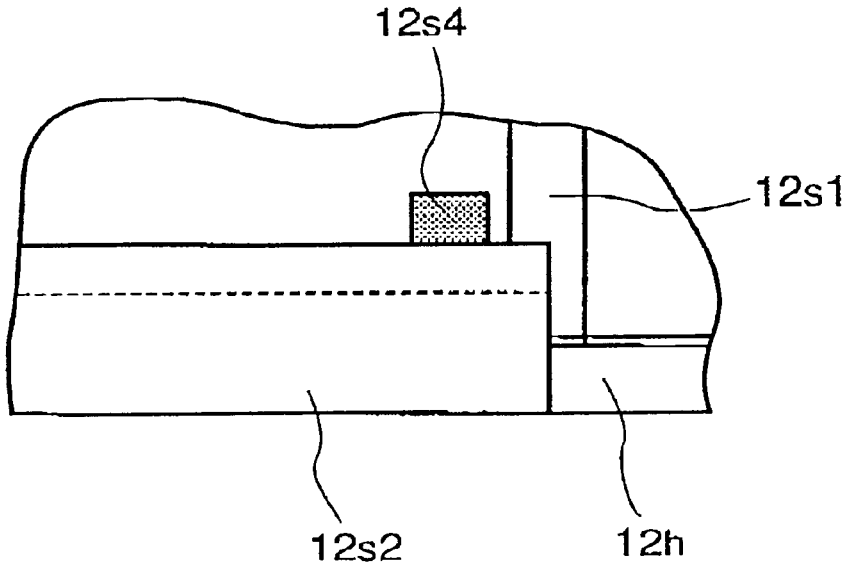
FIG. 25 is an enlarged view of an upper surface portion illustrating a sticking step of newly sticking a thin elastic sealing member in the remanufacturing process.

FIGS. 22 and 23 are drawings for showing the process for pasting the sealing member 12*s*2, and FIG. 25 is an enlarged top view of one of the lengthwise end portions of the developing means holding frame 12.

Referring to FIG. 25, the elastic sealing member 12*s*2 is pasted to the elastic sealing member pasting surface of the mandible-like portion 12*h* (bottom sub-frame of developing means holding frame), with the use of double-sided adhesive tape, so that the entire surface of the first auxiliary seal 12*s*3 and a part of the magnetic sealing member 12*s*1 is covered with the elastic sealing member 12*s*2.

Further, the elastic sealing member 12*s*2 is pasted so that it is bent in the direction perpendicular to the lengthwise direction, making it more difficult for the sealing member 12*s*2 to be "peeled".

Figure 26:
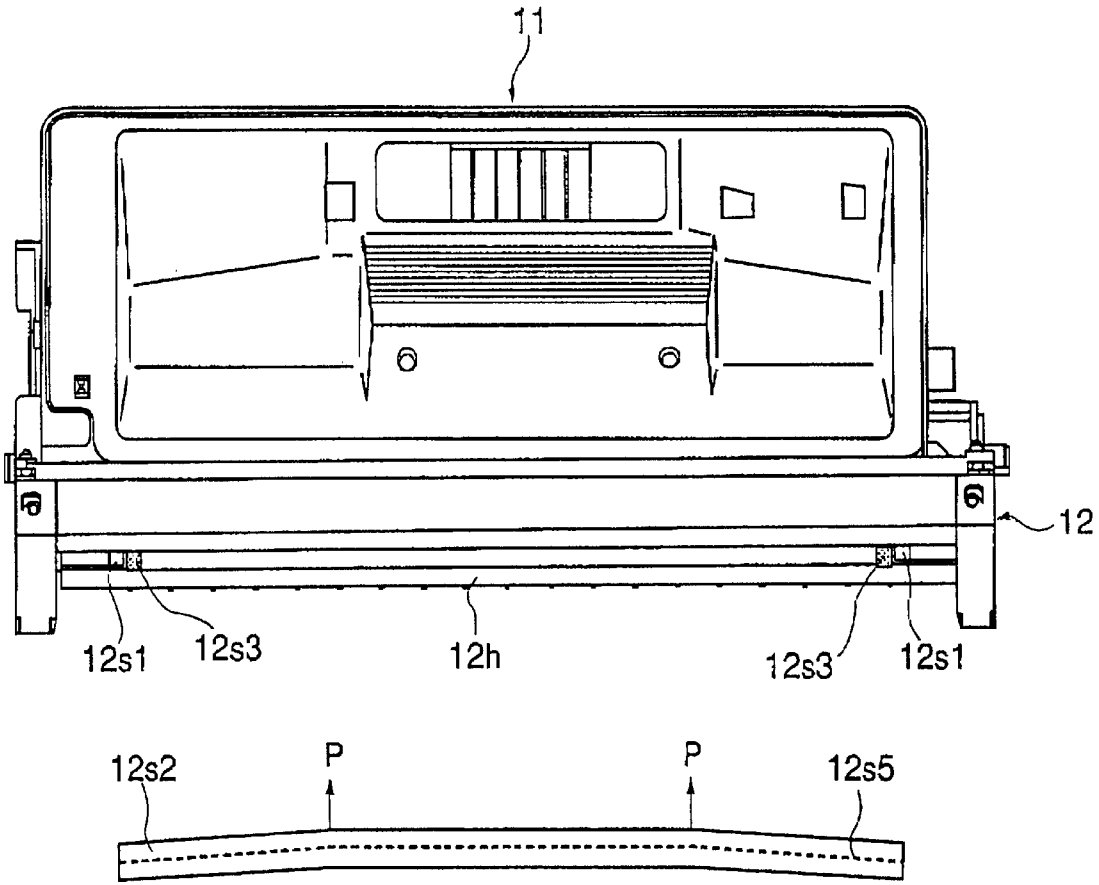
FIG. 26 is a top plan view illustrating sticking state of the thin elastic sealing member which is remounted in the remanufacturing process.
Figure 27:
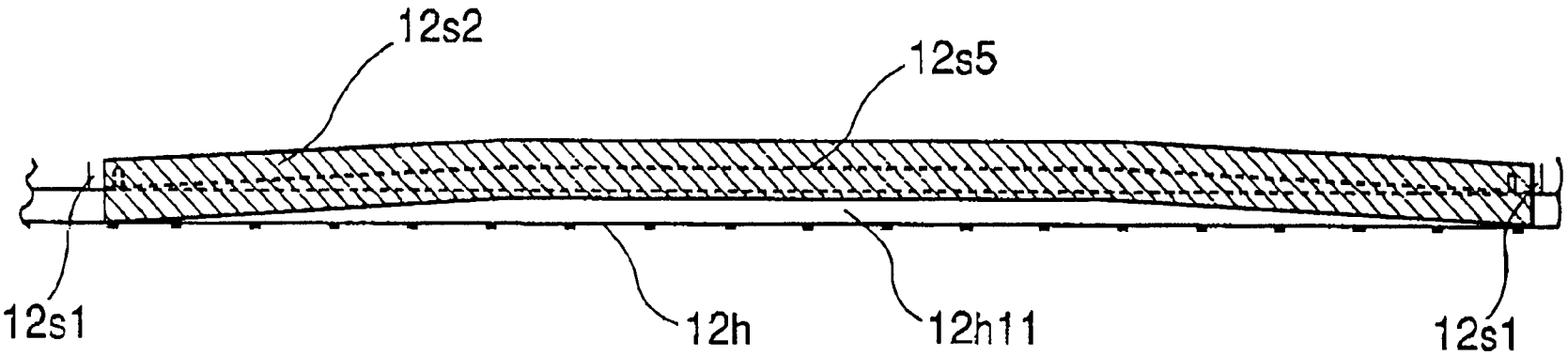
FIG. 27 is a top plan view of a picked-up jaw portion and thin elastic sealing member.

Referring to FIGS. 26 and 27, the above description will be elaborated.

FIG. 26 is a drawing for showing the process for pasting the sealing member 12*s*2, and FIG. 27 is the mandible-like portion 12*h* and sealing member 12*s*2 enlarged to make it easier to understand the manner in which the latter is pasted to the former.

In the sealing member pasting process, as the sealing member 12*s*2 is pulled by the two points indicated by a referential code P in FIG. 26, it bends toward the development roller 9*c*. If the sealing member 12*s*2 in this state is pasted to the pasting surface, it remains bent after the pasting. Referring to FIG. 27, the hatched member is the elastic sealing member 12*s*2, and the double-sided adhesive tape 12*s*5 pasted on the back side of the elastic sealing member 12*s*2 is contoured with broken lines; the double-side adhesive 12*s*5 has been bent because the sealing member 12*s*2 has been bent. If the sealing member 12*s*2 bent in this manner is pasted to the pasting surface, the double-sided adhesive tape 12*s*5, in particular, its center portion, protrudes from the pasting surface toward the development roller 9*c*. In this embodiment, the sealing member 12*s*2 is pasted to the pasting surface while keeping the sealing member 12*s*2 bent so that the center portion of the double sided adhesive tape 12*s*5 will protrude from the pasting surface approximately 1.7 mm after the pasting. As a result, the tension generated as the center portion is bent acts on the elastic sealing member 12*s*2. In addition, the double-side adhesive 12*s*5 is stuck on the back side of the sealing member 12*s*2. Therefore, the sealing member 12*s*2 resists the force which works in the direction to peel the free long edge of the sealing member 12*s*2 in the direction shown in FIG. 32. In other words, the force which acts in the direction to pull the free long edge of the sealing member 12*s*2 in the direction shown in FIG. 32 ends up pulling the portion of the sealing member 12*s*2 from which the double-sided adhesive tape 12*d*5 is protruding. Therefore, the sealing member 12*s*2 is less likely to be bent as shown in FIG. 32 by the toner pressure.

Since the sealing member 12*s*2 is pasted as described above, it is possible to prevent the toner pressure from causing the phenomenon that the free edge portion of the sealing member 12*s*2 is peeled away from the peripheral surface of the development roller 9*c* by the toner pressure.

Although it was stated in the preceding paragraph that the sealing member 12*s*2 was pulled by the two points indicated by the referential code P in FIG. 26, the sealing member 12*s*2 may be pasted in such a manner that the portion between the two points P is first pasted to the pasting surface, and then, the lengthwise end portions are pasted while being kept slightly bent in the direction opposite to the development roller 9*c*.

[Process for Refilling Toner Container with Toner]

Figure 28:
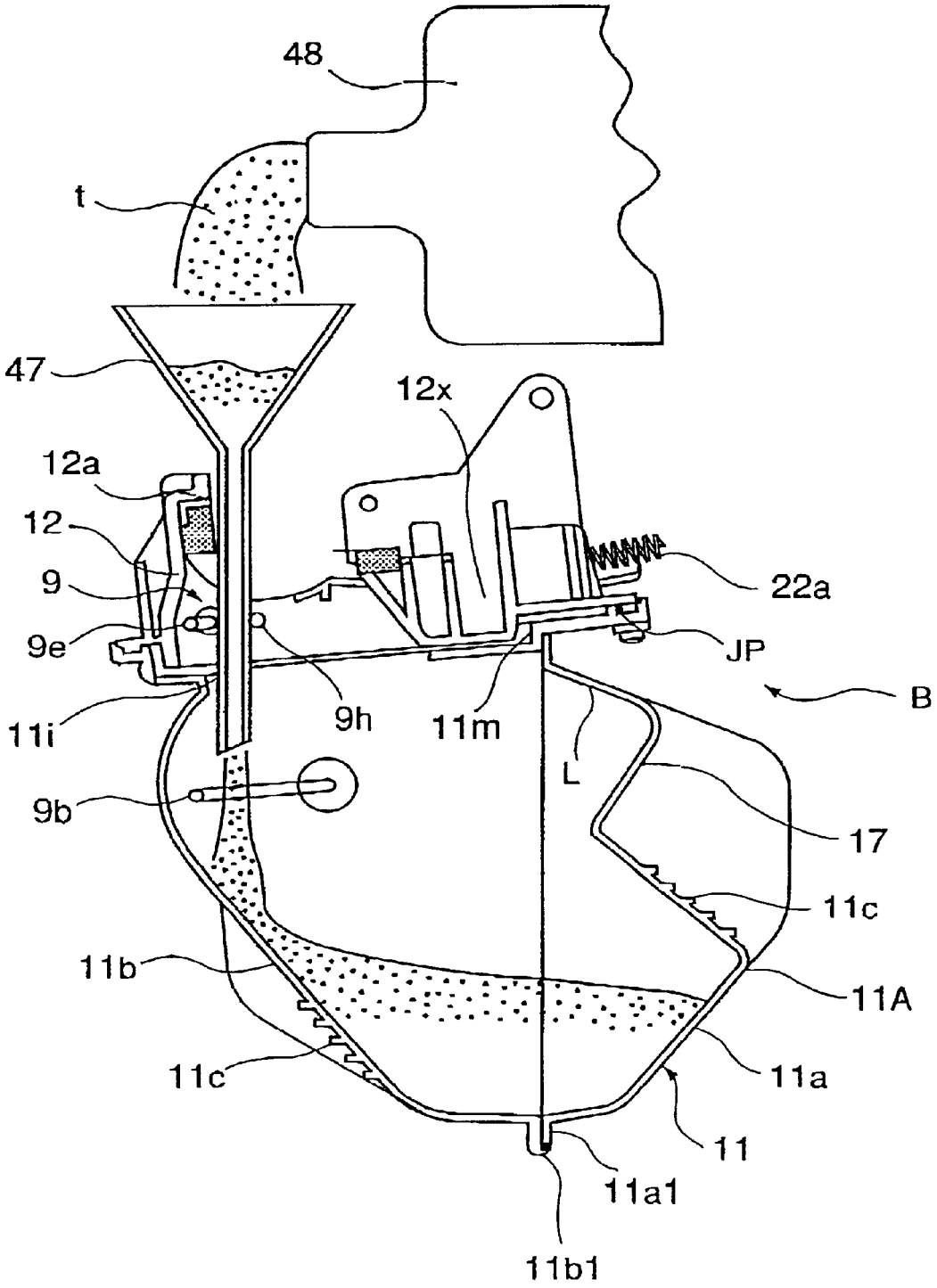
FIG. 28 is a longitudinal sectional view illustrating a refilling step of toner.

Next, the toner container 11A is refilled with toner. Referring to FIG. 28, this process is to be carried out with the development unit D held so that the opening 11*i* faces upward and the toner container 11A is positioned at the bottom. First, the end of a funnel 47 is inserted into the opening 11*i*, and the toner t is allowed to fall into the toner container 11A from the funnel 47. With the use of an automatic filling apparatus equipped with a funnel which contains an auger, and is enabled to release toner by a predetermined amount, it is possible to more efficiently refill the toner container 11A with toner.

[Process for Reattaching Development Blade]

Figure 30:
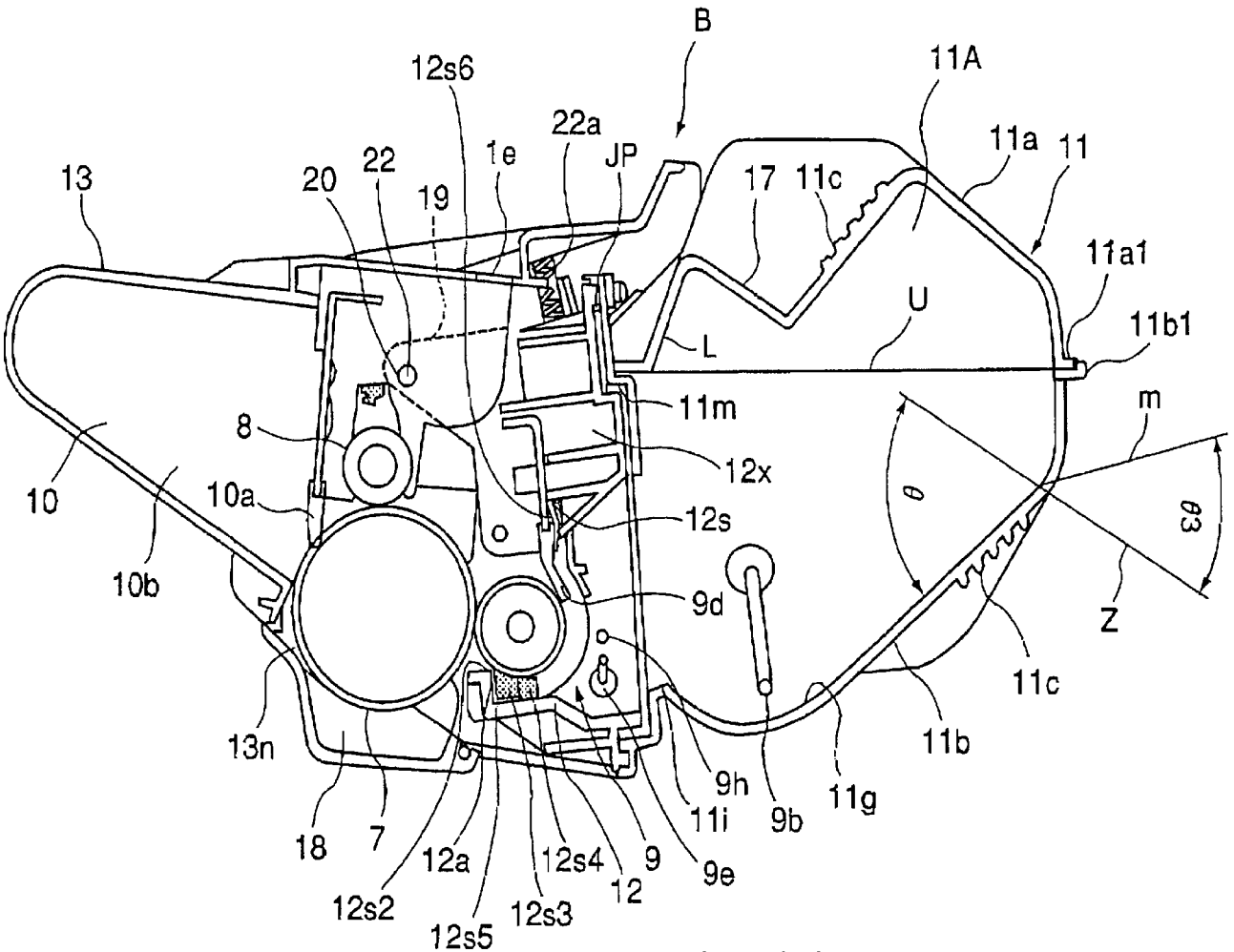
FIG. 30 is a longitudinal sectional view of a process cartridge remanufactured by the present invention.

Next, the development blade 9*d* is reattached to the developing means holding frame 12. When reattaching the development blade 9*d*, first, the toner particles adhering to the development blade 9*d* are removed by blowing air or the like upon the development blade 9*d*, and then, the development blade 9*d* is attached in reverse in terms of the front and back to the development blade 9*d*, for the following reason. That is, referring to FIG. 2 and 22, in a brand-new cartridge, the bent portion 9*d*1*a* of the metallic plate 9*d*1 of the development blade 9*d* is facing the toner container 11A. In comparison, when remanufacturing a cartridge, the development blade 9*d* is attached to the developing means holding frame 12 so that the bend portion 9*d*1 faces the photosensitive drum 7 as shown in FIGS. 22 and 30.

Next, the reason for reattaching the development blade 9*d* in reverse will be described.

As described before, the silicone rubber portion 9*d*2 of the development blade 9*d* regulates the amount by which toner is borne on the peripheral surface of the development roller 9*c*, so that a predetermined amount of toner is borne on the peripheral surface of the development roller 9*c* as the development roller 9*c* is rotated for image formation. It also gives toner a predetermined amount of triboelectric charge. Thus, while the development roller 9*c* rotates, the corner portion of the rubber portion 9*d*2 continuously rubs against toner, being thereby gradually shaved by the toner particles. Eventually, a substantial number of scars appear across the corner portion of the rubber portion 9*d*2, extending in the rotational direction of the development roller 9*c*. These scars keep on growing, resulting in the formation of defective images, for example, images having scratchy lines, images uneven in density, or the like. In the case of a brand-new process cartridge, the development blade 9*d* is provided with a sufficient amount of margin for ensuring that the aforementioned scars do not develop enough to produce defective images before the service life of the cartridge expires, more specifically, before the cartridge becomes depleted of toner. However, if a process cartridge, the service life of which had expired, is remanufactured for reuse, it is possible that the scars of the silicon rubber portion 9*d*2 will grow beyond the tolerable range, effecting image defects, during the second life of the process cartridge. In order to prevent this problem, it is possible to examine all the scars of the silicon rubber portion 9*d*2 to find out if it is usable for remanufacture, before starting to remanufacture the cartridge from which the silicon rubber portion 9*d*2 came. However, it is not easy to count a large number of scars, or to measure the thickness of each scar. For example, it requires expensive measuring devices such as a microscope or a surface roughness gauge, as well as a substantial amount of time. Thus, in this embodiment, based on the fact that the back surface of the silicon rubber portion 9*d*2 is not frictionally scarred by toner, the development blade 9*d* is attached in reverse, in terms of the front and back sides, to the developing means holding frame 12 when remanufacturing the cartridge. Reusing the original development blade 9*d* in the above described manner makes it possible for the original development blade 9*d*, which was scarred, to perform just as well as a brand-new development blade 9*d*, which is free of scars.

Figure 31:
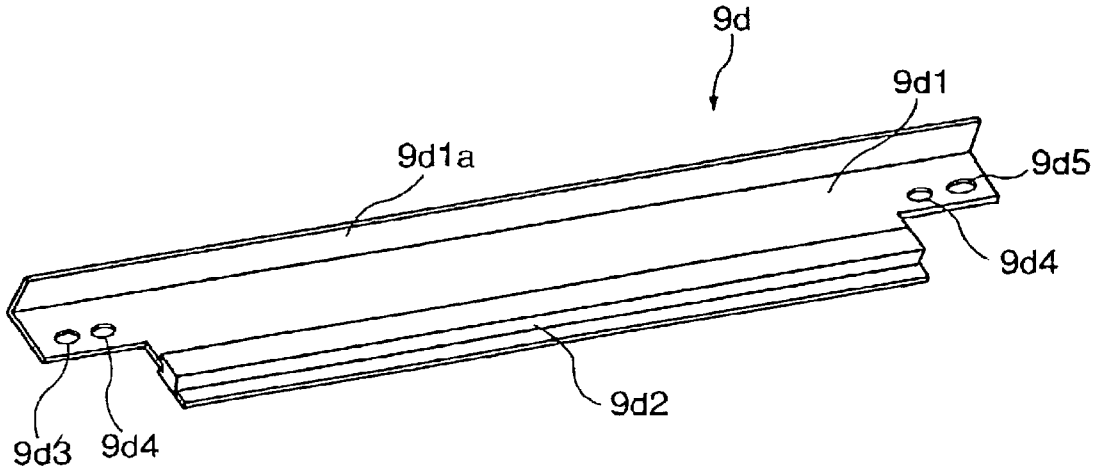
FIG. 31 is a perspective view of a developing blade to be used in a remanufactured process cartridge.

The state of the development blade 9*d* in a process cartridge prior to remanufacturing, that is, the state of the development blade 9*d* in a brand-new process cartridge, is as follows. Referring to FIGS. 2 and 11, in order to prevent the bent portion 9*d*1*a* of the metallic plate 9*d*1 from interfering with the developing means holding frame 12 as the development blade 9*d* is mounted so that the bent portion 9*d*1*a* faces the toner container 11A, the developing means holding frame 12 is provided with a recess 12*x*. Further, referring to FIG. 31, the development blade 9*d* is made virtually symmetrical, except for the presence of the positioning holes 9*d*3 and the elongated hole 9*d*5, with reference to the center line in terms of the lengthwise direction. Thus, in this embodiment, the holes 9*d*3, elongated hole 9*d*5, and screw holes 9*d*4 of the metallic plate 9*d*1 are positioned so that even if the development blade 9*d* is placed in reverse in terms of the front and back sides, they align with the joggles 12*i*1 and screw holes 12*i*2 of the lengthwise ends of the flat surface 12*i* (FIG. 11) as a blade holding portion, respectively. Thus, when attaching the development blade 9*d* in reverse, all that happens is that the hole 9*d*3 and elongated hole 9*d*5 of the left end portion of the development blade 9*d*, which originally corresponded to the hole and joggle of the left end portion of the developing means holding frame 12, are made to correspond to the hole and joggle of the right end portion of the developing means holding frame 12, and that the hole 9*d*3 and elongated hole 9*d*5 of the right end portion of the development blade 9*d*, which originally corresponded to the hole and joggle of the right end portion of the developing means holding frame 12, are made to correspond to the hole and joggle of the left end portion of the developing holding means frame 12. Therefore, the development blade 9*d* can be attached in reverse to the flat surface 12*i* with the same accuracy as that with which it was originally attached to the flat surface 12*i*. When reattaching the development blade 9*d* in reverse in terms of the front and back sides, it is attached in the same manner as it was originally attached: the screws 9*d*6 are put through the screws holes 9*d*4, and are screwed into the aforementioned female-threaded holes 12*i*2 to solidify attach the metallic plate 9*d*1 to the flat surface 12*i*. In this embodiment, originally, the development roller 9*c* is attached to the developing holding means frame 12 so that the bent portion 9*d*1*a* faces the toner container 11A, whereas when remanufacturing a process cartridge, it is attached so that the bent portion 9*d*1*a* faces the photosensitive drum 7 on the opposite side. However, the manner in which the development roller 9*c* is attached does not need to be limited to the above described one. For example, there will be no problem even if the development blade 9*d* is originally attached to the developing holding means frame 12 so that it faces the photosensitive drum 7, whereas when remanufacturing a process cartridge, it is attached so that it faces the toner container 11A. Obviously, there will be also no problem in terms of process cartridge remanufacture, even if the right hole 9*d*3 and right elongated hole 9*d*5, which are the holes for positioning the development blade 9*d*, are switched in location with the left hole 9*d*3 and left elongated hole 9*d*5, which also are the holes for positioning the development blade 9*d*. Further, although the metallic plate 9*d*1 of the development blade 9*d* is provided with the bent portion 9*d*1*a*, the provision of the bent portion 9*d*1*a* is not mandatory: even if the metallic plate 9*d*1 is flat, there is no problem in terms of the process cartridge remanufacturing method. If the metallic plate 9*d*1 is flat, it is unnecessary to provide the developing means holding frame 12 with the recess 12*x*. Further, in this embodiment, the portion of the development blade 9*d*, which is placed in contact with the development roller 9*c*, was formed of silicone rubber. However, the material therefor does not need to be limited to silicone rubber. For example, it may be synthetic rubber (urethane rubber or the like), natural rubber, or the like; in other words, it may be any elastic substance, the elasticity of which can be used to maintain a predetermined amount of contact pressure between the development blade 9*d* and development roller 9*c*.

[Process for Reattaching Development Roller]

Next, the development roller unit G is attached.

The development roller 9*c*, spacer rings 9*i*, and development roller gear 9*k*, are removed from the development roller unit G, which had been removed in the preceding section [Process for Removing Development Roller Unit], and the toner particles adhering thereon are removed by blowing air or the like upon them. Then, they are examined to determine whether or not they are reusable. Those which do not meet the performance requirements will be replaced with brand-new ones. If a certain component is known, through the studies made in the development process or remanufacture process, to be high in statistical probability with which it needs to be replaced during process cartridge remanufacture, it should be replaced with a brand-new one without being examined, in order to improve remanufacture efficiency. The flange 9*p*, magnet 9*g* in the development roller 9*c*, journal 9*w*, and development bias electrode 9*l* in the form of a coil spring, are not separated from their counterparts. After the completion of a series of the above described cleaning and examining operations, the components are reattached to the development roller unit G. Then, the reassembled development roller unit G is reattached to the developing means holding frame 12 by reattaching the bearing box 9*v* and unit DG to the developing means holding frame 12 by screwing the screws (unshown) into the lateral plates 12B and 12A, as it was when it was new.

[Process for Remanufacturing Cleaning Unit]

Next, the cleaning unit is remanufactured.

Referring to FIGS. 8 and 9, the photosensitive drum 7 is provided with the flange 36 attached to one of the lengthwise ends of the photoconductive drum 7 by crimping, gluing, or the like. It also is provided with the spur gear 7*n*, which is fixed to the other lengthwise end. The flange gear 36 is rotationally attached to the cleaning means holding frame 13 with the interposition of the bearing 38, whereas the gear 7*n* is rotationally attached to the cleaning means holding frame 13 by the flange 29 integrally comprising the drum shaft 7*a*, large diameter shaft portion 7*a*2, and guide 13*a*L. Referring to FIG. 19, the bearing 38 is attached to the cleaning means holding frame 13 with the use of the pair of screws 13*a*R2. Referring to FIG. 5, the flange 29 is attached to the cleaning means holding frame 13, with the use of the pair of screws 13*d*. Therefore, the photosensitive drum 7 can be removed from the cleaning means holding frame 13 by removing the bearing 38 and flange 29.

Figure 29:
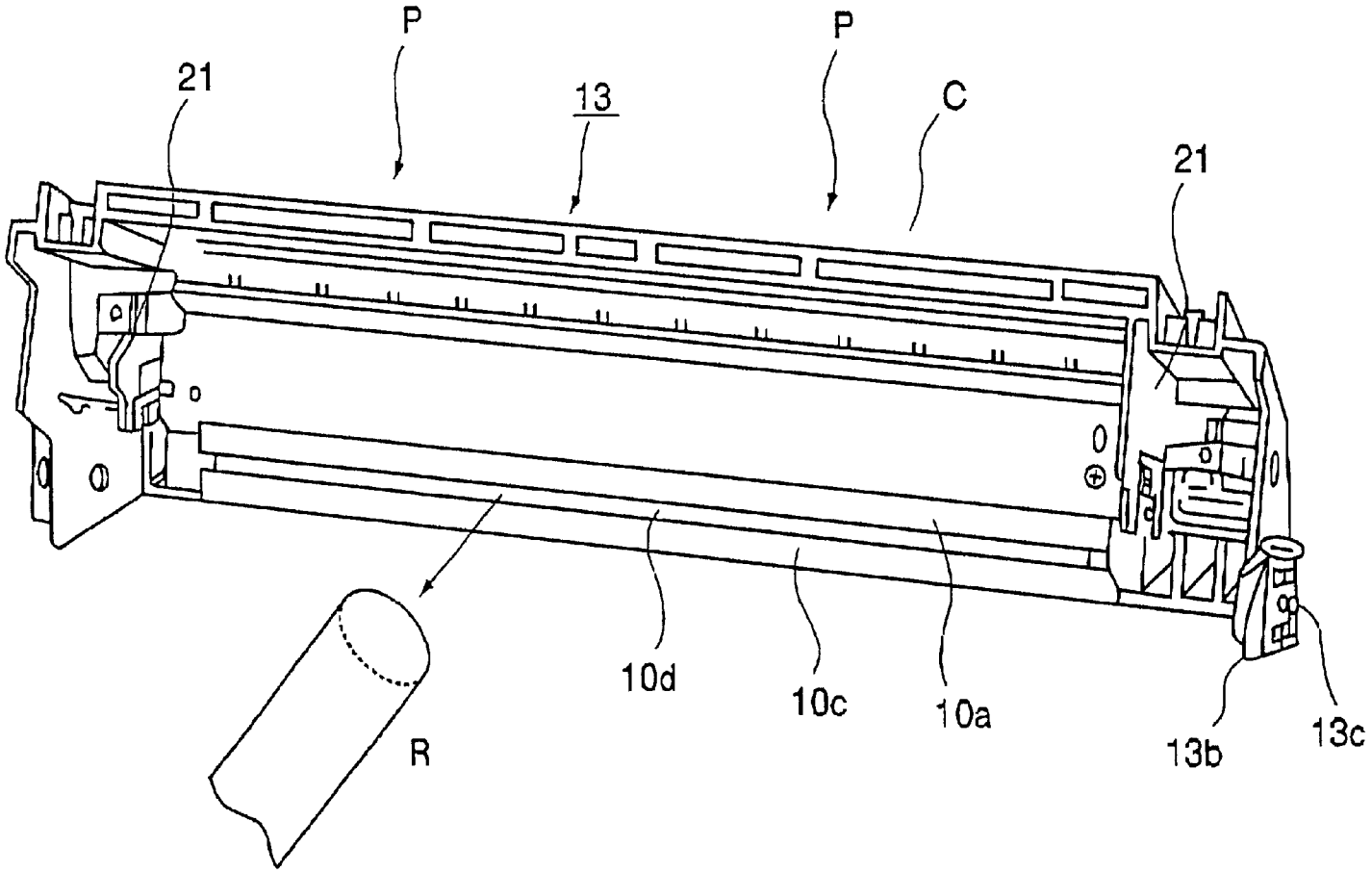
FIG. 29 is a perspective view illustrating a cleaning operation for a cleaning frame.

Next, referring to FIG. 29, the cleaning unit C from which the photosensitive drum 7 has been removed is placed on an appropriate table, as is fixed thereto. Then, the suctioning opening of a vacuuming apparatus (unshown) is pressed on the cleaning unit C, across the gap 10*b* between the blade 10*a* and toner catching sheet 10*c*, by holding the suction nozzle R of the vacuuming apparatus by hand. Then, in order to suction the removed toner in the cleaning unit C, the suction nozzle R is horizontally moved along the gap 10*d*, while keeping the opening of the suction nozzle R aligned with the gap 10*d* and tapping the top surface of the cleaning unit C on the location indicated by an arrow mark P. After the completion of the extraction of the removed toner, the blade 10*a* and toner catching sheet 10*c* are removed from the cleaning unit C, and then, the interiors of the cleaning means holding frame 13 and removed toner bin 10*b* are cleaning by air or the like. Upon the removed photosensitive drum 7 and blade 10*a*, air or the like is blown to remove the toner adhering thereto. Thereafter, each component is examined to determine whether or not it is reusable. After the examination, those which do not meet their performance standards are replaced with brand-new ones. However, if a certain component is known, through the statistical studies made in the development process or remanufacture process, to be high in probability with which it needs to be replaced during process cartridge remanufacture, it should be replaced with a brand-new one without being examined, in order to improve remanufacture efficiency. Thus, a brand-new blade 10*a* or a reusable blade 10*a*, and a brand-new toner catching sheet 10*c*, are attached to the cleaning means holding frame 13. Then, a brand-new photosensitive drum 7 or a reusable photosensitive drum 7 is rotationally attached to the cleaning means holding frame 13 by attaching the bearing 38 and flange 29 to the cleaning means holding frame 13 with the use of the pair of screws 13*a*R2 (FIG. 19) and the pair of screws 13*d* (FIG. 18).

[Unit Rejoining Process for Rejoining Development Unit and Cleaning Unit]

The development unit D, which has been remanufactured through the [Process for Removing Development Roller], [Process for Removing Development Blade], [Process for Removing Elastic Sealing Member], [Process for Attaching Thin Plate], [Process for Attaching Second Auxiliary Seal for Adjacencies of Development Roller], [Process for Pasting Elastic Sealing Member], the [Process for Refilling Toner Container with Toner] and [Process for Reattaching Development Roller], and the cleaning unit C, which has been remanufactured through the [Process for Remanufacturing Cleaning Unit], are united following in reverse [Process for Separating Development Unit and Cleaning Unit]. In other words, as described in {Structure of Housing of Process Cartridge B}, the end portion of each of the pair of arms 19 of the end portions of the developing holding means frame 12 (FIG. 10) in terms of the lengthwise direction (axial direction of development roller 9*c*) is inserted into the recess 21 of the corresponding end portion of the cleaning means holding frame 13 (FIG. 9), which is provided for accommodating the arm 19. Thereafter, the pair of connecting members 22 are pressed into the corresponding holes 13*e* of the cleaning means holding frame 13, are put through the through holes in the end portions of the arm portion 19*s*, and are pressed into the inward holes 13*e* of the cleaning means holding frame 13, being secured to the cleaning means holding frame 13. As a result, the development unit D and cleaning unit C are connected to each other, being allowed to rotate about the connecting members 22.

Given above are the essential process cartridge remanufacturing processes in this embodiment of the present invention. The above described process cartridge remanufacturing method is only one of the examples of the process cartridge remanufacturing methods in accordance with the present invention. Thus, the processes and methods, in accordance with the present invention, for remanufacturing a process cartridge does not need to be limited to the above described ones. Hereinafter therefore, the above given description of the process cartridge remanufacturing method in accordance with the present invention will be supplemented in order to ensure that the present invention is correctly understood.

First, in the preceding description of the present invention, the [Process for Remanufacturing Cleaning Unit] was described after the [Process for Reattaching Development Roller]. This does not necessarily means that the [Process for Remanufacturing Cleaning Unit] is to be carried out after the [Process for Reattaching Development Roller]. Since the development unit and cleaning unit are separated from each other in the [Process for Separating Development Unit from Cleaning Unit], they can be discretely remanufactured, or remanufactured in parallel at the same time. Of course, the cleaning unit may be remanufactured after the development unit, or vice versa. Similarly, even if the [Process for Attaching Thin Plate] is carried after the [Process for Pasting Thin Elastic Sealing Member], there will be no problems.

Secondary, in the above described [Process for Refilling Toner Container with Toner], toner was filled through the opening 11*i* as shown in FIG. 28. Therefore, this process was carried out between the [Process for Pasting Elastic Sealing member] and the [Process for Reattaching Development Blade]. However, the opening through which the toner container is refilled with toner does not need to be limited to the opening 11*i*. For example, the toner container may be refilled with toner through the toner filling opening 11*d* of the toner holding frame 11. In this case, toner will leak if the opening 11*i* is left exposed, and therefore, for the purpose of improving remanufacturing efficiency, the toner container should be refilled with toner after the [Process for Reattaching Development Roller Unit].

Thirdly, the development blade and development roller unit having been removed from the development unit, and the photosensitive drum and cleaning blade having been removed from the cleaning unit, are not necessarily reattached to the very development unit and cleaning unit, respectively, from which they were removed. For example, in the case that the remanufacturing processes are carried out using the assembly line, or the like cases, all the development blades removed from the development units are gathered in units of a predetermined number and stored in a tote box or the like, are cleaned with air, and are brought to the reattachment line. Thus, a development blade is not necessarily reattached to the development unit to which it had been attached. As long as all the removed development blades belong to the same model, they are same in size and shape, although admittedly that there are some differences among them resulting from a predetermined tolerance. Thus, it is unnecessary for each development blade to be reattached to the original development unit. The same principle applies to the development roller unit, the photosensitive drum, and the cleaning blade. Further, for the same reason, even in the case of the combination of development and cleaning units, a development unit is not necessarily connected to the cleaning unit to which it originally belonged; it is unnecessary for a development unit to be connected to the cleaning unit to which it original belonged.

Further, it is needless to say that the above described various processes may be automated with the use of robots. Not only is the present invention applicable to a process cartridge, such as the above described process cartridge B, for forming a monochromatic image, but also a cartridge which is for forming a multicolor image (for example, two-toner image, three-toner image, full-color image, and the like), and which comprises a plurality of developing means. Regarding the charging means structure, in the above described first embodiment, the so-called contact charging method was employed. However, it is also needless to say that the structure used for uniformly charging the peripheral surface of the photosensitive drum 7 may be such a known structure that a piece of tungsten wire is shielded on three sides with a metallic shield formed of aluminum or the like, and that positive or negative ions generated by applying high voltage to the tungsten wire are transferred onto the peripheral surface of the photosensitive drum 7 to charge the photosensitive drum 7. As for the type of a charging means, the charging means may be in the form of a blade (charge blade), a pad, a block, a rod, a wire, and the like, in addition to a roller. Further, as for the means for cleaning the toner remaining on the peripheral surface of the photosensitive drum 7, it may be in the form of a blade, a fur brush, a magnetic brush, or the like.

[Structure of Brand-new Process Cartridge]

In the preceding sections, cartridge remanufacture was described. However, the above described cartridge structure arrangement is also applicable to a brand-new cartridge.

More specifically, the process cartridge B removably mountable in the main assembly of an electrophotographic image forming apparatus is structured as follows.

The process cartridge B comprises: the cleaning means holding frame 13 as a first frame for supporting the electrophotographic photosensitive drum 7; toner holding frame 11 as a second frame, which supports the development roller 9*c* for developing the electrostatic latent image formed on the photosensitive drum 7, and has the toner container 11A as a developer storage portion for storing the developer used by the development roller 9*c* of developing the electrostatic latent image; and the developing means holding frame 12 connected to the cleaning means holding frame 13 (first frame) so that the former and latter are allowed to rotate relative each other. Further, the process cartridge B comprises: the elastic sealing member 12*s*2, one of the edge of which in terms of the widthwise direction is placed in contact with the peripheral surface of the development roller 9*c* to prevent the developer from leaking from between the developing means holding frame 12 (second frame) and development roller 9*c*; the piece of double-sided adhesive tape 12*s*5, which extends in the lengthwise direction of the developing means holding frame 12, and the two adhesive surfaces of which adhere to the elastic sealing member 12*s*2, and the developing means holding frame 12 (second frame), one for one, to attach the elastic sealing member 12*s*2 to the developing means holding frame 12 (second frame), wherein one of the edge portions of the double-sided adhesive tape 12*s*5, in terms of the widthwise direction, protrudes from the edge 12*a* (FIGS. 28, 30 and 32) of the developing means holding frame 12 (second frame) toward the development roller 9c.

The distance one of the edge portions of the double-sided adhesive tape 12*s*5, in terms of the width direction, protrudes from the edge 12*a* of the developing means holding frame 12 (second frame) is greater across the center portion than across the lengthwise end portions.

The preceding embodiment of the present invention includes a case in which a plurality of process cartridges, the service lives of which have expired, are recovered and disassembled; the components removed from the process cartridges through disassembly were sorted; and process cartridges are remanufactured using the sorted components, or brand-new components if necessary (in the case of nonrecyclable component) and the above described cartridge remanufacturing method. It also includes a case in which a process carriage, the service life of which has expired, is recovered and disassembled; and the process cartridge is remanufactured using the components removed from the process cartridge, brand-new components if necessary (in the case of nonrecyclable component), or the components removed from the other process cartridge, and also using the above described cartridge remanufacturing method.

As described above, the present invention provides a simple method for remanufacturing a process cartridge. It also makes it possible to provide a process cartridge from which developer is not likely to leak.

While the invention has been described with reference to the structures disclosed herein, it is not confined to the details set forth and this application is intended to cover such modifications or changes as may come within the purposes of the improvements or the scope of the following claims.

What is claimed is:

1. A remanufacturing method for a process cartridge detachably mountable to a main assembly of an electrophotographic image forming apparatus, wherein the process cartridge comprises a first frame supporting an electrophotographic photosensitive drum and a second frame which supports a developing roller configured and positioned to develop an electrostatic latent image formed on the electrophotographic photosensitive drum and which includes a developer accommodating portion accommodating a developer to be used for development of the electrostatic latent image by the developing roller, wherein the first frame and the second frame are rotatably coupled relative to each other, said remanufacturing method comprising:

(a) a separating step of separating the first frame and the second frame from each other;

(b) a developing roller dismounting step of dismounting the developing roller mounted in the second frame;

(c) an elastic sealing member peeling step of peeling off an elastic sealing member providing sealing between the second frame and the developing roller, wherein the elastic sealing member has been stuck in a longitudinal direction of the second frame;

(d) an elastic sealing member sticking step of sticking a double coated tape on a seat on which the elastic sealing member has been stuck in a widthwise direction of the seat such that it protrudes to provide a protrusion protruding toward the developing roller and resticking an elastic sealing member using the double coated tape;

(e) a developer filling step of filling developer into the developer accommodating portion;

(f) a developing roller mounting step of mounting a developing roller to a second frame; and (g) a frame coupling step of coupling separated first and second frames with each other.

2. A remanufacturing method for a process cartridge detachably mountable to a main assembly of an electrophotographic image forming apparatus, wherein the process cartridge comprises a first frame supporting an electrophotographic photosensitive drum and a second frame which supports a developing roller configured and positioned to develop an electrostatic latent image formed on the electrophotographic photosensitive drum and which includes a developer accommodating portion accommodating a developer to be used for development of the electrostatic latent image by the developing roller, wherein the first frame and the second frame are rotatably coupled relative to each other, said remanufacturing method comprising:

(a) a separating step of separating the first frame and the second frame from each other;

(b) a developing roller dismounting step of dismounting the developing roller mounted in the second frame;

(c) an elastic sealing member peeling step of peeling off an elastic sealing member providing sealing between the second frame and the developing roller, wherein the elastic sealing member has been stuck in a longitudinal direction of the second frame;

(d) a second developing roller end portion auxiliary seal mounting step of mounting a second developing roller end portion auxiliary seal along an inside of a developing roller end portion seal configured and positioned to seal an end of the developing roller mounted to the second frame, at a developing roller side of a first developing roller end portion auxiliary seal which has been mounted at a position covered by the elastic sealing member, adjacent the first developing roller end portion auxiliary seal;

(e) an elastic sealing member sticking step of sticking a double coated tape on a seat on which the elastic sealing member has been stuck in a widthwise direction of the seat such that it protrudes to provide a protrusion protruding toward the developing roller and resticking an elastic sealing member using the double coated tape;

(f) a developer filling step of filling the developer into the developer accommodating portion;

(g) a developing roller mounting step of mounting a developing roller to a second frame; and (h) a frame coupling step of coupling separated first and second frames with each other.

3. A remanufacturing method according to claim 1 or 2, further comprising a developing blade dismounting step of dismounting a developing blade from the second frame after said developing roller dismounting step, and a developing blade mounting step of mounting a developing blade to the second frame prior to said developing roller mounting step.

4. A remanufacturing method according to claim 1 or 2, wherein the elastic sealing member stuck in said elastic sealing member sticking step has a thickness which is larger than a thickness of the elastic sealing member which has been stuck.

5. A remanufacturing method according to claim 1 or 2, wherein a dimension of the elastic sealing member stuck in said elastic sealing member sticking step, measured in the widthwise direction, is larger than that of the elastic sealing member which has been stuck, and protrudes toward the developing roller.

6. A remanufacturing method according to claim 1 or 2, wherein the distance of the protrusion of the double coated tape is larger in a longitudinal central portion than longitudinal end portions thereof.

7. A remanufacturing method according to claim 3, wherein the developing blade to be mounted to the second frame in said developing blade mounting step is the developing blade removed from the second frame of the process cartridge or a developing blade removed from a second frame of another process cartridge.

8. A remanufacturing method according to claim 1 or 2, wherein the developing roller mounted to the second frame in said developing roller mounting step is the developing roller dismounted from the second frame of the process cartridge or a developing roller dismounted from a second frame of another process cartridge.

9. A remanufacturing method according to claim 1 or 2, wherein in said frame coupling step, said coupled frames comprise the first frame separated in said frame separating step or a first frame removed from another process cartridge, and the second frame separated in said frame separating step or a second frame removed from another process cartridge.

10. A remanufacturing method according to claim 1 or 2, wherein the electrophotographic photosensitive drum and a cleaning blade for removing the developer remaining on the electrophotographic photosensitive drum are dismounted from the first frame prior to said frame coupling step, and the developer removed from the electrophotographic photosensitive drum by the cleaning blade is removed.

11. A remanufacturing method according to claim 10, wherein the electrophotographic photosensitive drum is replaced with a new electrophotographic photosensitive drum or is reused; the developing roller is replaced with a new developing roller or is reused; the cleaning blade is replaced with a new cleaning blade or is reused.

12. A remanufacturing method according to claim 11, wherein the reused electrophotographic photosensitive drum is the electrophotographic photosensitive drum removed from the first frame of said process cartridge or is an electrophotographic photosensitive drum removed from a first frame of another process cartridge; the reused developing roller is the developing roller removed from the second frame of said process cartridge or is a developing roller removed from a second frame of another process cartridge; and the reused cleaning blade is the cleaning blade removed from the first frame of the process cartridge or is a cleaning blade removed from a first frame of another process cartridge.

13. A remanufacturing method according to claim 1 or 2, wherein in said developer filling step, the developer is filled through a developer supply opening for supplying the developer from the developer accommodating portion to the developing roller.

14. A remanufacturing method according to claim 1 or 2, wherein in the remanufacturing method, a sealing member for sealing a developer supply opening is kept pulled out to supply the developer from the developer accommodating portion to the developing roller.

15. A remanufacturing method according to claim 1 or 2, wherein in said elastic sealing member sticking step, an elastic sealing member is stuck on one side of the double coated tape, and then, the other side of the double coated tape is stuck on the seat.

16. A remanufacturing method for a process cartridge detachably mountable to a main assembly of an electrophotographic image forming apparatus, wherein the process cartridge comprises a first frame supporting an electrophotographic photosensitive drum and a second frame which supports a developing roller configured and positioned to develop an electrostatic latent image formed on the electrophotographic photosensitive drum and which includes a developer accommodating portion accommodating a developer to be used for development of the electrostatic latent image by the developing roller, wherein the first frame and the second frame are rotatably coupled relative to each other, said remanufacturing method comprising:

(a) a separating step of separating the first frame and the second frame from each other;

(b) a developing roller dismounting step of dismounting the developing roller mounted in the second frame;

(c) a developing blade dismounting step of dismounting from the second frame a developing blade configured and positioned to regulate the amount of the developer deposited on the developing roller mounted on the second frame;

(d) an elastic sealing member dismounting step of dismounting an elastic sealing member configured and positioned to seal between the second frame and the developing roller extended in a longitudinal direction of the second frame;

(e) a sheet material mounting step of mounting a sheet material on such a side of a longitudinal developing blade seal for the developing blade configured and positioned to seal between the second frame and the developing blade which has been mounted along a longitudinal direction of the second frame as is opposite the side mounted to the second frame;

(f) a second developing roller end portion auxiliary seal mounting step of mounting a second developing roller end portion auxiliary seal along an inside of a developing roller end portion seal configured and positioned to seal an end of the developing roller mounted to the second frame, at a developing roller side of a first developing roller end portion auxiliary seal which has been mounted at a position covered by the elastic sealing member, adjacent the first developing roller end portion auxiliary seal;

(g) an elastic sealing member sticking step of sticking a double coated tape on a seat on which the elastic sealing member has been stuck in a widthwise direction of the seat such that it protrudes to provide a protrusion protruding toward the developing roller and resticking an elastic sealing member using the double coated tape;

(h) a developer filling step of filling developer into the developer accommodating portion;

(i) a developing blade mounting step of mounting the developing blade to the second frame with a face orientation which is reverse from a face orientation when it has been mounted to the second frame and with the longitudinal developing blade seal disposed between the second frame and the developing blade;

(j) a developing roller mounting step of mounting a developing roller to a second frame; and (k) a frame coupling step of coupling separated first and second frames with each other.

17. A remanufacturing method according to claim 16, wherein the elastic sealing member stuck in said elastic sealing member sticking step has a thickness which is larger than a thickness of the elastic sealing member which has been stuck.

18. A remanufacturing method according to claim 16 or 17, wherein a dimension of the elastic sealing member stuck in said elastic sealing member sticking step, measured in the widthwise direction, is larger than that of the elastic sealing member which has been stuck, and is protruded toward the developing roller.

19. A remanufacturing method according to claim 16, wherein the distance of the protrusion of the double coated tape is larger in a longitudinal central portion than longitudinal end portions thereof.

20. A remanufacturing method according to claim 16 or 17, wherein the developing blade to be mounted to the second frame in said developing blade mounting step is the developing blade removed from the second frame of the process cartridge or a developing blade removed from a second frame of another process cartridge.

21. A remanufacturing method according to claim 16 or 17, wherein the developing roller mounted to the second frame in said developing roller mounting step is the developing roller dismounted from the second frame of the process cartridge or a developing roller dismounted from a second frame of another process cartridge.

22. A remanufacturing method according to claim 16, wherein in said frame coupling step, said coupled frames comprise the first frame separated in said frame separating step or a first frame removed from another process cartridge, and the second frame separated in said frame separating step or a second frame removed from another process cartridge.

23. A remanufacturing method according to claim 16 or 22, wherein the electrophotographic photosensitive drum and a cleaning blade configured and positioned to remove developer remaining on the electrophotographic photosensitive drum are dismounted from the first frame prior to said frame coupling step, and the developer removed from the electrophotographic photosensitive drum by the cleaning blade is removed.

24. A remanufacturing method according to claim 23, wherein the electrophotographic photosensitive drum is replaced with a new electrophotographic photosensitive drum or is reused; the developing roller is replaced with a new developing roller or is reused; the cleaning blade is replaced with a new cleaning blade or is reused.

25. A remanufacturing method according to claim 24, wherein the reused electrophotographic photosensitive drum is the electrophotographic photosensitive drum removed from the first frame of the process cartridge or is an electrophotographic photosensitive drum removed from a first frame of another process cartridge; the reused developing roller is the developing roller removed from the second frame of the process cartridge or is a developing roller removed from a second frame of another process cartridge; and the reused cleaning blade is the cleaning blade removed from the first frame of the process cartridge or is a cleaning blade removed from a first frame of another process cartridge.

26. A remanufacturing method according to claim 16, wherein in said developer filling step, the developer is filled through a developer supply opening for supplying the developer from the developer accommodating portion to the developing roller.

27. A remanufacturing method according to claim 16, wherein in the remanufacturing method, a sealing member configured and positioned to seal a developer supply opening is kept pulled out to supply the developer from the developer accommodating portion to the developing roller.

28. A remanufacturing method according to claim 16 or 17, wherein in said elastic sealing member sticking step, an elastic sealing member is stuck on one side of the double coated tape, and then, the other side of the double coated tape is stuck on the seat.

29. A process cartridge detachably mountable to a main assembly of an electrophotographic image forming apparatus, comprising:

a first frame supporting an electrophotographic photosensitive drum;

a second frame which supports a developing roller configured and positioned to develop an electrostatic latent image formed on the photosensitive drum and which includes a developer accommodating portion for configured to accommodate a developer to be used for development of the electrostatic latent image by the developing roller, wherein said first frame and said second frame are rotatably coupled relative to each other;

an elastic sealing member configured and positioned to prevent leakage of the developer through between said second frame and the developing roller with one lateral end thereof contacted to a peripheral surface of the developing roller; and a double coated tape configured and positioned to stick said elastic sealing member along a longitudinal direction of said second frame, wherein said elastic sealing member is stuck to one side of said double coated tape, and the other side of said double coated tape is stuck on said second frame along the longitudinal direction of said second frame, and wherein one lateral end of said double coated tape is protruded to provide a protrusion protruding beyond and along said second frame toward the developing roller.

30. A process cartridge according to claim 29, wherein the distance of the protrusion of said double coated tape is larger in a longitudinal central portion than longitudinal end portions thereof.

* * * * *

UNITED STATES PATENT AND TRADEMARK OFFICE

CERTIFICATE OF CORRECTION

PATENT NO. : 6,735,404 B2
DATED : May 11, 2004
INVENTOR(S) : Akira Higeta et al.

It is certified that error appears in the above-identified patent and that said Letters Patent is hereby corrected as shown below:

Title page,
Item [75], Inventors, "Akira Higeta, Shizuoka-ken (JP); Satoshi Yasuda, Toride (JP; Takayoshi Hoshi, Ibaraki-Ken (JP)" should read -- Akira Higeta, Shizuoka (JP); Satoshi Yasuda, Toride (JP); Takayoshi Hoshi, Toride (JP) --.
Item [30], Foreign Application Priority Data:
"Apr. 26, 2002 (J) ….2002/126157" should read -- Apr. 26, 2002 (JP) ….2002-126157 --.

Column 1,
Line 42, "value," should read -- value --.
Line 67, "comprising" should read -- comprising: --.

Column 2,
Line 31, "e" should read -- perspective --.

Column 4,
Line 4, "paper;" should read -- paper, --.

Column 5,
Line 62, "up" should read -- up --.

Column 6,
Line 43, "projection 18*cl*," should read -- projection 18*c1*, --.

Column 8,
Line 51, "width" should read -- widths --.

Column 9,
Line 42, "to" should read -- of --.

Column 13,
Line 4, "member 12*s*1" should read -- member 12*s* --.
Line 26, "place" should read -- placed --.
Line 64, "end" should read -- ends --.

Column 15,
Line 49, "plate-of" should read -- plate of --.

Column 17,
Line 63, "by-the" should read -- by the --.

UNITED STATES PATENT AND TRADEMARK OFFICE

CERTIFICATE OF CORRECTION

PATENT NO. : 6,735,404 B2
DATED : May 11, 2004
INVENTOR(S) : Akira Higeta et al.

It is certified that error appears in the above-identified patent and that said Letters Patent is hereby corrected as shown below:

Column 20,
Line 52, "in" should read -- in which --.

Column 21,
Line 38, "leaking the" should read -- leaking from the --.

Column 23,
Line 40, "seal" should read -- seals --.

Column 24,
Line 55, "member 12*s2*, in" should read -- member 12*s2*. In --.

Column 25,
Line 4, "surface" should read -- surface 2*h1* --.

Column 27,
Line 65, "tory:" should read -- tory; --.

Column 29,
Line 6, "cleaning" should read -- cleaned --.
Line 64, "does" should read -- do --.

Column 30,
Line 55, "original" should read -- originally --.

Column 31,
Line 33, "edge" should read -- edges --.
Line 61, "component)" should read -- components) --
Line 63, "carriage," should read -- cartridge, --.

Column 32,
Line 1, "component" should read -- components --.

UNITED STATES PATENT AND TRADEMARK OFFICE

CERTIFICATE OF CORRECTION

PATENT NO. : 6,735,404 B2
DATED : May 11, 2004
INVENTOR(S) : Akira Higeta et al.

It is certified that error appears in the above-identified patent and that said Letters Patent is hereby corrected as shown below:

Column 36,
Line 43, "for" should be deleted.

Signed and Sealed this

Ninth Day of November, 2004

JON W. DUDAS
*Director of the United States Patent and Trademark Office*